US010842281B2

(12) United States Patent
Battey et al.

(10) Patent No.: US 10,842,281 B2
(45) Date of Patent: Nov. 24, 2020

(54) CONTROL ASSEMBLY FOR CHAIR

(71) Applicant: Steelcase Inc., Grand Rapids, MI (US)

(72) Inventors: Robert J. Battey, Middleville, MI (US); Todd T. Andres, Sparta, MI (US); Todd David Krupiczewicz, Alto, MI (US); Kurt R. Heidmann, Grand Rapids, MI (US); Gordon Jay Peterson, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 16/241,439

(22) Filed: Jan. 7, 2019

(65) Prior Publication Data

US 2019/0133326 A1 May 9, 2019

Related U.S. Application Data

(63) Continuation of application No. 15/792,974, filed on Oct. 25, 2017, now Pat. No. 10,264,889, which is a (Continued)

(51) Int. Cl.
*A47C 7/44* (2006.01)
*A47C 3/025* (2006.01)
(Continued)

(52) U.S. Cl.
CPC ..... *A47C 7/44* (2013.01); *A47C 1/024* (2013.01); *A47C 1/032* (2013.01);
(Continued)

(58) Field of Classification Search
CPC ..... A47C 1/024; A47C 1/03255; A47C 1/032; A47C 1/03266; A47C 1/03272;
(Continued)

(56) References Cited

U.S. PATENT DOCUMENTS 1,763,001 A 6/1930 Masury
2,083,838 A 6/1937 Goenen
(Continued)

FOREIGN PATENT DOCUMENTS

CA 2395448 A1 4/2002
CA 2437074 A1 3/2004
(Continued)

OTHER PUBLICATIONS

Knoll, Inc., Generation by Knoll brochure, 2009, 18 pages.
(Continued)

*Primary Examiner* — Rodney B White
(74) *Attorney, Agent, or Firm* — Price Heneveld LLP

(57) ABSTRACT

A chair back assembly includes a back frame having a front surface and a rear surface and including a laterally extending cross member having opposite end portions, a back shell including a front surface, a rear surface positioned in front of the front surface of the back frame, a pair of laterally spaced side portions defining an opening therebetween, and a top portion extending laterally between and connected to the side portions, wherein the side portions are exclusively connected to the cross member at opposite ends of the cross member, wherein the connection between the side portions of the back shell and the end portions of the cross member are the only connections between the side portions of the back shell and the back frame, and a cover extending across the opening and connected to the side portions and the top portion of the back shell.

41 Claims, 40 Drawing Sheets

Related U.S. Application Data continuation of application No. 15/202,107, filed on Jul. 5, 2016, now Pat. No. 9,826,839, which is a continuation of application No. 14/624,850, filed on Feb. 18, 2015, now Pat. No. 9,408,467, which is a continuation of application No. 13/837,031, filed on Mar. 15, 2013, now Pat. No. 8,998,339, and a continuation-in-part of application No. 29/432,795, filed on Sep. 20, 2012, now Pat. No. Des. 683,150, application No. 16/241,439, which is a continuation-in-part of application No. 15/891,962, filed on Feb. 8, 2018, now Pat. No. 10,206,507, which is a continuation of application No. 15/256,012, filed on Sep. 2, 2016, now Pat. No. 9,918,552, which is a continuation of application No. 14/633,808, filed on Feb. 27, 2015, now Pat. No. 9,462,888, which is a continuation of application No. 14/029,243, filed on Sep. 17, 2013, now Pat. No. 9,022,476, and a continuation of application No. 29/432,765, filed on Sep. 20, 2012, now Pat. No. Des. 697,726, and a continuation of application No. 29/432,767, filed on Sep. 20, 2012, now Pat. No. Des. 697,727, said application No. 15/891,962 is a continuation-in-part of application No. 15/619,591, filed on Jun. 12, 2017, now Pat. No. 9,986,848, which is a continuation of application No. 14/678,065, filed on Apr. 3, 2015, now Pat. No. 9,706,853, which is a continuation of application No. 14/029,284, filed on Sep. 17, 2013, now Pat. No. 8,973,990, and a continuation of application No. 14/029,273, filed on Sep. 17, 2013, now Pat. No. 9,167,910, which is a continuation of application No. 29/432,776, filed on Sep. 20, 2012, now Pat. No. Des. 697,729, said application No. 15/619,591 is a continuation of application No. 29/432,776, filed on Sep. 20, 2012, now Pat. No. Des. 697,729.

(60) Provisional application No. 61/703,677, filed on Sep. 20, 2012, provisional application No. 61/703,666, filed on Sep. 20, 2012, provisional application No. 61/703,515, filed on Sep. 20, 2012, provisional application No. 61/703,663, filed on Sep. 20, 2012, provisional application No. 61/703,659, filed on Sep. 20, 2012, provisional application No. 61/703,661, filed on Sep. 20, 2012, provisional application No. 61/754,803, filed on Jan. 21, 2013, provisional application No. 61/703,667, filed on Sep. 20, 2012, provisional application No. 61/733,661, filed on Dec. 5, 2012.

(51) Int. Cl.

| | |
|---|---|
| ***A47C 3/026*** | (2006.01) |
| ***A47C 1/032*** | (2006.01) |
| ***A47C 7/18*** | (2006.01) |
| ***A47C 31/02*** | (2006.01) |
| ***A47C 7/40*** | (2006.01) |
| ***A47C 7/46*** | (2006.01) |
| ***A47C 1/024*** | (2006.01) |
| ***A47C 3/00*** | (2006.01) |
| ***A47C 7/00*** | (2006.01) |
| ***A47C 7/02*** | (2006.01) |
| ***A47C 7/24*** | (2006.01) |
| ***A47C 3/20*** | (2006.01) |
| ***A47C 7/54*** | (2006.01) |

(52) U.S. Cl.

CPC ..... *A47C 1/03255* (2013.01); *A47C 1/03266* (2013.01); *A47C 1/03272* (2013.01); *A47C 1/03274* (2018.08); *A47C 3/00* (2013.01); *A47C 3/20* (2013.01); *A47C 7/004* (2013.01); *A47C 7/006* (2013.01); *A47C 7/02* (2013.01); *A47C 7/185* (2013.01); *A47C 7/24* (2013.01); *A47C 7/40* (2013.01); *A47C 7/46* (2013.01); *A47C 7/462* (2013.01); *A47C 7/54* (2013.01); *A47C 31/023* (2013.01)

(58) Field of Classification Search

CPC .. A47C 3/00; A47C 7/006; A47C 7/02; A47C 7/24; A47C 7/40; A47C 7/46; A47C 7/462

USPC ..... 297/228.1, 228.11, 228.12, 228.13, 229, 297/452.13, 452.14, 452.56, 285, 296

See application file for complete search history.

(56) References Cited

U.S. PATENT DOCUMENTS

| | | | | |
|---|---|---|---|---|
| 2,120,036 | A | 6/1938 | Northrup | |
| 2,191,848 | A | 2/1940 | Cramer et al. | |
| 2,588,171 | A | 6/1951 | Chesley | |
| 2,587,822 | A | 3/1952 | Corning | |
| 2,725,096 | A | 11/1955 | Granby | |
| 3,066,435 | A | 5/1960 | Oddo et al. | |
| 3,059,971 | A | 10/1962 | Becker | |
| 3,120,407 | A | 2/1964 | Propst | |
| 3,174,797 | A | 3/1965 | Neufeld | |
| 3,311,408 | A | 3/1967 | Sarvas | |
| 3,438,099 | A | 4/1969 | Green | |
| 3,586,370 | A | 6/1971 | Barecki et al. | |
| 4,157,203 | A | 6/1979 | Ambasz | |
| 4,333,683 | A | 6/1982 | Ambasz | |
| 4,469,739 | A | 9/1984 | Gretzinger et al. | |
| 4,549,764 | A | 10/1985 | Haedo | |
| 4,711,491 | A | 12/1987 | Ginat | |
| 4,715,651 | A | 12/1987 | Wakamatsu | |
| 4,789,201 | A | 12/1988 | Selbert | |
| 4,837,878 | A | 6/1989 | Huemer | |
| 4,842,257 | A | 6/1989 | Abu-Isa et al. | |
| 4,869,552 | A | 9/1989 | Tolleson et al. | |
| 4,869,554 | A * | 9/1989 | Abu-Isa ..... | A47C 7/282 297/452.56 |
| 4,928,334 | A | 5/1990 | Kita | |
| 5,000,513 | A | 3/1991 | Schmidt | |
| 5,100,201 | A | 3/1992 | Becker, III et al. | |
| 5,249,839 | A | 10/1993 | Faiks et al. | |
| 5,338,092 | A | 8/1994 | Wiltsey et al. | |
| 5,439,267 | A | 8/1995 | Peterson et al. | |
| 5,478,134 | A | 12/1995 | Bernard et al. | |
| 5,518,292 | A | 5/1996 | Cozzani | |
| 5,544,943 | A | 8/1996 | Durling | |
| 5,560,677 | A | 10/1996 | Cykana et al. | |
| 5,599,067 | A | 2/1997 | Schuelke et al. | |
| 5,649,739 | A | 7/1997 | Zapf | |
| 5,704,689 | A | 1/1998 | Kim | |
| 5,716,096 | A | 2/1998 | Pryde et al. | |
| 5,725,276 | A | 3/1998 | Ginat | |
| 5,768,758 | A | 6/1998 | Deignan et al. | |
| 5,772,282 | A | 6/1998 | Stumpf et al. | |
| 5,868,467 | A | 2/1999 | Moll | |
| 5,871,258 | A | 2/1999 | Battey et al. | |
| 5,887,946 | A | 3/1999 | Raftery | |
| 5,904,397 | A | 5/1999 | Fismen | |
| 5,934,758 | A | 8/1999 | Ritch et al. | |
| 5,971,478 | A | 10/1999 | Hurite | |
| 5,975,634 | A | 11/1999 | Knoblock et al. | |
| 6,035,901 | A | 3/2000 | Stumpt et al. | |
| 6,039,397 | A | 3/2000 | Ginat | |
| D423,261 | S | 4/2000 | Ritch et al. | |
| 6,053,578 | A | 4/2000 | Van Hekken et al. | |
| 6,056,361 | A | 5/2000 | Cvek | |

(56) References Cited

U.S. PATENT DOCUMENTS 6,059,366 A 5/2000 Hu
6,059,368 A 5/2000 Stumpf et al.
6,076,892 A 6/2000 Van Hekken et al.
6,079,785 A 6/2000 Peterson et al.
6,086,156 A 7/2000 Breen et al.
6,113,186 A * 9/2000 Holmes ..... A47C 11/005 297/452.56 X
6,125,521 A 10/2000 Stumpf et al.
6,168,239 B1 1/2001 Conner et al.
6,178,595 B1 1/2001 Marinoni
6,220,661 B1 4/2001 Peterson
6,254,190 B1 7/2001 Gregory
6,257,665 B1 7/2001 Nagamitsu et al.
D446,033 S 8/2001 Koepke et al.
6,322,147 B1 11/2001 Leib
D451,723 S 12/2001 Grove
6,364,415 B1 4/2002 Mori et al.
6,367,877 B1 4/2002 Knoblock et al.
6,375,269 B1 4/2002 Maeda et al.
6,378,944 B1 4/2002 Weisser
6,382,719 B1 5/2002 Heidmann et al.
6,386,634 B1 5/2002 Stumpf et al.
6,394,546 B1 5/2002 Knoblock et al.
6,394,548 B1 5/2002 Battey et al.
6,394,549 B1 5/2002 Dekraker et al.
6,419,318 B1 7/2002 Albright et al.
6,439,661 B1 8/2002 Brauning
6,460,932 B1 10/2002 Kopish et al.
6,471,294 B1 10/2002 Dammermann et al.
6,499,801 B1 12/2002 Peterson et al.
6,502,904 B1 1/2003 Hansen
6,508,509 B2 1/2003 Peterson
6,523,898 B1 2/2003 Ball et al.
6,550,866 B1 4/2003 Su
6,554,360 B1 4/2003 Wilke et al.
6,572,190 B2 6/2003 Koepke et al.
6,588,842 B2 7/2003 Stumpf et al.
6,609,755 B2 8/2003 Koepke et al.
D479,416 S 9/2003 Raftery
6,616,228 B2 9/2003 Heidmann
6,619,746 B2 9/2003 Roslund, Jr. et al.
6,626,497 B2 9/2003 Nagamitsu et al.
6,644,749 B2 11/2003 Vanderiet et al.
6,669,292 B2 12/2003 Koepke et al.
6,669,294 B2 12/2003 Kinoshita et al.
6,688,690 B2 2/2004 Watson et al.
D487,359 S 3/2004 Giugiaro
6,698,839 B2 3/2004 Ballendat
6,702,390 B2 * 3/2004 Stumpf ..... A47C 1/03 297/452.56
6,709,058 B1 3/2004 Diffrient
6,709,060 B1 3/2004 Su
D488,314 S 4/2004 Chole et al.
6,722,741 B2 4/2004 Stumpf et al.
6,726,278 B1 4/2004 Albright et al.
6,726,286 B2 4/2004 Stumpf et al.
6,729,691 B2 5/2004 Koepke et al.
6,733,080 B2 5/2004 Stumpf et al.
6,739,663 B2 5/2004 Gevaert
D490,994 S 6/2004 Schmitz et al.
6,758,523 B2 7/2004 Vanderiet et al.
6,761,404 B2 7/2004 Parker et al.
6,761,406 B2 7/2004 Kinoshita et al.
D493,626 S 8/2004 James
D493,627 S 8/2004 Ma
D496,812 S 10/2004 Chu
D497,264 S 10/2004 Aubriet et al.
6,817,667 B2 11/2004 Pennington et al.
6,837,546 B2 1/2005 Vanderiet et al.
6,843,530 B1 1/2005 Wu
6,857,704 B2 2/2005 Stenzel et al.
6,874,852 B2 4/2005 Footit
6,880,215 B2 4/2005 Peterson
6,899,398 B2 * 5/2005 Coffield ..... A47C 7/282 297/452.56
D507,423 S 7/2005 Beaulieu et al.
6,913,306 B2 7/2005 Rosler et al.
6,913,315 B2 7/2005 Ball et al.
6,913,316 B2 7/2005 Kinoshita et al.
6,942,300 B2 9/2005 Numa et al.
6,945,601 B1 9/2005 Wu
6,945,605 B2 9/2005 Kinoshta et al.
6,948,775 B2 9/2005 Tsai
6,955,402 B2 10/2005 Vanderiet et al.
6,966,604 B2 11/2005 Stumpf et al.
6,976,737 B1 12/2005 Dandolo
6,983,997 B2 1/2006 Wilkerson et al.
6,988,774 B1 1/2006 Elzenbeck
D514,832 S 2/2006 Tsai
7,014,269 B2 3/2006 Coffield et al.
7,025,424 B2 4/2006 Harley
7,025,425 B2 4/2006 Harley
D521,755 S 5/2006 Kinoshita et al.
7,055,911 B2 6/2006 Simpson et al.
7,066,537 B2 6/2006 Coffield et al.
7,066,546 B2 6/2006 Trego et al.
7,066,550 B1 6/2006 Su
D527,920 S 9/2006 Giugiaro
D528,811 S 9/2006 Giugiaro
7,131,700 B2 11/2006 Knoblock et al.
7,134,722 B2 11/2006 Ueda et al.
7,147,288 B2 12/2006 Grasse et al.
D534,365 S 1/2007 Breen
D535,505 S 1/2007 Cai
7,159,947 B1 1/2007 Lee
D540,008 S 4/2007 Su
D540,079 S 4/2007 Su
D540,578 S 4/2007 Chen
D541,063 S 4/2007 Su
7,201,449 B2 4/2007 Tsai
7,213,880 B2 5/2007 Schmitz et al.
7,213,886 B2 5/2007 Schmitz et al.
7,216,933 B2 5/2007 Schmidt et al.
7,216,936 B2 5/2007 Peterson
D544,722 S 6/2007 Scheper et al.
D545,076 S 6/2007 Dallmann et al.
7,234,773 B2 6/2007 Raftery et al.
7,237,841 B2 7/2007 Norman et al.
7,249,802 B2 7/2007 Schmitz et al.
D547,978 S 8/2007 Machael et al.
7,270,378 B2 9/2007 Wilkerson et al.
7,273,253 B2 9/2007 Deimen et al.
D553,378 S 10/2007 Wang
7,281,764 B2 10/2007 Thole
D556,481 S 12/2007 Harley
D557,027 S 12/2007 Hara
D557,028 S 12/2007 Su
D557,913 S 12/2007 Ong
D557,950 S 12/2007 Lu
D558,994 S 1/2008 Machael et al.
D558,995 S 1/2008 Igarski
D558,996 S 1/2008 Igarski
D558,997 S 1/2008 Igarski
D559,572 S 1/2008 Igarski
7,347,495 B2 3/2008 Beyer et al.
D567,521 S 4/2008 Igarski
7,360,839 B1 4/2008 Chen
7,367,622 B2 5/2008 Roslund et al.
D570,624 S 6/2008 Kang
D572,923 S 7/2008 Huang
D572,948 S 7/2008 Wakasugi et al.
7,396,079 B2 7/2008 Heidmann et al.
D576,809 S 9/2008 Christianson et al.
D577,519 S 9/2008 Su
7,419,222 B2 9/2008 Schmitz et al.
7,425,037 B2 9/2008 Schmitz et al.
7,425,039 B2 * 9/2008 Lin ..... A47C 31/023 297/452.56
7,427,105 B2 9/2008 Knoblock et al.
7,434,879 B2 10/2008 Ueda et al.
D580,199 S 11/2008 Su
7,445,288 B2 11/2008 Zapf
7,455,366 B2 11/2008 Kawasaki
D583,580 S 12/2008 Hara

(56) References Cited

U.S. PATENT DOCUMENTS

D583,581 S 12/2008 Hara
7,461,442 B2 12/2008 Johnson et al.
7,475,943 B1 1/2009 Huang
7,484,802 B2 2/2009 Beyer et al.
7,500,718 B2 3/2009 Fookes
7,527,335 B2 5/2009 Eberlein et al.
7,533,939 B2 5/2009 Fookes et al.
D593,345 S 6/2009 Schweikarth et al.
7,549,704 B1 6/2009 Chou et al.
7,568,765 B2 8/2009 Brauning
D599,571 S 9/2009 Hara
D600,461 S 9/2009 Sexton
D600,462 S 9/2009 Ooki et al.
7,549,700 B2 9/2009 Stumpf et al.
7,604,298 B2 10/2009 Peterson et al.
D604,527 S 11/2009 Ooki et al.
7,625,045 B2 12/2009 Hatcher et al.
7,647,714 B2 * 1/2010 Coffield ..... A47C 7/282 297/452.56 X
D609,021 S 2/2010 Ooki et al.
7,665,805 B2 2/2010 Ueda
7,857,388 B2 2/2010 Bedford et al.
7,686,395 B2 3/2010 Piretti
D613,085 S 4/2010 Fujita
D613,086 S 4/2010 Fujita
7,695,067 B2 4/2010 Goetz et al.
7,712,833 B2 5/2010 Ueda
7,712,834 B2 5/2010 Knoblock et al.
7,717,513 B2 5/2010 Ueda
7,740,315 B2 6/2010 Ball et al.
7,744,159 B2 6/2010 Yang
7,775,601 B2 8/2010 Wu
7,794,022 B2 * 9/2010 Caruso ..... A47C 1/03 297/452.56 X
7,798,573 B2 9/2010 Pennington et al.
7,806,481 B2 10/2010 Eberlein
7,815,259 B2 10/2010 Fookes et al.
D627,983 S 11/2010 Wakasugi et al.
7,828,389 B2 11/2010 Oda
7,832,803 B2 11/2010 Cassaday
7,837,269 B2 11/2010 Bock
7,837,272 B2 11/2010 Masunaga et al.
7,841,665 B2 11/2010 Geister et al.
7,841,666 B2 11/2010 Schmitz et al.
7,857,389 B2 12/2010 Ueda
7,862,120 B2 1/2011 Ueda
7,874,618 B2 1/2011 Kohl et al.
7,874,619 B2 1/2011 Harley
7,878,591 B2 2/2011 Walker et al.
7,887,131 B2 2/2011 Chadwick et al.
7,887,135 B2 2/2011 Oda
7,896,439 B2 3/2011 Kan et al.
D636,614 S 4/2011 Sander et al.
7,922,248 B2 4/2011 Aldrich et al.
7,926,879 B2 4/2011 Schmitz et al.
D638,635 S 5/2011 Sander et al.
D639,576 S 6/2011 Grove et al.
D642,833 S 8/2011 Su
7,992,936 B2 8/2011 Schmitz et al.
D645,684 S 9/2011 Chen
8,016,360 B2 9/2011 Machael et al.
8,029,066 B2 10/2011 Su
8,061,778 B2 11/2011 Machael et al.
D652,646 S 1/2012 Fujita
D652,658 S 1/2012 Figueroa
D653,044 S 1/2012 Schaak
D654,709 S 2/2012 Fujita
D654,711 S 2/2012 Fujita
8,109,576 B2 2/2012 Lin
D657,166 S 4/2012 Behar et al.
D658,904 S 5/2012 Chen
D660,031 S 5/2012 Starczewski
8,172,315 B2 5/2012 Jonsen et al.
D665,589 S 8/2012 Wagner
D665,590 S 8/2012 Wagner
8,240,771 B2 * 8/2012 Diffrient ..... A47C 7/282 297/452.56
8,251,448 B2 * 8/2012 Machael ..... A47C 7/14 297/452.56 X
8,272,691 B2 9/2012 Hsuan-Chin
D679,107 S 4/2013 Darrow et al.
8,408,647 B2 4/2013 Wu
8,449,037 B2 5/2013 Behar et al.
8,579,376 B2 11/2013 Chen
8,616,655 B2 12/2013 Jung
8,764,110 B2 7/2014 Hsuan-Chin
8,777,312 B2 7/2014 Diffrient
8,794,701 B2 8/2014 Nakayama et al.
8,967,726 B2 * 3/2015 Schmitz ..... A47C 7/025 297/452.56 X
8,998,339 B2 * 4/2015 Peterson ..... A47C 1/024 297/452.56
9,010,859 B2 4/2015 Battey et al.
9,022,476 B2 * 5/2015 Battey ..... A47C 1/032 297/300.2
9,033,421 B2 * 5/2015 Wilkinson ..... A47C 1/03 297/452.56 X
9,408,467 B2 * 8/2016 Peterson ..... A47C 1/024
9,462,888 B2 * 10/2016 Battey ..... A47C 1/032
9,510,684 B2 12/2016 Schmitz et al.
9,826,839 B2 * 11/2017 Battey ..... A47C 1/024
9,918,552 B2 * 3/2018 Battey ..... A47C 1/032
10,206,507 B2 * 2/2019 Battey ..... A47C 1/032
10,264,889 B2 * 4/2019 Battey ..... A47C 1/024
2001/0028188 A1 10/2001 Stumpf et al.
2002/0003368 A1 1/2002 Vanderiet et al.
2002/0043867 A1 4/2002 Lessmann
2002/0043871 A1 * 4/2002 Prince ..... A47C 1/023 297/452.56 X
2002/0109379 A1 8/2002 Marechal et al.
2002/0190553 A1 12/2002 Koepke et al.
2002/0190564 A1 * 12/2002 Coffield ..... A47C 1/03255 297/452.56
2002/0195863 A1 12/2002 Su
2003/0001425 A1 1/2003 Koepke et al.
2003/0010752 A1 1/2003 Kikuchi et al.
2003/0030317 A1 2/2003 Chen
2003/0047980 A1 3/2003 Vassallo
2003/0160494 A1 8/2003 Coffield
2003/0184140 A1 10/2003 Bruske
2004/0000805 A1 1/2004 Vanderiet et al.
2004/0140701 A1 7/2004 Schmitz et al.
2004/0155503 A1 8/2004 Stumpf et al.
2004/0262975 A1 12/2004 Su
2005/0052061 A1 3/2005 Deimen et al.
2005/0057085 A1 3/2005 Wu
2005/0062323 A1 3/2005 Dicks
2005/0062326 A1 3/2005 Dicks
2005/0248205 A1 11/2005 Neil et al.
2007/0108822 A1 5/2007 Ueda
2007/0216213 A1 * 9/2007 Chang ..... A47C 5/04 297/452.56 X
2007/0222265 A1 9/2007 Machael et al.
2008/0079307 A1 * 4/2008 Su ..... A47C 7/282 297/452.56
2008/0122284 A1 5/2008 Yang
2008/0315661 A1 * 12/2008 Lin ..... A47C 7/282 297/452.56
2009/0102268 A1 4/2009 Schmitz et al.
2009/0020931 A1 11/2009 Coffield et al.
2010/0007190 A1 1/2010 Johnson et al.
2010/0237679 A1 * 9/2010 Tsukiji ..... A47C 7/282 297/452.56 X
2010/0244521 A1 9/2010 Ueda
2010/0276978 A1 11/2010 Furuta et al.
2011/0012395 A1 1/2011 Roslund et al.
2011/0198907 A1 8/2011 Masunaga et al.
2011/0215623 A1 9/2011 Tsai
2011/0248543 A1 10/2011 Hitchcock et al.
2011/0285191 A1 11/2011 Van Hekken
2012/0007400 A1 1/2012 Behar et al.
2012/0193959 A1 8/2012 Chen

(56) References Cited

U.S. PATENT DOCUMENTS

| | | | |
|---|---|---|---|
| 2013/0082499 | A1 | 4/2013 | Schmitz et al. |
| 2013/0099548 | A1 | 4/2013 | Schmitz et al. |
| 2014/0117732 | A1 | 5/2014 | Bachar |

FOREIGN PATENT DOCUMENTS

| | | | |
|---|---|---|---|
| CN | 201958277 | U | 9/2011 |
| DE | 19930922 | A1 | 5/2000 |
| DE | 10147021 | A1 | 4/2003 |
| EP | 0815778 | A1 | 1/1998 |
| EP | 1447029 | A1 | 8/2004 |
| EP | 1785065 | A1 | 5/2007 |
| EP | 1785067 | A1 | 5/2007 |
| EP | 1785068 | A1 | 5/2007 |
| EP | 1785070 | A1 | 5/2007 |
| EP | 1785076 | A1 | 5/2007 |
| EP | 1808096 | A1 | 7/2007 |
| EP | 2100539 | A1 | 9/2009 |
| GB | 610740 | | 10/1948 |
| GB | 610741 | | 10/1948 |
| JP | 2000079034 | A | 3/2000 |
| JP | 2010043387 | | 2/2010 |
| JP | 2010094299 | A | 4/2010 |
| JP | 2012055583 | | 3/2012 |
| NL | 7804978 | | 11/1978 |
| WO | 2009033535 | A1 | 3/2009 |
| WO | 2010050204 | A1 | 5/2010 |
| WO | 2011157392 | A1 | 12/2011 |

OTHER PUBLICATIONS

Knoll, Inc., ReGeneration by Knoll brochure, 2012, 18 pages.
Dauphin Furniture, Lordo brochure, 2009, 6 pages.
Haworth X99 Chair Brochure; Mar. 9, 2009.
Werndl #1 Brochure; 2008.
Steelcase Please Chair Brochure; Apr. 11, 2009.

* cited by examiner

CONTROL ASSEMBLY FOR CHAIR

CROSS REFERENCE TO RELATED APPLICATIONS

This application is a continuation of U.S. patent application Ser. No. 15/792,974 filed Oct. 25, 2017, entitled "CHAIR ASSEMBLY WITH UPHOLSTERY COVERING," which is a continuation of U.S. patent application Ser. No. 15/202,107 filed on Jul. 5, 2016, entitled "CHAIR ASSEMBLY WITH UPHOLSTERY COVERING," now U.S. Pat. No. 9,826,839, which is a continuation of U.S. patent application Ser. No. 14/624,850, filed Feb. 18, 2015, entitled "CHAIR ASSEMBLY WITH UPHOLSTERY COVERING," now U.S. Pat. No. 9,408,467, which is a continuation of U.S. patent application Ser. No. 13/837,031, filed Mar. 15, 2013, entitled "CHAIR ASSEMBLY WITH UPHOLSTERY COVERING," now U.S. Pat. No. 8,998,339, which claims the benefit of U.S. Provisional Patent Application No. 61/703,677, filed on Sep. 20, 2012, entitled "CHAIR ASSEMBLY" and U.S. Provisional Patent Application No. 61/703,666, filed on Sep. 20, 2012, entitled "CHAIR ASSEMBLY WITH UPHOLSTERY COVERING," and is a continuation-in-part of U.S. Design patent application No. 29/432,795, filed on Sep. 20, 2012, entitled "CHAIR," now U.S. Design Pat. No. D683150, and the present application is a continuation-in-part of U.S. patent application Ser. No. 15/891,962 filed Feb. 8, 2018, entitled "CONTROL ASSEMBLY FOR CHAIR," which is a continuation of U.S. patent application Ser. No. 15/256,012, filed Sep. 2, 2016, entitled "CONTROL ASSEMBLY FOR CHAIR," now U.S. Pat. No. 9,918,552, which is a continuation of U.S. patent application Ser. No. 14/633,808, filed Feb. 27, 2015, entitled "CONTROL ASSEMBLY FOR CHAIR," now U.S. Pat. No. 9,462,888, which is a continuation of U.S. patent application Ser. No. 14/029,243, filed Sep. 17, 2013, entitled "CONTROL ASSEMBLY FOR CHAIR," now U.S. Pat. No. 9,022,476, which claims benefit to U.S. Provisional Patent Application No. 61/703,677, filed on Sep. 20, 2012, entitled "CHAIR ASSEMBLY," U.S. Provisional Patent Application No. 61/703,667, filed on Sep. 20, 2012, entitled "CHAIR ARM ASSEMBLY," U.S. Provisional Patent Application No. 61/703,666, filed on Sep. 20, 2012, entitled "CHAIR ASSEMBLY WITH UPHOLSTERY COVERING," U.S. Provisional Patent Application No. 61/703,515, filed on Sep. 20, 2012, entitled "SPRING ASSEMBLY AND METHOD," U.S. Provisional Patent Application No. 61/703,663, filed on Sep. 20, 2012, entitled "CHAIR BACK MECHANISM AND CONTROL ASSEMBLY," U.S. Provisional Patent Application No. 61/703,659, filed on Sep. 20, 2012, entitled "CONTROL ASSEMBLY FOR CHAIR," U.S. Provisional Patent Application No. 61/703,661, filed on Sep. 20, 2012, entitled "CHAIR ASSEMBLY," U.S. Provisional Patent Application No. 61/754,803, filed on Jan. 21, 2013, entitled "CHAIR ASSEMBLY WITH UPHOLSTERY COVERING," U.S. patent application Ser. No. 14/029,243 is a continuation of U.S. Design patent application No. 29/432,765, filed on Sep. 20, 2012 entitled "CHAIR," now U.S. Design Pat. No. D697,726, and U.S. Design patent application No. 29/432,767, filed on Sep. 20, 2012, entitled "CHAIR," now U.S. Design Pat. No. D697,727, U.S. patent application Ser. No. 15/891,962 is a continuation-in-part of U.S. patent application Ser. No. 15/619,591, filed on Jun. 12, 2017, entitled "CHAIR ASSEMBLY," now U.S. Pat. No. 9,986,848, which is a continuation of U.S. patent application Ser. No. 14/678,065, filed Apr. 3, 2015, entitled "CHAIR ASSEMBLY," now U.S. Pat. No. 9,706,853, which is a continuation of U.S. patent application Ser. No. 14/029,284, filed Sep. 17, 2013, entitled "CHAIR ASSEMBLY," now U.S. Pat. No. 8,973,990, and U.S. patent application Ser. No. 14/029,273, filed Sep. 17, 2013, entitled "CHAIR ASSEMBLY," now U.S. Pat. No. 9,167,910, U.S. patent application Ser. No. 15/619,591 claims the benefit of U.S. Provisional Patent Application Nos. 61/703,677, filed Sep. 20, 2012, entitled "CHAIR ASSEMBLY," 61/703,667, filed Sep. 20, 2012, entitled "CHAIR ARM ASSEMBLY," 61/703,666, filed Sep. 20, 2012, entitled "CHAIR ASSEMBLY WITH UPHOLSTERY COVERING," 61/703,663, filed Sep. 20, 2012, entitled "CHAIR BACK MECHANISM AND CONTROL ASSEMBLY," 61/703,659, filed Sep. 20, 2012, entitled "CONTROL ASSEMBLY FOR CHAIR," 61/703,661, filed Sep. 20, 2012, entitled "CHAIR ASSEMBLY," 61/754,803, filed Jan. 21, 2013, entitled "CHAIR ASSEMBLY WITH UPHOLSTERY COVERING," 61/703,515, filed Sep. 20, 2012, entitled "SPRING ASSEMBLY AND METHOD," 61/733,661, filed Dec. 5, 2012, entitled "CHAIR ASSEMBLY," and U.S. patent application Ser. No. 15/619,591 is a continuation of U.S. Design patent application No. 29/432,776, filed Sep. 20, 2012, entitled "CHAIR," now U.S. Design Pat. No. D697729, the entire disclosures of all references set forth above being incorporated herein by reference.

BACKGROUND OF THE INVENTION

The present invention relates to a chair assembly, and in particular to an office chair assembly comprising a back assembly and a seat assembly each covered by upholstery coverings.

BRIEF SUMMARY OF THE INVENTION

One aspect includes a chair back assembly that includes a back frame having a front surface and a rear surface and comprising a laterally extending cross member having opposite end portions, and a back shell comprising a front surface, a rear surface positioned in front of the front surface of the back frame, a pair of laterally spaced side portions defining an opening therebetween, and a top portion extending laterally between and connected to the side portions, wherein the side portions are exclusively connected to the cross member at opposite ends of the cross member, wherein the connection between the side portions of the back shell and the end portions of the cross member are the only connections between the side portions of the back shell and the back frame. The chair back assembly further includes a cover extending across the opening and connected to the side portions and the top portion of the back shell.

Another aspect includes a chair that includes a base, a seat support structure pivotally connected to the base, and a back frame comprising a front surface, a rear surface and a forwardly extending first bottom portion pivotally connected to the base. The chair further includes a back shell comprising a forwardly extending bottom portion connected to the seat support structure, a front surface, a rear surface positioned in front of the front surface of the back frame, a pair of laterally spaced side portions defining an opening therebetween, and a top portion extending laterally between and connected to the side portions, wherein each of the side portions are exclusively connected to the back frame at a first location, and a cover extending across the opening and connected to the side portions and the top portion of the back shell.

Yet another aspect includes a chair that includes a base, a back frame comprising an upright portion with a front surface, a rear surface and a forwardly extending first bottom portion pivotally connected to the base, and a shell spaced forwardly of the upright portion of the back frame and comprising laterally spaced side portions, a lower portion extending laterally between first ends of the side portions, and an upper portion extending laterally between opposite second ends of the side portions, wherein the upper and lower portions and side portions define a ring having a central opening, wherein each of the side portions are exclusively connected to the upright portion of the back frame at a location positioned above a lumbar region of the shell, wherein the connections between the side portions of the shell and the upright portion of the back frame at the first location are the only connections between the side portions of the shell and the upright portion of the back frame. The chair further includes a cover extending across the opening and connected to the side portions and the top and bottom portions of the ring.

These and other features and advantages of the present invention will be further understood and appreciated by those skilled in the art by reference to the following specification, claims, and appended drawings.

DETAILED DESCRIPTION OF THE PREFERRED EMBODIMENTS

Figure 1:
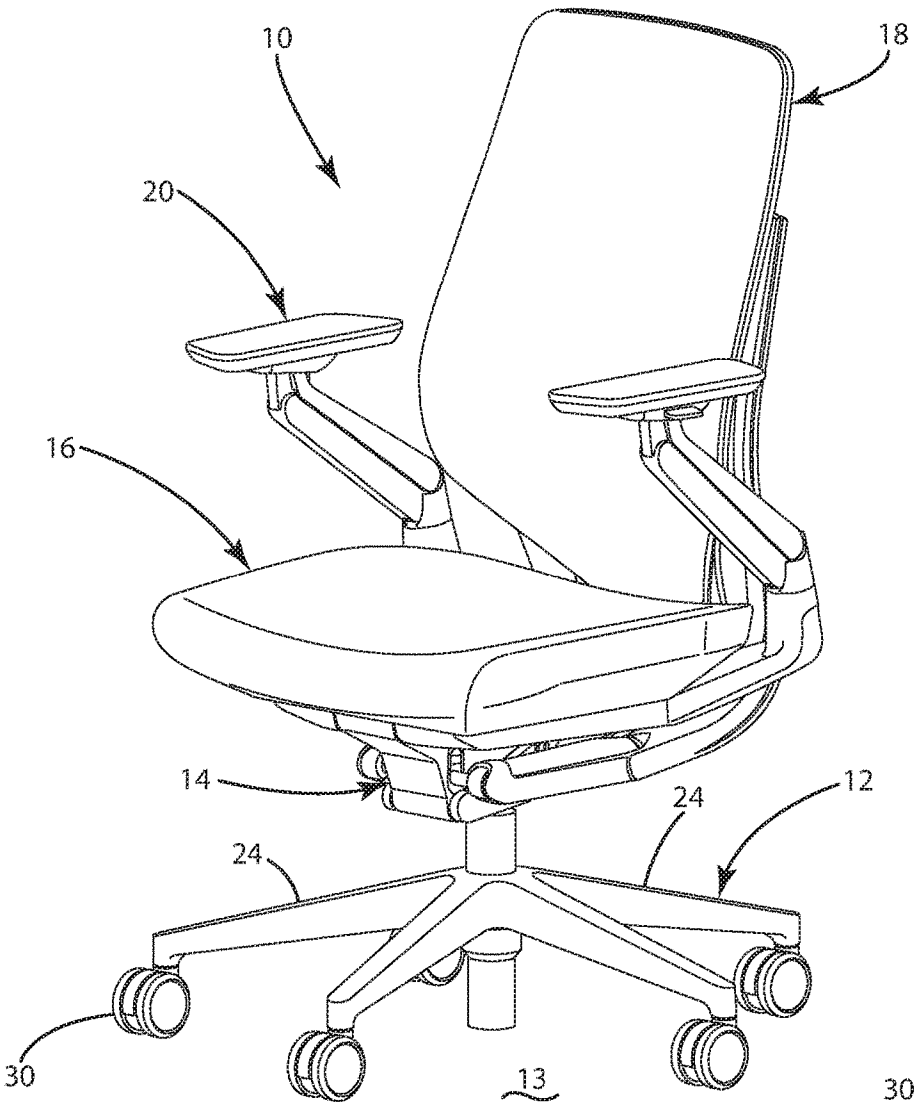
FIG. 1 is a front perspective view of a chair assembly embodying the present invention.
Figure 2:
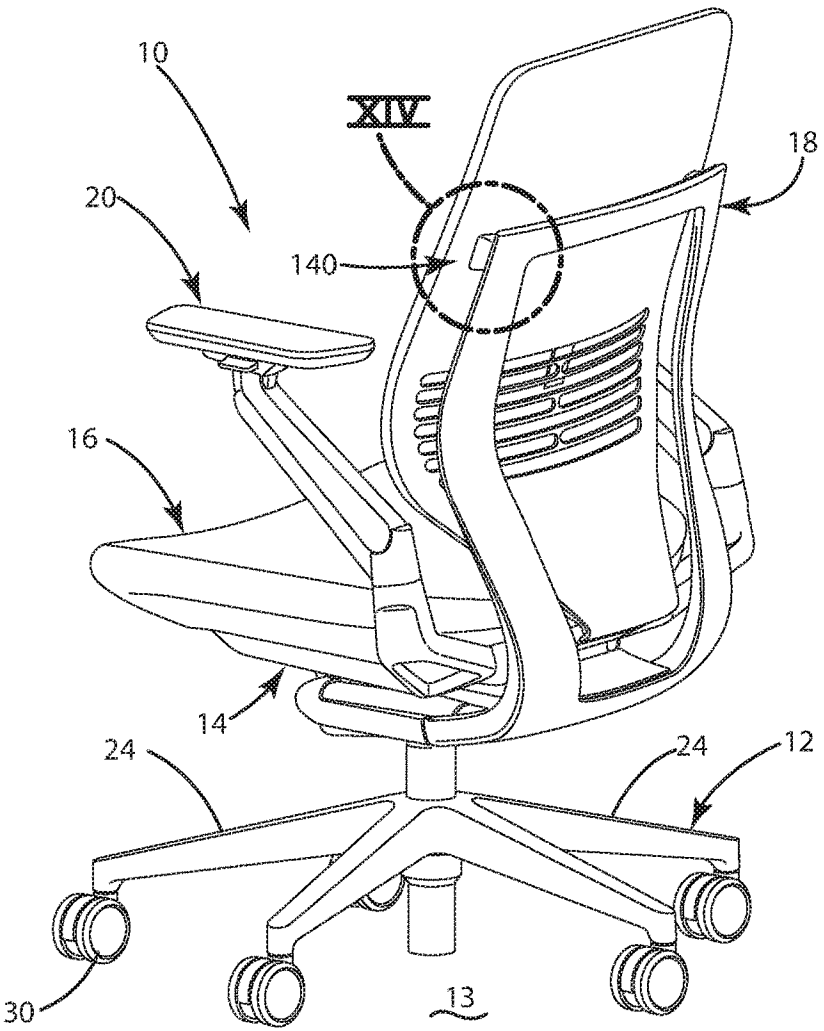
FIG. 2 is a rear perspective view of the chair assembly.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
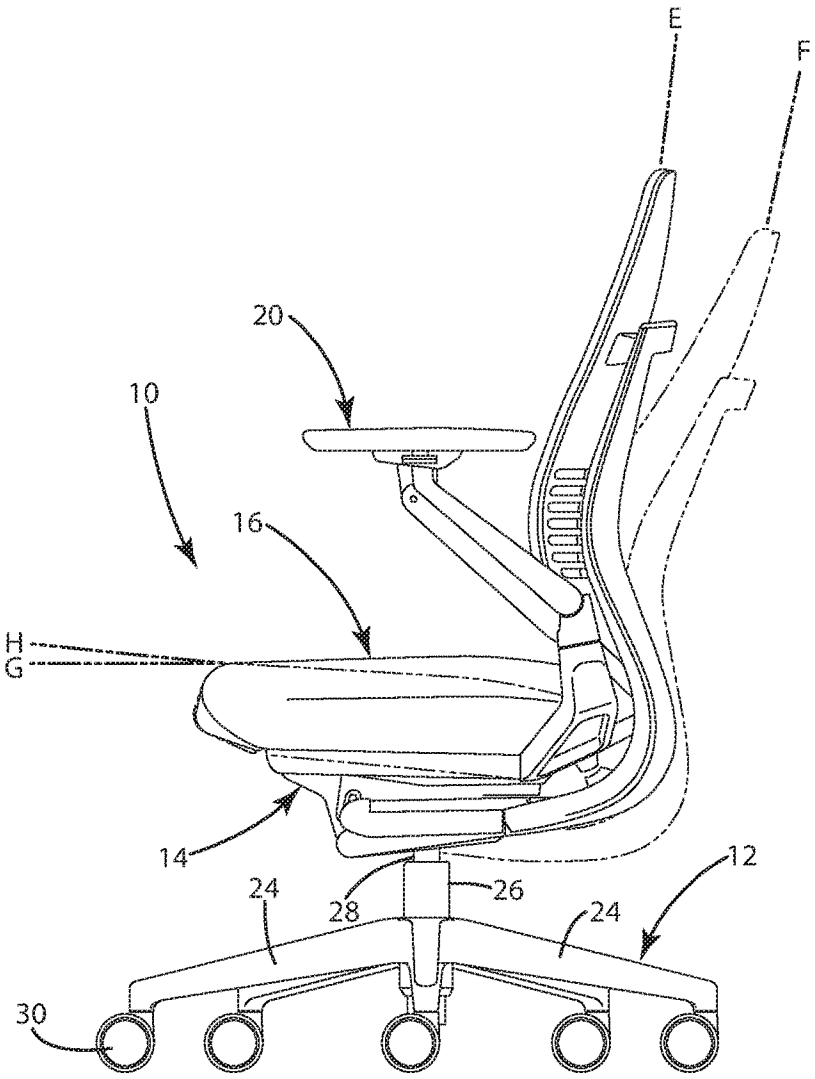
FIG. 4 is a side elevational view of the chair assembly showing the chair assembly in an upright position and in a reclined position in dashed line.
Figure 3:
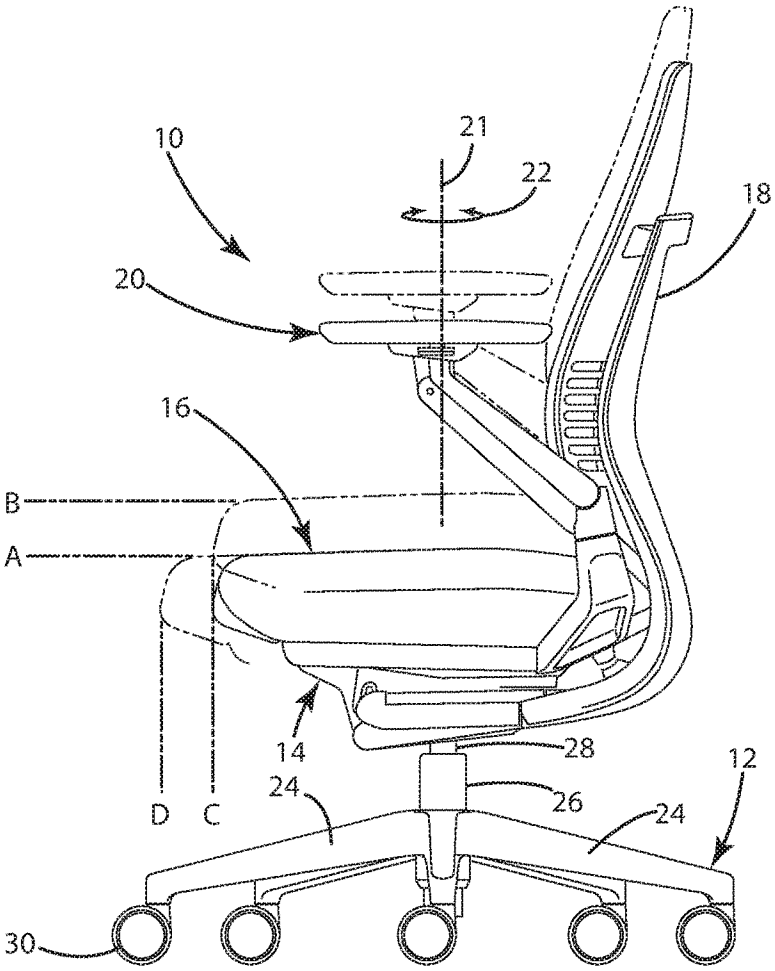
FIG. 3 is a side elevational view of the chair assembly showing the chair assembly in a lowered position and in a raised position in dashed line, and a seat assembly in a retracted position and an extended position in dashed line.

The reference numeral 10 (FIGS. 1 and 2) generally designates a chair assembly embodying the present invention. In the illustrated example, the chair assembly 10 includes a castered base assembly 12 abutting a supporting floor surface 13, a control or support assembly 14 supported by the castered base assembly 12, a seat assembly 16 and back assembly 18 each operably coupled with the control assembly 14, and a pair of arm assemblies 20. The control assembly 14 (FIG. 3) is operably coupled to the base assembly 12 such that the seat assembly 16, the back assembly 18 and the arm assemblies 20 may be vertically adjusted between a fully lowered position A and a fully raised position B, and pivoted about a vertical axis 21 in a direction 22. The seat assembly 16 is operably coupled to the control assembly 14 such that the seat assembly 16 (FIG. 4) is longitudinally adjustable with respect to the control assembly 14 between a fully retracted position C and a fully extended position D. The seat assembly 16 and the back assembly 18 are operably coupled with the control assembly 14 and with one another such that the back assembly 18 is movable between a fully upright position E and a fully reclined position F, and further such that the seat assembly 16 is movable between a fully upright position G and a fully reclined position H corresponding to the fully upright position E and the fully reclined position F of the back assembly 18, respectively.

The base assembly 12 includes a plurality of pedestal arms 24 radially extending and spaced about a hollow central column 26 that receives a pneumatic cylinder 28 therein. Each pedestal arm 24 is supported above the floor surface 13 by an associated caster assembly 30. Although the base assembly 12 is illustrated as including a multiple-arm pedestal assembly, it is noted that other suitable supporting structures maybe utilized, including but not limited to fixed columns, multiple leg arrangements, vehicle seat support assemblies, and the like.

Figure 5:
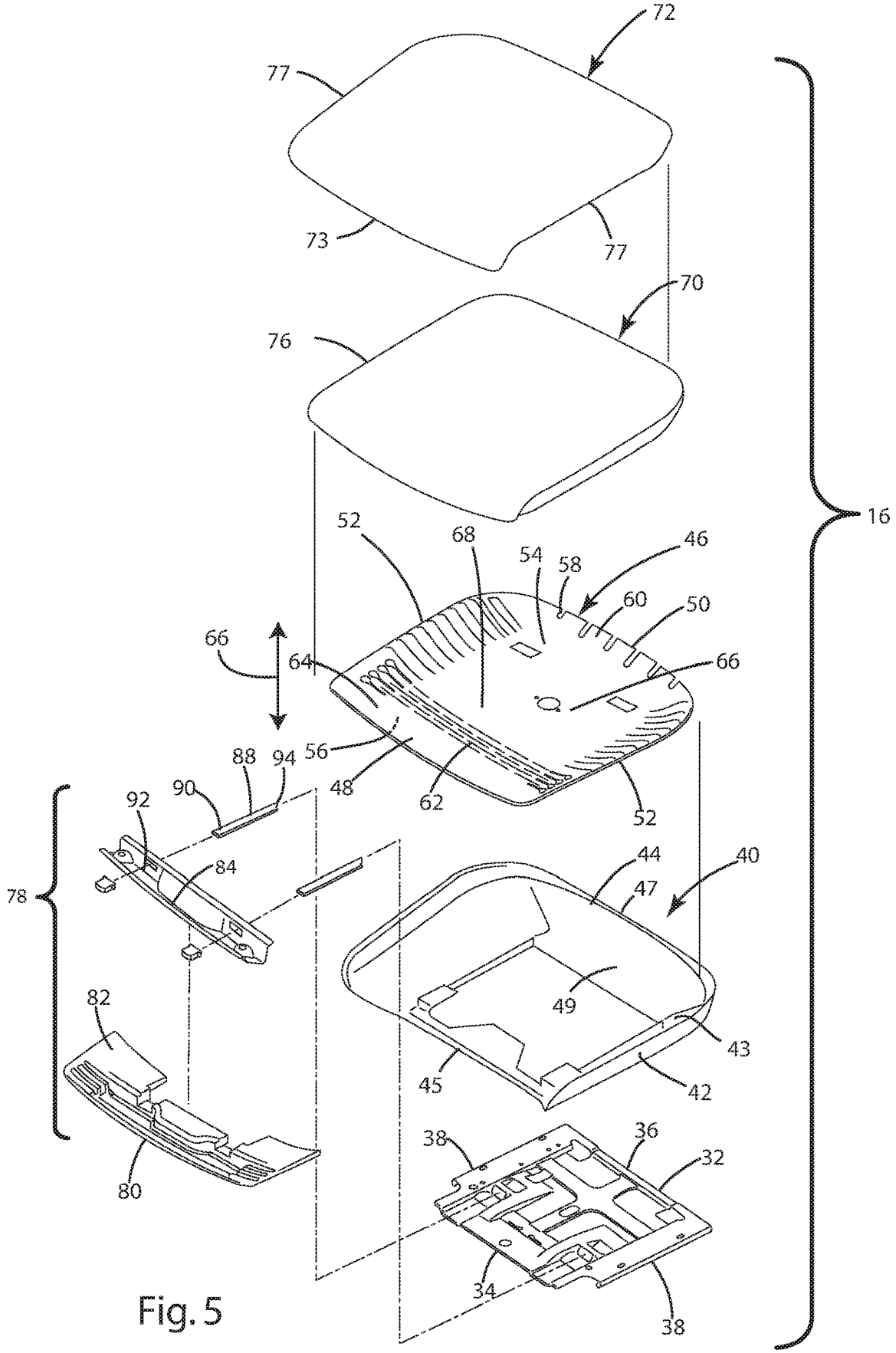
FIG. 5 is an exploded view of the seat assembly.

The seat assembly 16 (FIG. 5) includes a relatively rigid seat support plate 32 having a forward edge 34, a rearward edge 36, and a pair of C-shaped guide rails 38 defining the side edges of the seat support plate 32 and extending between the forward edge 34 and the rearward edge 36. The seat assembly 16 further includes a flexibly resilient outer seat shell 40 having a pair of upwardly turned side portions 42 each terminating in a side edge 43, a forward edge 45, and an upwardly turned rear portion 44 that terminates in a rear edge 47 and includes a flap portion 49, wherein the side portions 42 and rear portion 44 cooperate to form a three-dimensional upwardly disposed generally concave shape. In the illustrated example, the seat shell 40 is comprised of a relatively flexible material such as a thermoplastic elastomer (TPE) and is molded as a single, integral piece. In assembly, described in further detail below, the outer seat shell 40 is secured and sandwiched between the seat support plate 32 and a plastic, flexibly resilient seat pan 46 which is secured to the seat support plate 32 by a plurality of mechanical fasteners. The seat pan 46 includes a forward edge 48, a rearward edge 50, side edges 52 extending between the forward edge 48 and the rearward edge 50, a top surface 54 and a bottom surface 56 that cooperate to form an upwardly disposed generally concave shape. In the illustrated example, the seat pan 46 includes a plurality of longitudinally extending slots 58 extending forwardly from the rearward edge 50. The slots 58 cooperate to define a plurality of fingers 60 therebetween, each finger 60 being individually flexibly resilient. The seat pan 46 further includes a plurality of laterally oriented, elongated apertures 62 located proximate the forward edge 48. The apertures 62 cooperate to increase the overall flexibility of the seat pan 46 in the area thereof, and specifically allow a forward portion 64 of the seat pan 46 to flex in a vertical direction 66 with respect to a rearward portion 68 of the seat pan 46, as discussed further below. The seat assembly 16 further includes a foam cushion member 70 that rests upon the top surface 54 of the seat pan 46 and is cradled within the outer seat shell 40, a fabric seat cover 72, and an upper surface 76 of the cushion members 70. In the illustrated example, the cover 72 includes a forward edge 73, a rearward edge 75 and a pair of side edges 77 extending therebetween. A spring support assembly 78 (FIGS. 5 and 6) is secured to the seat 16 and is adapted to flexibly support the forward portion 64 of the seat pan 46 for flexure in the vertical direction 66. In the illustrated example, the spring support assembly 78 includes a support housing 80 comprising a foam and having side portions 82 defining an upwardly concave arcuate shape. The spring support assembly 78 further includes a relatively rigid attachment member 84 that extends laterally between the side portions 82 of the support housing 80 and is located between the support housing 80 and the forward portion 64 of the seat pan 46. A plurality of mechanical fasteners 86 secure the support housing 80 and the attachment member 84 to the forward portion 64 of the seat pan 46. The spring support assembly 78 further includes a pair of cantilever springs 88 each having a distal end 90 received through a corresponding aperture 92 of the attachment member 84, and a proximate end 94 secured to the seat support plate 32 such that the distal end 90 of each cantilever spring 88 may flex in the vertical direction 66. A pair of linear bearings 96 are fixedly attached to the attachment member 84 and aligned with the apertures 92 thereof, such that the linear bearing 96 slidably receives the distal ends 90 of a corresponding cantilever spring 88. In operation, the cantilever springs 88 cooperate to allow the forward portion 64 of the seat pan 46, and more generally the entire forward portion of seat assembly 16 to flex in the vertical direction 66 when a seated user rotates forward on the seat assembly 16 and exerts a downward force on the forward edge thereof.

Figure 6:
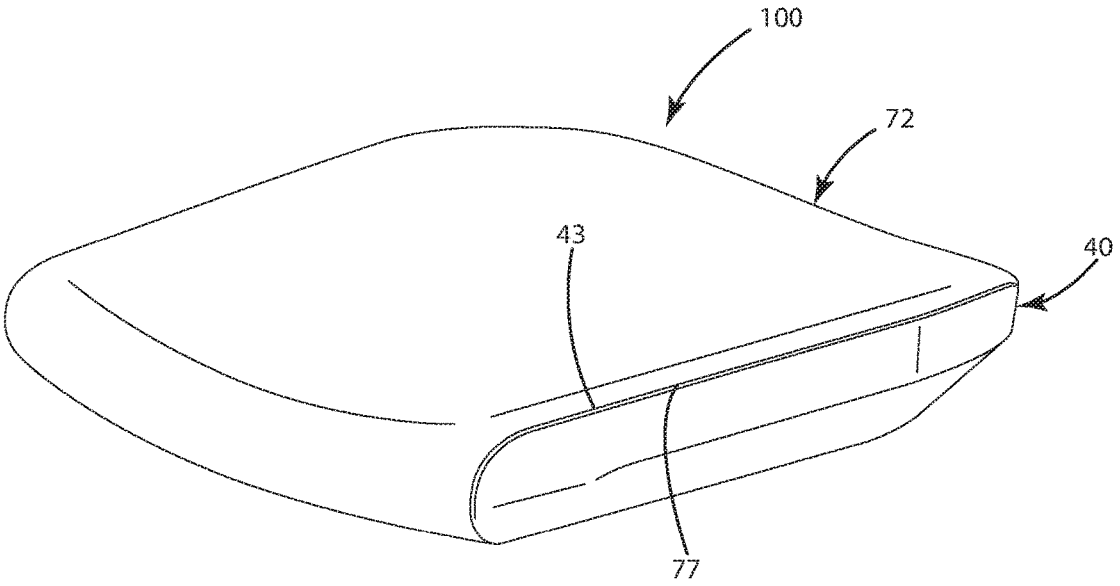
FIG. 6 is a top perspective view of an upholstery cover assembly.
Figure 7:
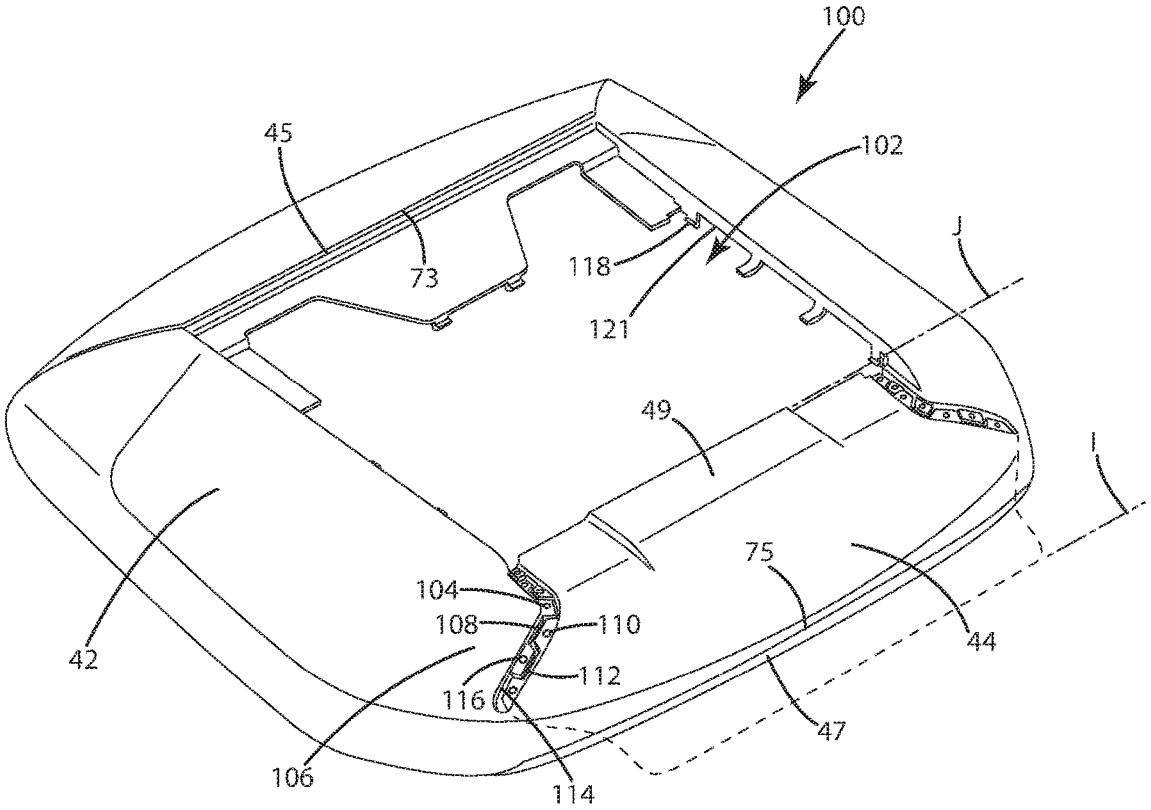
FIG. 7 is a bottom perspective view of the cover assembly.

As best illustrated in FIGS. 6 and 7, the flexible resilient seat shell 40 and the fabric seat cover 72 cooperate to form an upholstery cover assembly or cover 100. Specifically, the side edges 43 of the seat shell 40 and the side edges 77 of the seat cover 72, the forward edge 45 of the seat shell 40 and the forward edge 73 of the seat cover 72, and the rear edge 47 of the seat shell 40 and the rear edge 75 of the seat cover 72 are respectively attached to one another to form the cover 100 and to define an interior space 102 therein.

The flap portion 49 of the seat shell 40 includes a pair of corner edges 104 each extending along a corner 106 of the seat shell 40 located between the rear portion 44 and respective side portions 42, such that the flap portion 49 is movable between an open position I and a closed position J. In the illustrated example, each corner edge 104 of the flap portion 49 includes a plurality of tabs 108 spaced along the corner edge 104 and each including an aperture 110 extending therethrough. The tabs 108 of the corner edge 104 are interspaced with a plurality of tabs 112 spaced along a corner edge 114 of each side portion 42. Each of the tabs 112 includes an aperture 116 that extends therethrough.

The seat shell 40 also includes a plurality of integrally-molded coupling tabs 118 spaced about an inner edge 121 of the seat shell 40 and each having a Z-shaped, cross-section configuration.

Figure 8:
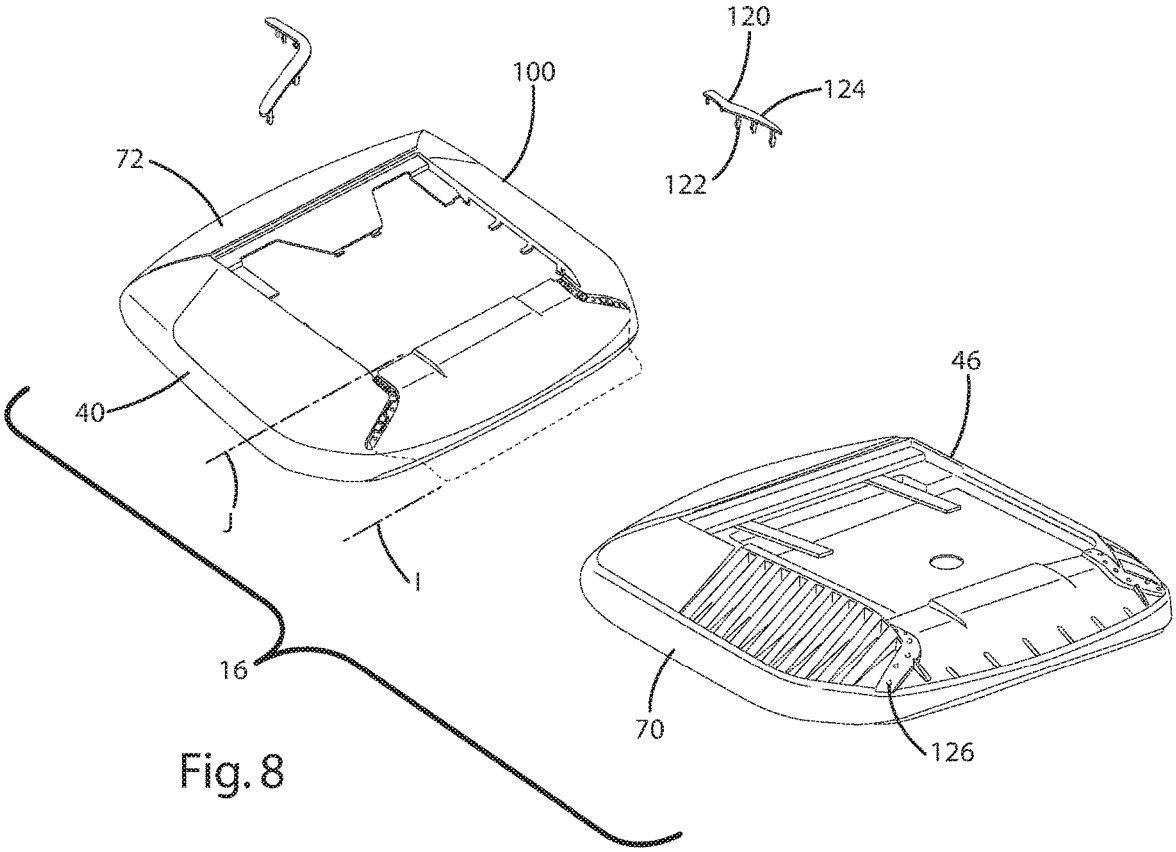
FIG. 8 is a bottom perspective view of the cover assembly and the seat assembly.

In assembly, the upholstery cover assembly 100 (FIG. 8) is constructed from the seat shell 40 and seat cover 72 as described above. The seat pan 46, the cushion member 70 and the spring support assembly 78 are then arranged with respect to one another and positioned within the interior space 102 of the upholstery cover assembly 100 by positioning the flap 49 in the open position I, after which the flap 49 is moved to the closed position J. A pair of quick-connect fasteners 120 each include a plurality of snap couplers 122 spaced along the length of an L-shaped body portion 124. In assembly, the snap couplers 122 are extended through the apertures 110, 116 of the tabs 108, 112, and are snapably received within corresponding apertures 126 of the seat pan 46, thereby securing the corner edges 104, 114 to the seat pan 46 and the flap portion 49 in the closed position J.

Figure 9:
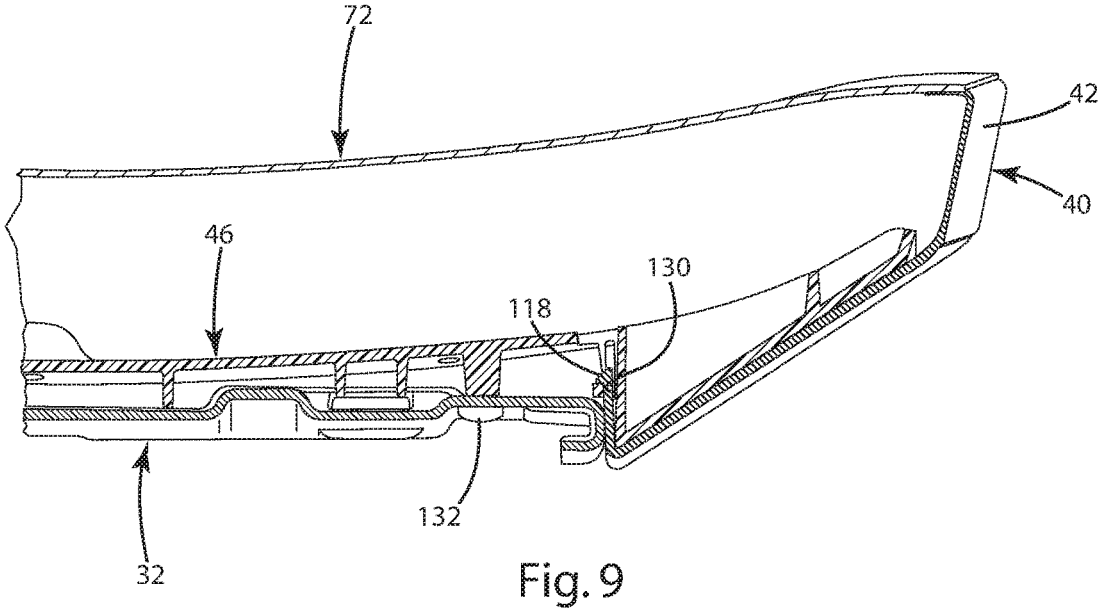
FIG. 9 is a cross-sectional view of the cover assembly.
Figure 11:
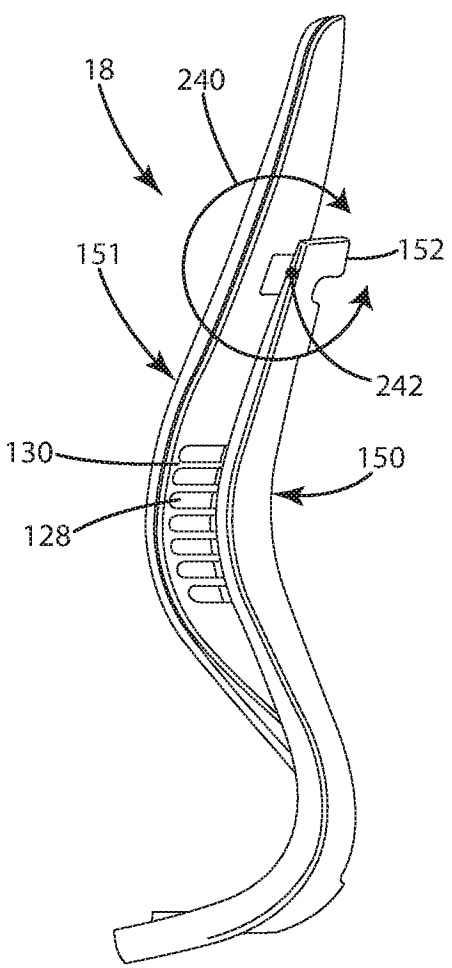
FIG. 11 is a side elevational view of the back assembly.

Further in assembly, the coupling tabs 118 (FIG. 9) are positioned within corresponding apertures 130 of the seat pan 46, such that the cover assembly 100 is temporarily secured to the seat pan 46, thereby allowing further manipulation of the over seat assembly 16 during assembly while maintaining connection and alignment of the cover assembly 100 with the seat pan 46. As used herein, "temporarily securing" is defined as a securing not expected to maintain the securement of the cover assembly 100 to the seat pan 46 by itself during normal use of the chair assembly 10 throughout the normal useful life of the chair assembly 10. The support plate 32 is then secured to an underside of the seat pan 46 by a plurality of screws 132, thereby sandwiching the coupling tabs 118 between the support plate 32 and the seat pan 46, and permanently securing the cover assembly 100 to the seat pan 46. As used herein, "permanently securing" is defined as a securing expected to maintain the securement of the cover assembly 100 to the seat pan 46 during normal use of the chair assembly 10 throughout the normal useful life of the chair assembly.

The back assembly 18 (FIGS. 10-12B) includes a back frame assembly 150 and a back support assembly 151 supported thereby. The back frame assembly 150 is generally comprised of a substantially rigid material such as metal, and includes a laterally extending top frame portion 152, a laterally extending bottom frame portion 154, and a pair of curved side frame portion 156 extending between the top frame portion 152 and the bottom frame portion 154 and cooperating therewith to define an opening 158 having a relatively large upper dimension 160 and a relatively narrow lower dimension 162.

The back assembly 18 further includes a flexibly resilient, plastic back shell 164 having an upper portion 166, a lower portion 168, a pair of side edges 170 extending between the upper portion 166 and a lower portion 168, a forwardly facing surface 172 and a rearwardly facing surface 174, wherein the width of the upper portion 166 is generally greater than the width of the lower portion 168, and the lower portion 168 is downwardly tapered to generally follow the rear elevational configuration of the frame assembly 150. A lower reinforcement member 176 attaches to hooks 177 (FIG. 9A) of lower portion 168 of back shell 164. Reinforcement member 176 includes a plurality of protrusions 179 that engage reinforcement ribs 180 to prevent side-to-side movement of lower reinforcement member 176 relative to back shell 164. As discussed below, reinforcement member 176 pivotably interconnects a back control link 600 (FIG. 42) to the lower portion 168 of the back shell 164 at pivot points or axis 602.

Figure 13:
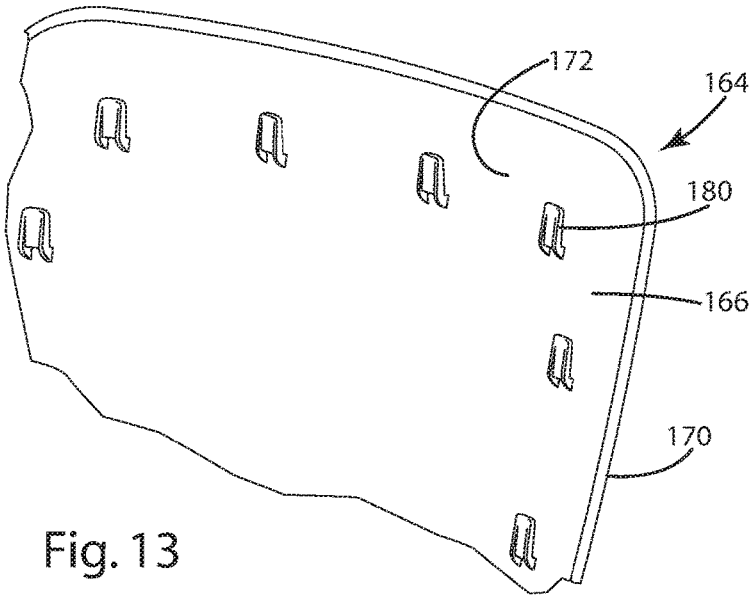
FIG. 13 is an enlarged perspective view of an area XIII, FIG. 12A.
Figure 14:
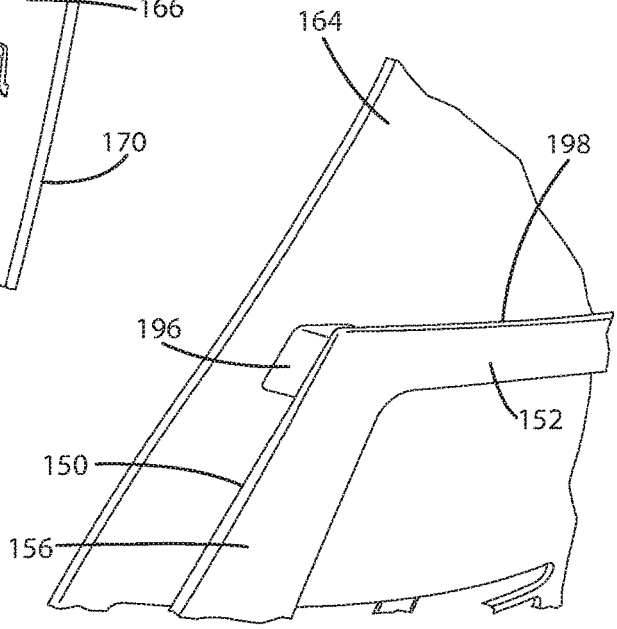
FIG. 14 is an enlarged perspective view of an area XIV, FIG. 2.
Figure 15:
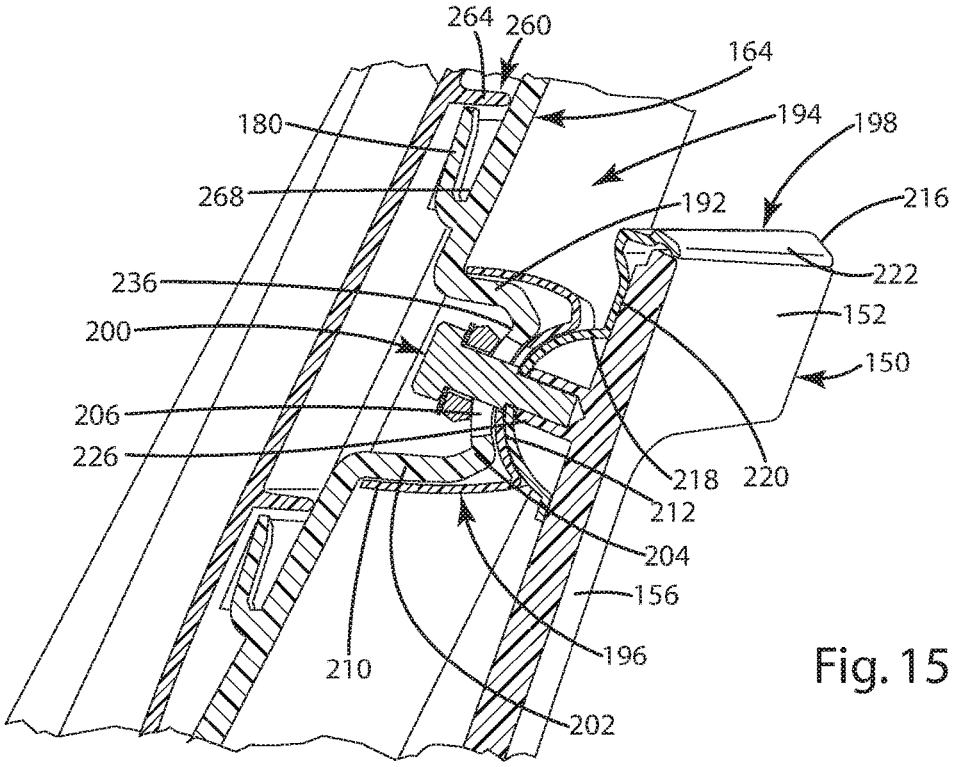
FIG. 15 is a cross-sectional view of an upper back pivot assembly taken along the line XV-XV, FIG. 10.
Figure 16A:
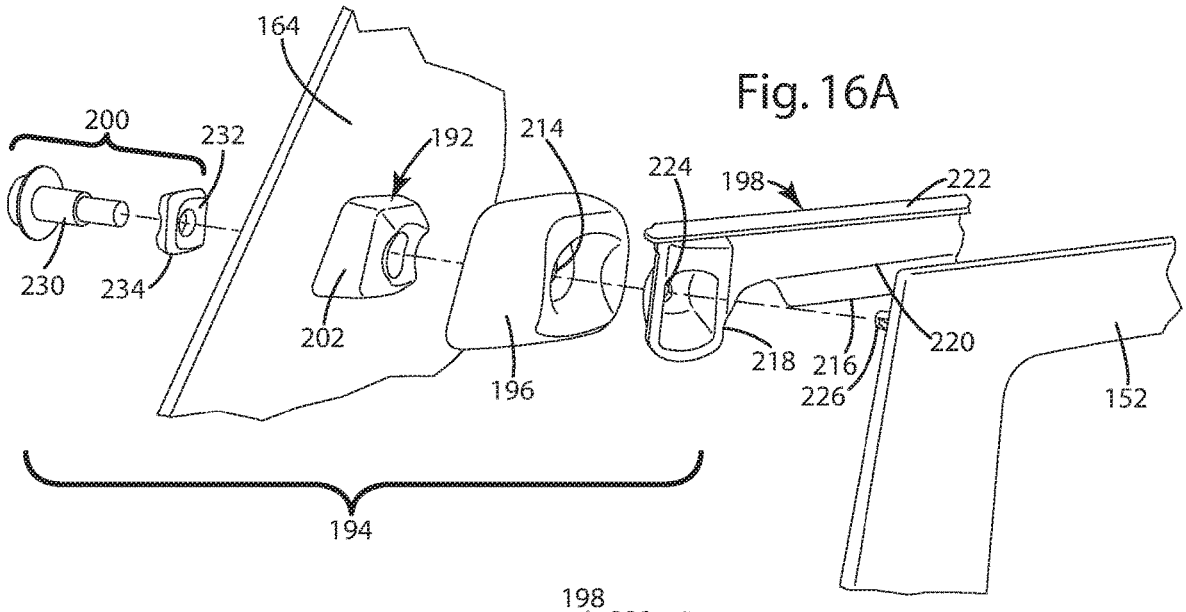
FIG. 16A is an exploded rear perspective view of the upper back pivot assembly.
Figure 16B:
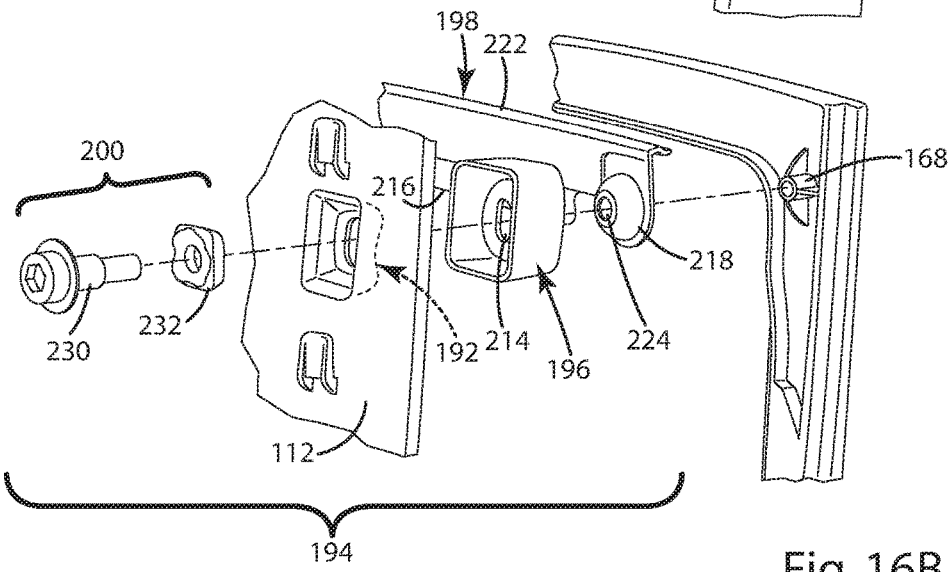
FIG. 16B is an exploded front perspective view of the upper back pivot assembly.

The back shell 164 also includes a plurality of integrally molded, forwardly and upwardly extending hooks 177 (FIG. 13) spaced about the periphery of the upper portion 166 thereof. An intermediate or lumbar portion 182 is located vertically between the upper portion 166 and the lower portion 168 of the back shell 164, and includes a plurality of laterally extending slots 184 that cooperate to form a plurality of laterally extending ribs 186 located therebetween. The slots 184 cooperate to provide additional flexure to the back shell 164 in the location thereof. Pairings of lateral ribs 186 are coupled by vertically extending ribs 188 integrally formed therewith and located at an approximate lateral midpoint thereof. The vertical ribs 188 function to tie the lateral ribs 186 together and reduce vertical spreading therebetween as the back shell 164 is flexed at the intermediate portion 182 thereof when the back assembly 18 is moved from the upright position E to the reclined position F. The back shell 164 further includes a plurality of laterally-spaced reinforcement ribs 190 extending longitudinally along the vertical length of the back shell 164 between the lower portion 168 and the intermediate portion 182. It is noted that the depth of each of the ribs 190 increases the further along each of the ribs 190 from the intermediate portion 182, such that the overall rigidity of the back shell 164 increases along the length of the ribs 190 from the intermediate portion 182 toward the lower portion 168.

The back shell 164 further includes a pair of rearwardly extending, integrally molded pivot bosses 192 forming part an upper back pivot assembly 194. The back pivot assembly 194 (FIGS. 14-16B) includes the pivot bosses 192 of the back shell 164, a pair of shroud members 196 that encompass respective pivot bosses 192, a race member 198, and a mechanical fastening assembly 200. Each pivot boss 192 includes a pair of side walls 202 and a rearwardly-facing concave seating surface 204 having a vertically elongated pivot slot 206 extending therethrough. Each shroud member 196 is shaped so as to closely house the corresponding pivot boss 192, and includes a plurality of side walls 210 corresponding to side walls 202, and a rearwardly-facing concave bearing surface 212 that includes a vertically elongated pivot slot 214 extending therethrough, and which is adapted to align with the slot 206 of a corresponding pivot boss 192. The race member 198 includes a center portion 216 extending laterally along and abutting the top frame portion 152 of the back frame assembly 150, and a pair of arcuately-shaped bearing surfaces 218 located at the ends thereof. Specifically, the center portion 216 includes a first portion 220, and a second portion 222, wherein the first portion 220 abuts a front surface of the top frame portion 152 and second portion 222 abuts a top surface of the top frame portion 152. Each bearing surface 218 includes an aperture 224 extending therethrough and which aligns with a corresponding boss member 226 integral with the back frame assembly 150.

Figure 10:
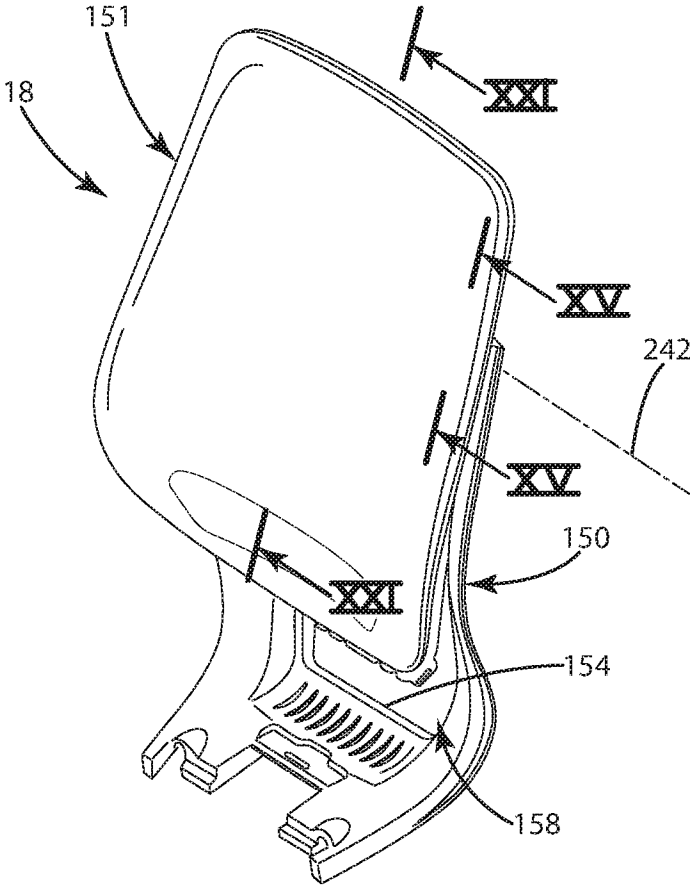
FIG. 10 is a front perspective view of a back assembly.

In assembly, the shroud members 196 are positioned about the corresponding pivot bosses 192 of the back shell 164 and operably positioned between the back shell 164 and race member 198 such that the bearing surface 212 is sandwiched between the seating surface 204 of a corresponding pivot boss 192 and a bearing surface 218. The mechanical fastening assemblies 200 each include a bolt 230 that secures a rounded abutment surface 232 of the bearing washer 234 in sliding engagement with an inner surface 236 of the corresponding pivot boss 192, and threadably engages the corresponding boss member 226 of the back shell 164. In operation, the upper back pivot assembly 194 allows the back support assembly 151 to pivot with respect to the back frame assembly in a direction 240 (FIG. 11) about a pivot axis 242 (FIG. 10).

Figure 12A:
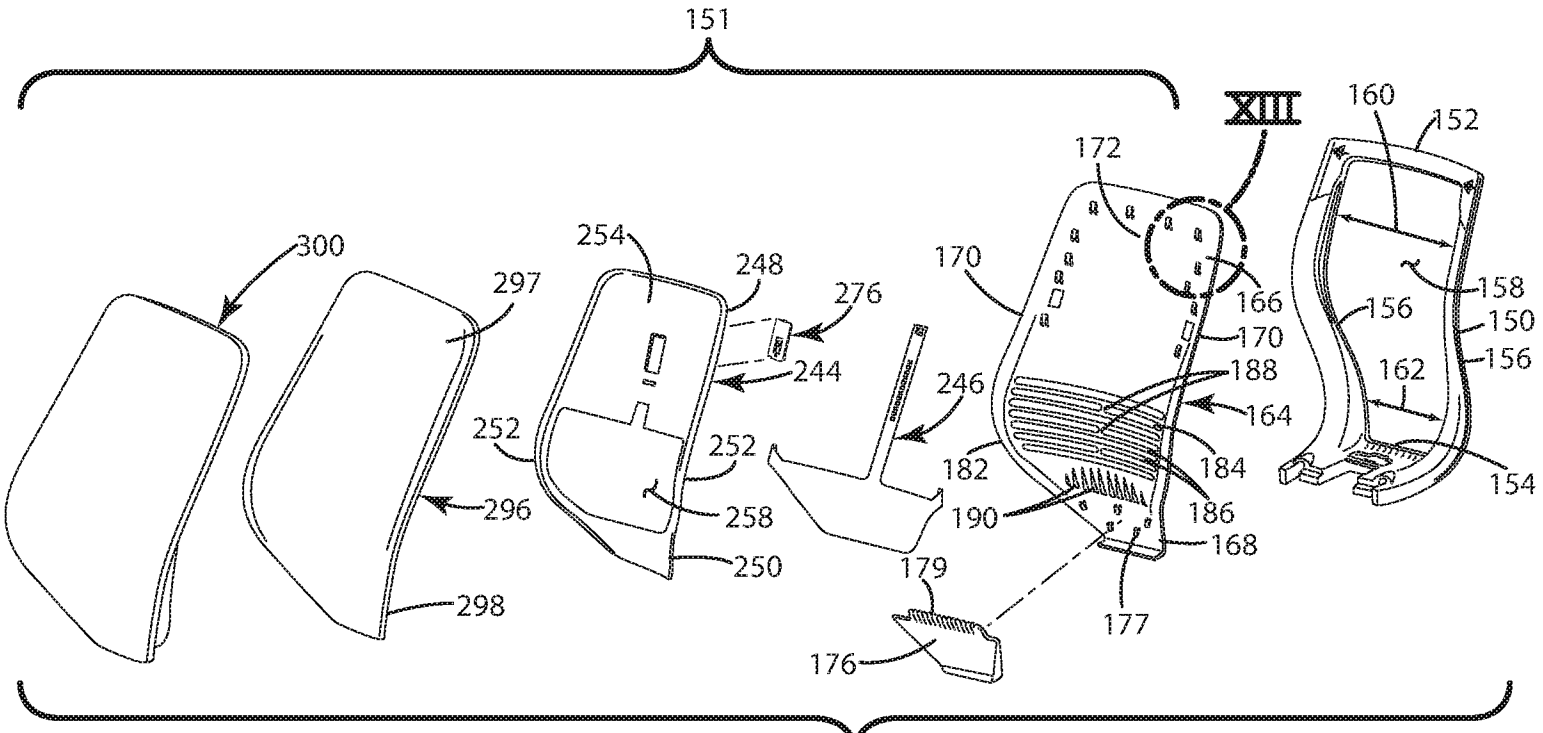
FIG. 12A is an exploded front perspective view of the back assembly.
Figure 12B:
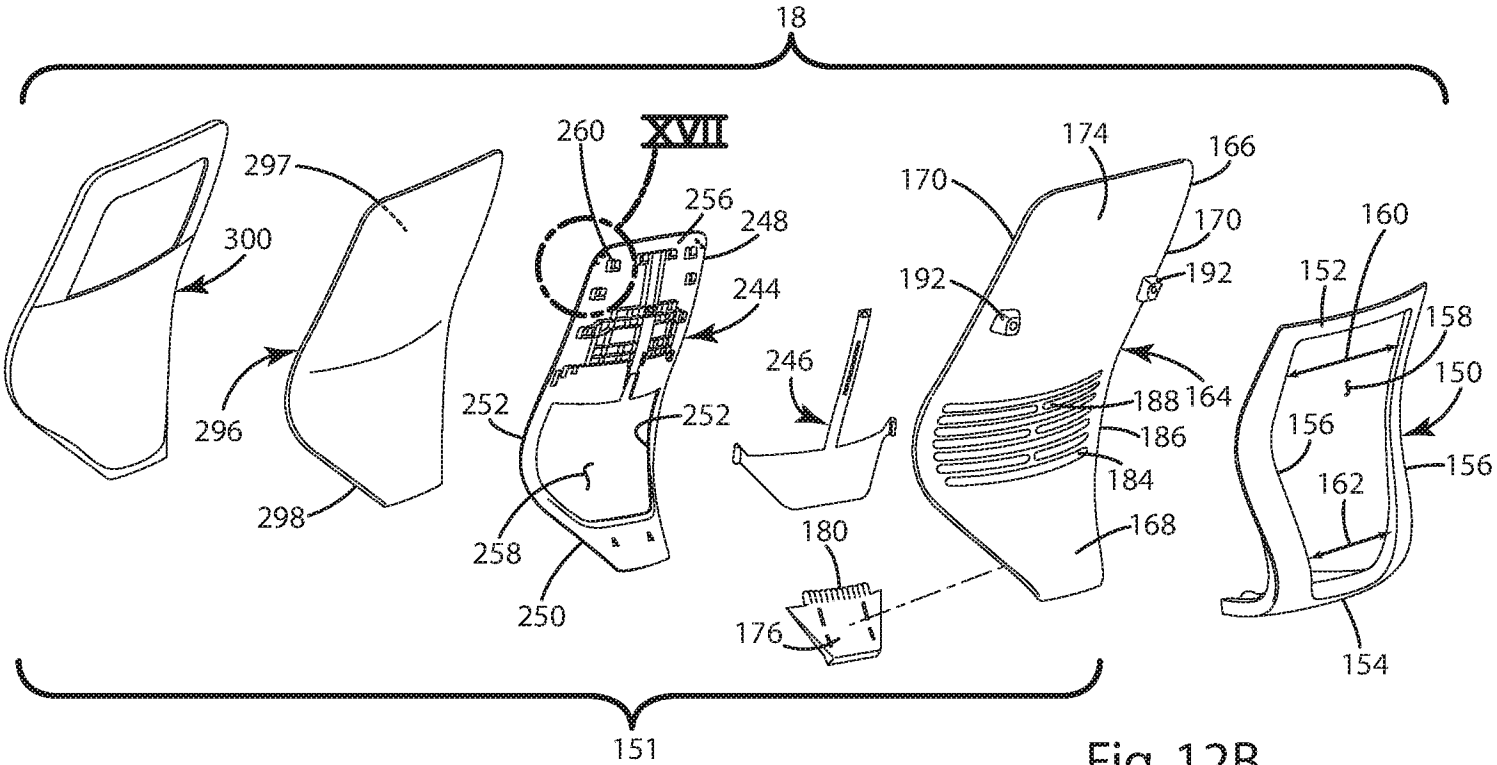
FIG. 12B is an exploded rear perspective view of the back assembly.
Figure 17:
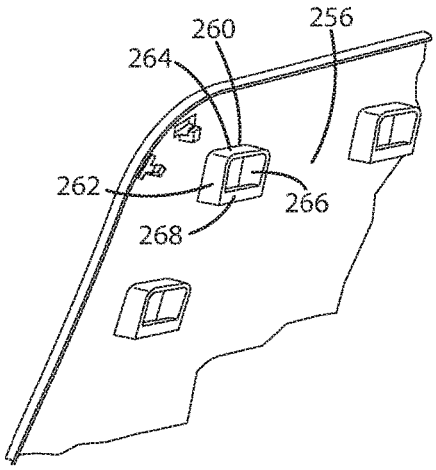
FIG. 17 is an enlarged perspective view of the area XVII, FIG. 12B.

The back support assembly 151 further includes a flexibly resilient comfort member 244 attached to the back shell 164 and slidably supporting a lumbar assembly 246. The comfort member 244 includes an upper portion 248, a lower portion 250, a pair of side portions 252, a forward surface 254 and a rearward surface 256, wherein the upper portion 248, the lower portion 250 and the side portions cooperate to form an aperture 258 that receives the lumbar assembly 246 therein. As best illustrated in FIGS. 12B and 17, the comfort member 244 includes a plurality of box-shaped couplers 260 spaced about the periphery of the upper portion 248 and extending rearwardly from the rearward surface 256. Each box-shaped coupler 260 includes a pair of side walls 262 and a top wall 264 that cooperate to form an interior space 266. A bar 268 extends between the side walls 262 and is spaced from the rearward surface 256. In assembly, the comfort member 244 is secured to the back shell 164 by aligning and vertically inserting the hooks 180 of the back shell 164 into the interior space 266 of each of the box-shaped couplers 260 until the hooks 180 engage a corresponding bar 268. It is noted that the forward surface 172 of the back shell 164 and the rearward surface 256 of the comfort member 244 are free from holes or apertures proximate the hooks 180 and box-shaped couplers 260, thereby providing a smooth forward surface 254 and increasing the comfort to a seated user.

Figure 18A:
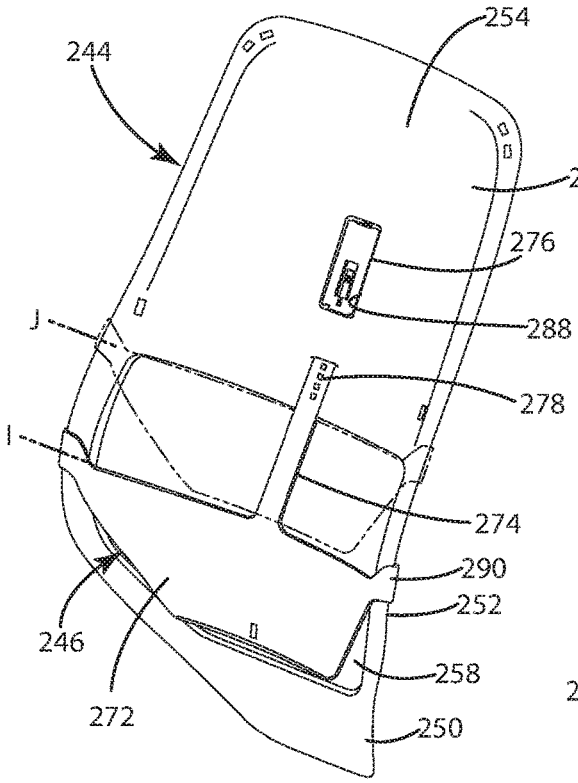
FIG. 18A is an enlarged perspective view of a comfort member and a lumbar assembly.
Figure 18B:
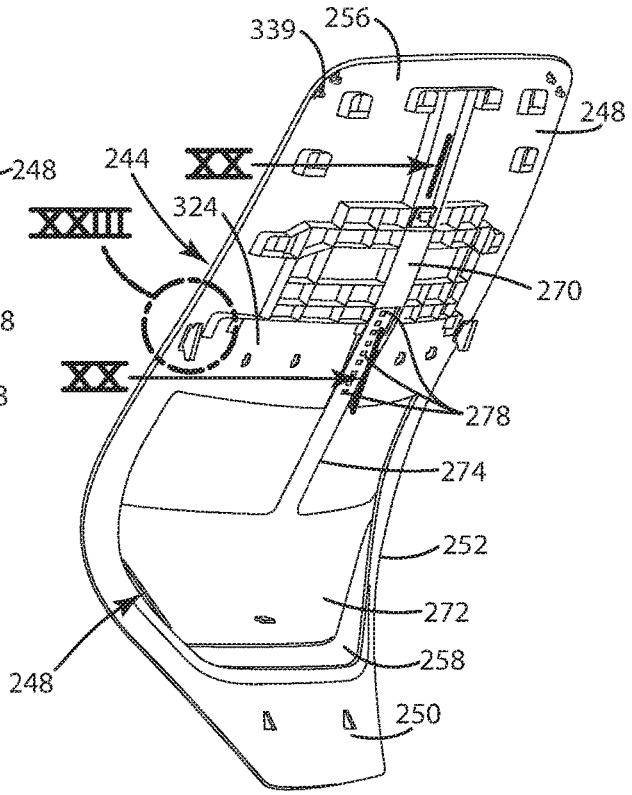
FIG. 18B is a rear perspective view of the comfort member and the lumbar assembly.
Figure 19A:
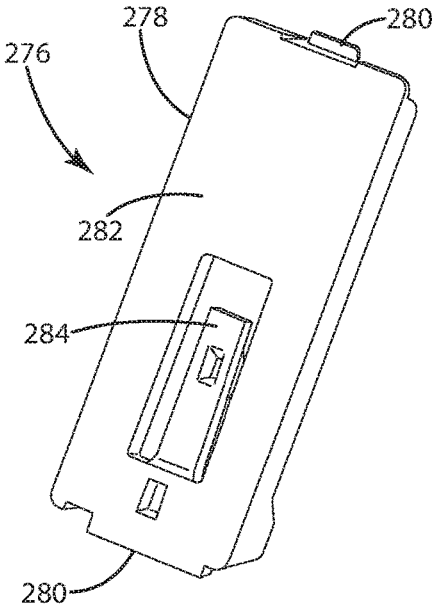
FIG. 19A is a front perspective view of a pawl member.
Figure 19B:
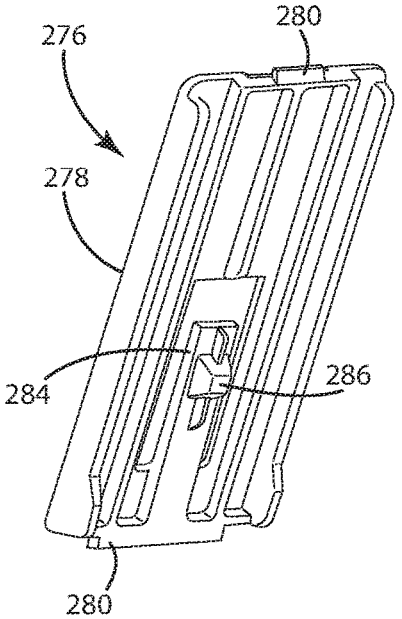
FIG. 19B is a rear perspective view of the pawl member.

The comfort member 244 (FIGS. 18A and 18B) includes an integrally molded, longitudinally extending sleeve 270 extending rearwardly from the rearward surface 256 and having a rectangularly-shaped cross-sectional configuration. The lumbar assembly 246 includes a forwardly laterally concave and forwardly vertically convex, flexibly resilient body portion 272, and an integral support portion 274 extending upwardly from the body portion 272. In the illustrated example, the body portion 272 is shaped such that the body portion vertically tapers along the height thereof so as to generally follow the contours and shape of the aperture 258 of the comfort member 244. The support portion 274 is slidably received within the sleeve 270 of the comfort member 244 such that the lumbar assembly 246 is vertically adjustable with respect to the remainder of the back support assembly 151 between a fully lowered position L and a fully raised position M. A pawl member 276 selectively engages a plurality of apertures 288 spaced along the length of support portion 274, thereby releasably securing the lumbar assembly 246 at selected vertical positions between the fully lowered position I and the fully raised position J. The pawl member 276 (FIGS. 19A and 19B) includes a housing portion 278 having engagement tabs 280 located at the ends thereof and rearwardly offset from an outer surface 282 of the housing portion 280. A flexibly resilient finger 284 is centrally disposed within the housing portion 280 and includes a rearwardly-extending pawl 286.

Figure 20:
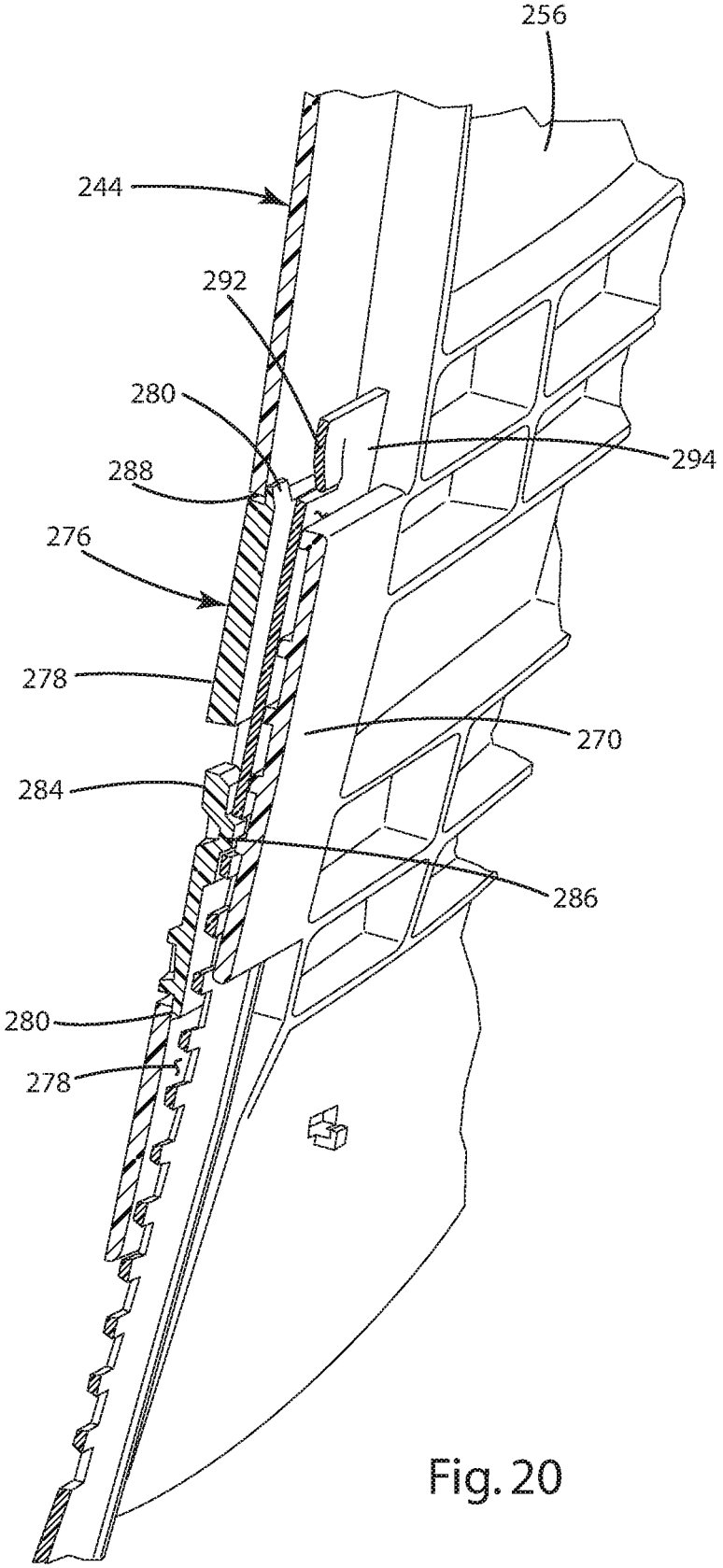
FIG. 20 is a partial cross-sectional perspective view along the line X-X, FIG. 18B.

In assembly, the pawl member 276 (FIG. 20) is positioned within an aperture 288 located within the upper portion 248 of the comfort member 244 such that the outer surface 282 of the housing portion 278 of the pawl member 276 is coplanar with the forward surface 254 of the comfort member 244, and such that the engagement tabs 280 of the housing portion 278 abut the rearward surface 256 of the comfort member 244. The support portion 274 of the lumbar assembly 246 is then positioned within the sleeve 270 of the comfort member 244 such that the sleeve 270 is slidable therein and the pawl 286 is selectively engageable with the apertures 278, thereby allowing the user to optimize the position of the lumbar assembly 246 with respect to the overall back support assembly 151. Specifically, the body portion 272 of the lumbar assembly 246 includes a pair of outwardly extending integral handle portions 290 each having a C-shaped cross-sectional configuration that wraps about and guides along the respective side edge 252 of the back shell 164.

In operation, a user adjusts the relative vertical position of the lumbar assembly 246 with respect to the back shell 244 by grasping one or both of the handle portions 290 and sliding the handle assembly 290 along the back shell 244 in a vertical direction. A stop tab 292 is integrally formed within a distal end 294 and is offset therefrom so as to engage an end wall of the sleeve 270 of the comfort member 244, thereby limiting the vertical downward travel of the support portion 274 of the lumbar assembly 246 with respect to the sleeve 270 of the comfort member 244.

The back assembly 151 further includes a cushion member 296 having an upper portion 297 and a lower portion 298, wherein the lower portion 298 tapers along the vertical length thereof to correspond to the overall shape and taper of the back shell 164 and the comfort member 244.

Figure 21:
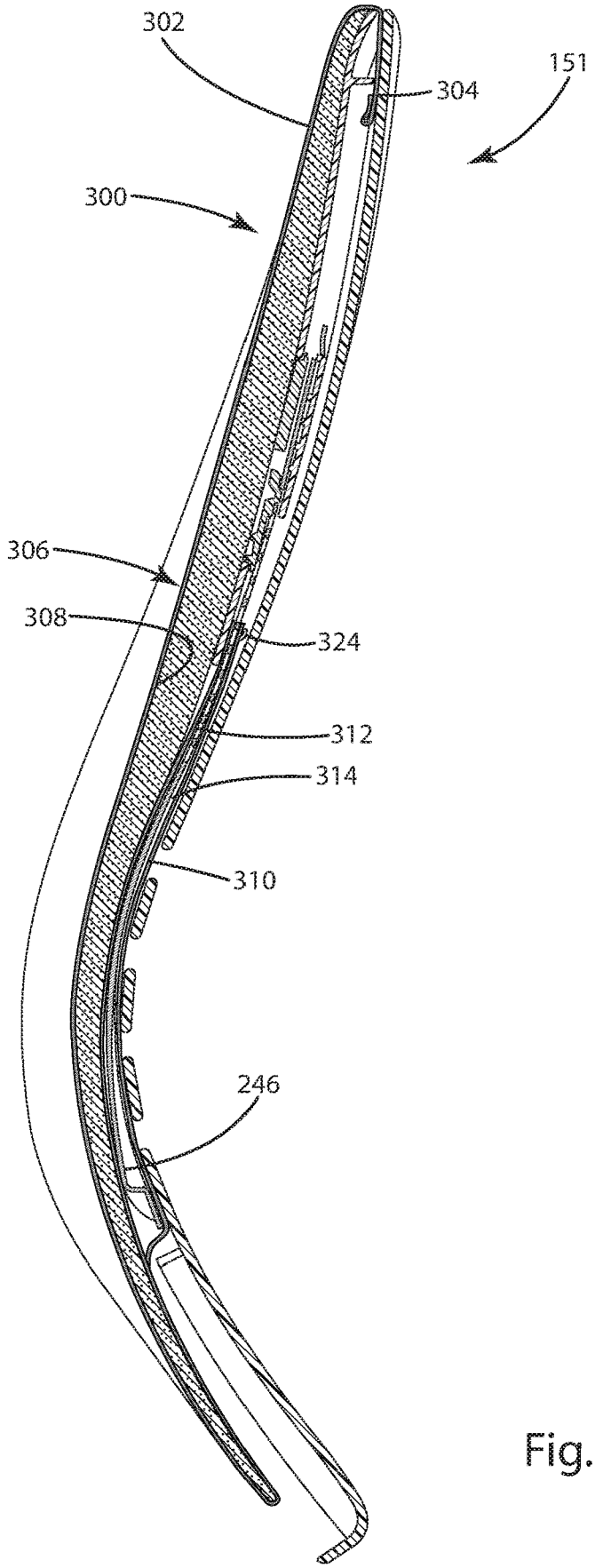
FIG. 21 is a cross-sectional side view of the back assembly and an upholstery assembly along the line XXI-XXI, FIG. 10.

The back assembly 151 further includes an upholstery cover assembly 300 (FIGS. 12A and 12B) that houses the back shell 244, the lumbar support assembly 246 and the cushion member 296 therein. In the illustrated example, the cover assembly 300 (FIG. 21) comprises a fabric material and includes a front side 302 and a rear side 304 that are sewn together along the respective side edges thereof to form a first pocket 306 having a first interior or inner space 308 that receives the back shell 244 and the cushion member 296 therein, and a flap portion 310 that is sewn to the rear side 304 and cooperates therewith to form a second pocket 312 having a second interior or inner space 308 that receives the lumbar support assembly 246 therein.

Figure 22A:
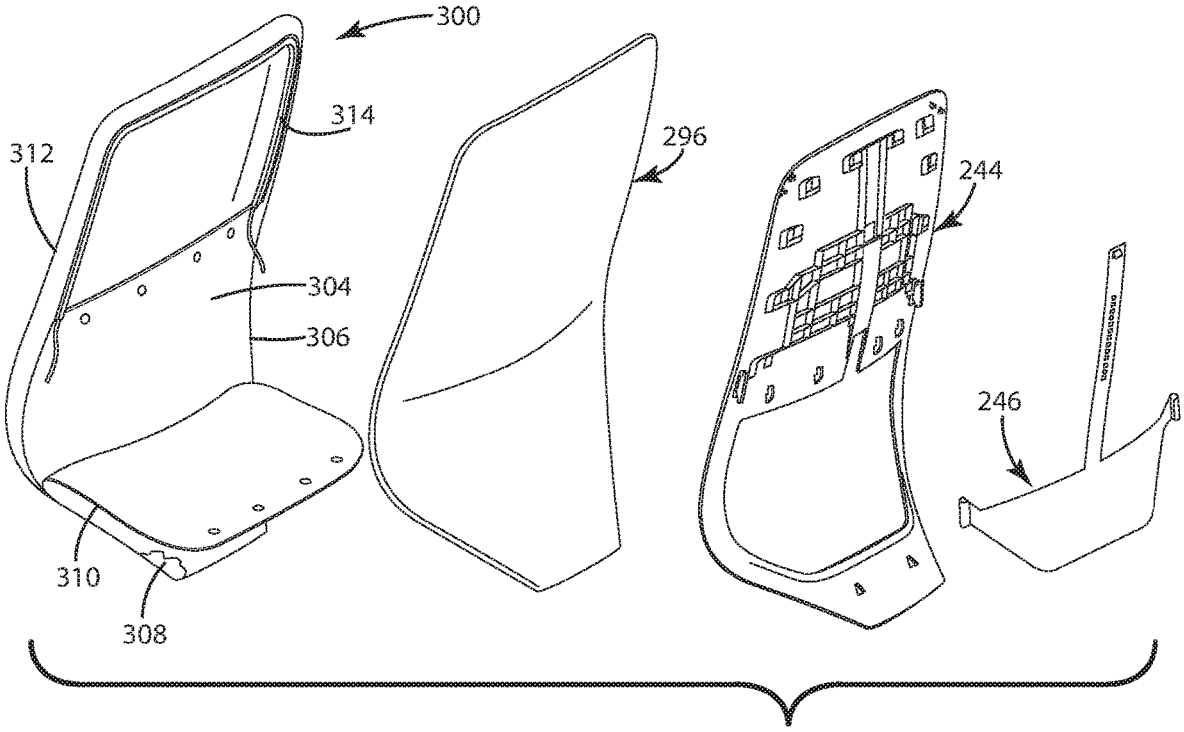
FIGS. 22A-22D are stepped assembly views of the back assembly and the upholstery assembly.
Figure 22B:
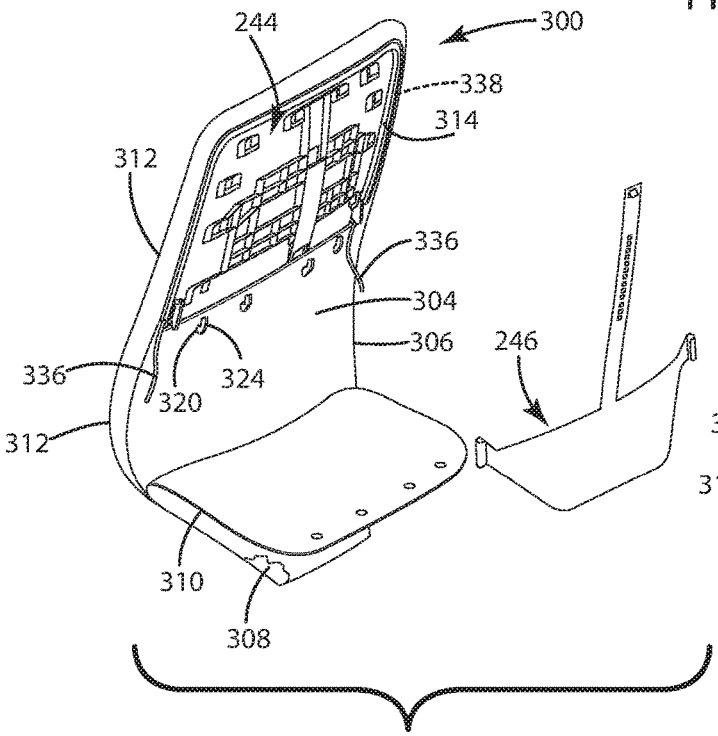
Figure 22C:
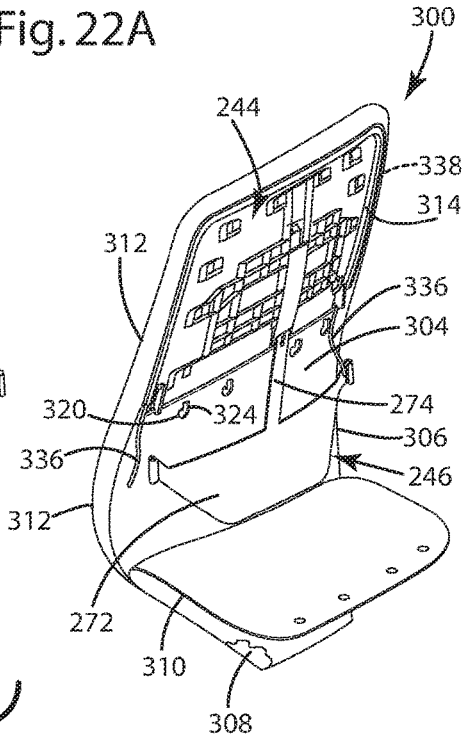
Figure 22D:
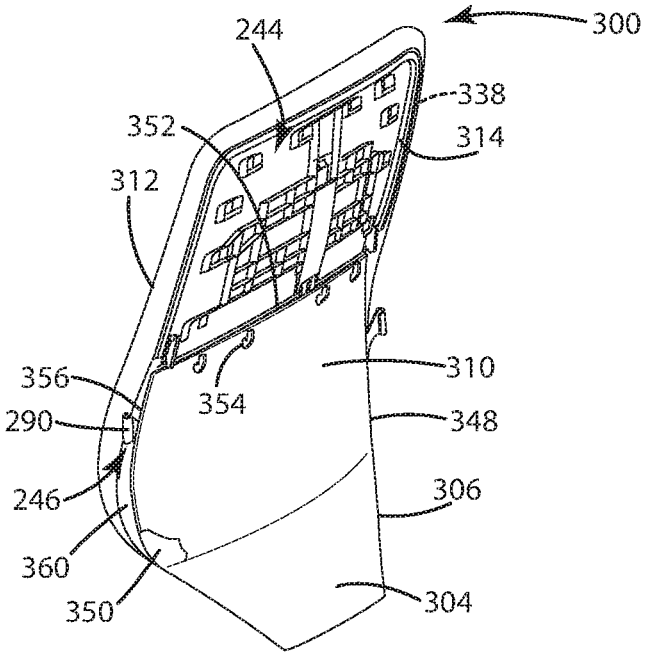
Figure 23:
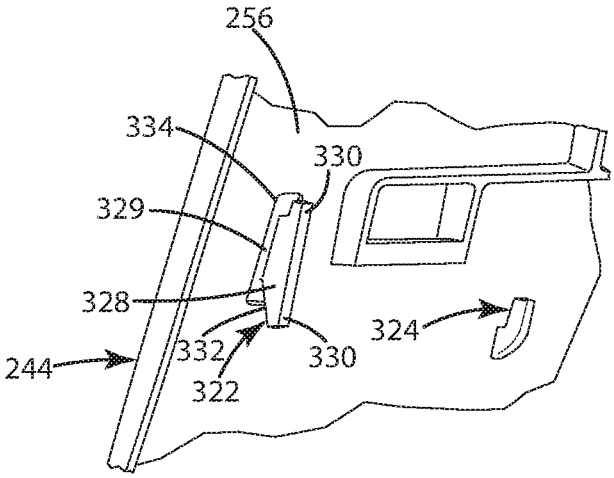
FIG. 23 is an enlarged perspective view of an area XXIII, FIG. 18B.
Figure 24A:
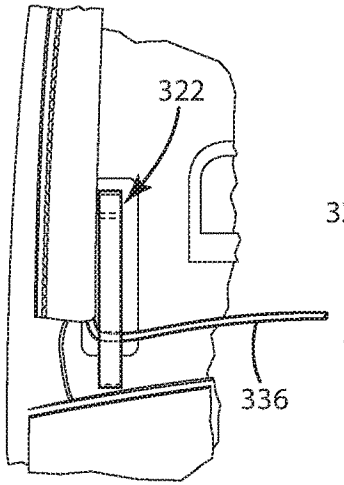
FIGS. 24A-24H are a series of back elevational views of a boat cleat and the sequential steps of a drawstring secured thereto.
Figure 24B:
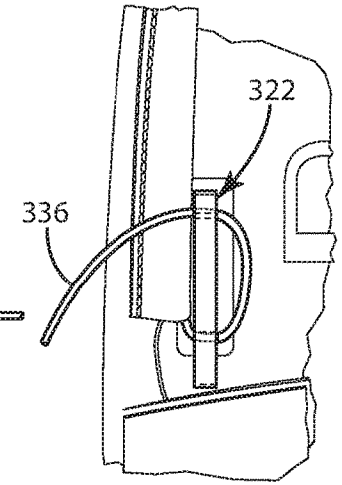
Figure 24C:
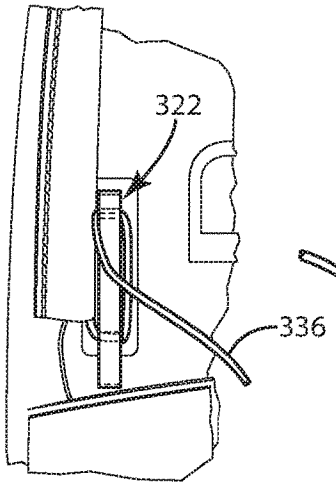
Figure 24D:
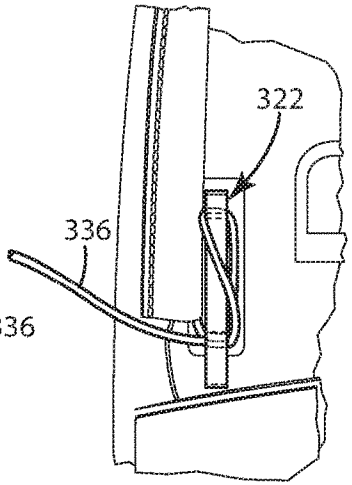
Figure 24E:
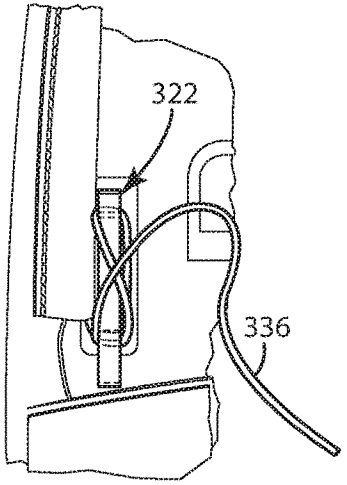
Figure 24F:
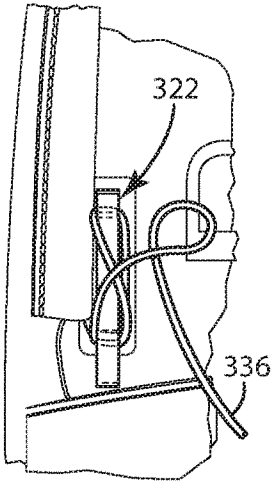
Figure 24G:
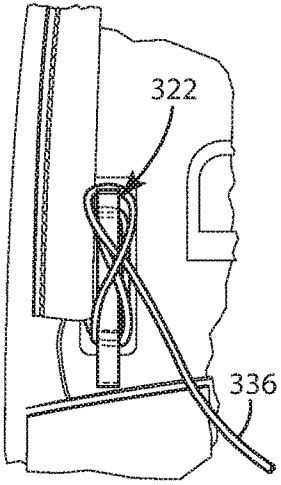
Figure 24H:
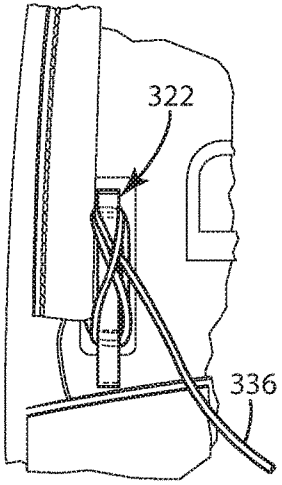
Figure 25:
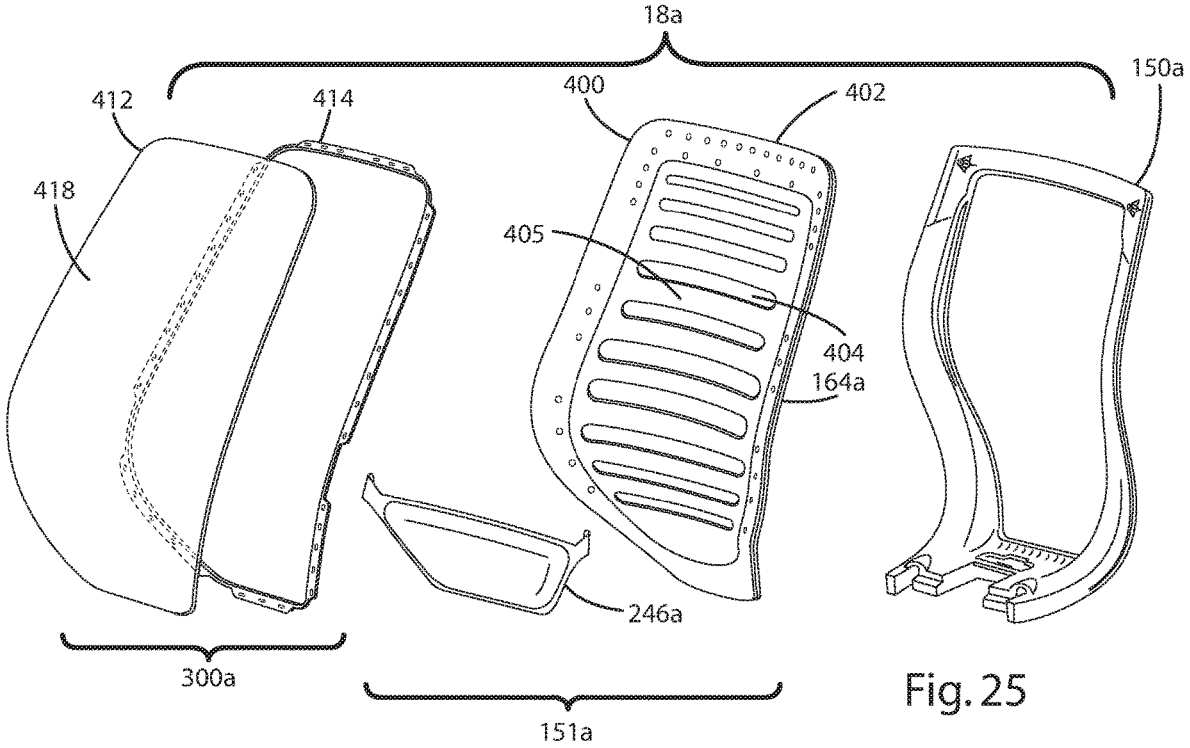
FIG. 25 is an exploded view of an alternative embodiment of the back assembly.

In assembly, the first pocket 306 (FIG. 22A) is formed by attaching the respective side edges of the front side 302 and the rear side 304 to one another such as by sewing or other means suitable for the material for which the cover assembly 300 is comprised, and to define the first interior space 308. An edge of the flap portion 310 is then secured to the rear side 304 proximate a midsection 312 thereof. In the illustrated example, the combination of the back shell 164 and the cushion member 296 are then inserted into the interior space 308 of the first pocket 306 via an aperture 314 located of the rear side 304 (FIG. 22B). The upholstery cover assembly 300 is stretched about the cushion member 296 and the comfort member 244, and is secured to the comfort member 244 by a plurality of apertures 320 that receive upwardly extending hook members 324 (FIG. 23) therethrough. Alternatively, the cover assembly 300 may be configured such that apertures 320 are positioned to also receive T-shaped attachment members 322 therethrough. In the illustrated example, the attachment members 322 and the hook members 324 are integrally formed with the comfort member 244. Each attachment member 322 is provided with a T-shaped cross-section or boat-cleat configuration having a first portion 328 extending perpendicularly rearward from within a recess 329 of the rear surface 256 of the comfort member 244, and a pair of second portions 330 located at a distal end of the first portion 328 and extending outwardly therefrom in opposite relation to one another. One of the second portions 330 cooperates with the first portion 328 to form an angled engagement surface 332. The recess 329 defines an edge 334 about the perimeter thereof.

The cover assembly 300 is further secured to the comfort member 244 by a drawstring 336 that extends through a drawstring tunnel 338 of the cover assembly 300, and is secured to the attachment members 322. Specifically, and as best illustrated in FIGS. 24A-24H, each free end of the drawstring 336 is secured to an associated attachment member 322 in a knot-free manner and without the use of a mechanical fastener that is separate from the comfort member 244. In assembly, the drawstring 336 and drawstring tunnel 338 guide about a plurality of guide hooks 339 (FIG. 18B) located about a periphery of and integrally formed with the back shell 344. The drawstring 336 is wrapped about the associated attachment member 322 such that the tension in the drawstring 336 about the attachment member 322 forces the drawstring 366 against the engagement surface 332 that angles towards the recess 329, thereby forcing a portion of the drawstring 336 into the recess 329 and into engagement with at least a portion of the edge 334 of the recess 329 resulting in an increased frictional engagement between the drawstring 336 and the comfort member 244.

The lumbar assembly 246 is then aligned with the assembly of the cover assembly 300, the cushion member 296 and the comfort member 244 such that the body portion 272 of the lumbar assembly 246 is located near the midsection 312 of the cover assembly 300, and the support portion 274 of the lumbar assembly 246 is coupled with the comfort member 244 as described above. The flap portion 310 is then folded over the lumbar assembly 246, thereby creating a second pocket 348 having an interior space 350. A distally located edge 352 of the flap portion 310 is attached to the comfort member 244 by a plurality of apertures 354 with the flap portion 310 that receive the hooks 324 therethrough. The distal edge 352 may also be sewn to the rear side 304 of the cover assembly 300. In the illustrated example, the side edges 356 of the flap portion 310 are not attached to the remainder of the cover assembly 300, such that the side edges 356 cooperate with the remainder of the cover assembly 300 to form slots 360 through which the handle portions 290 of the lumbar assembly 246. The second pocket 348 is configured such that the lumbar assembly 246 is vertically adjustable therein. The assembly of the cover assembly 300, the cushion member 296, the comfort member 244 and the lumbar assembly 246 are then attached to the back shell 164.

Figure 26:
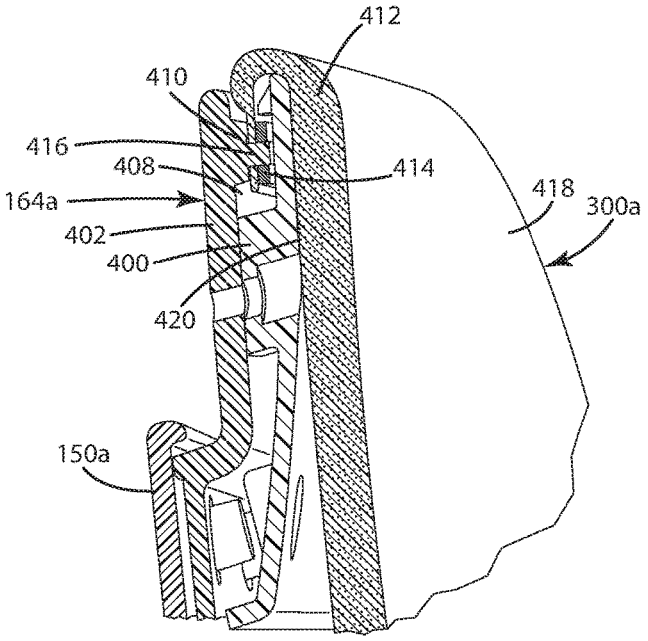
FIG. 26 is a cross-sectional side view of a top portion of the alternative embodiment of the back assembly.
Figure 27:
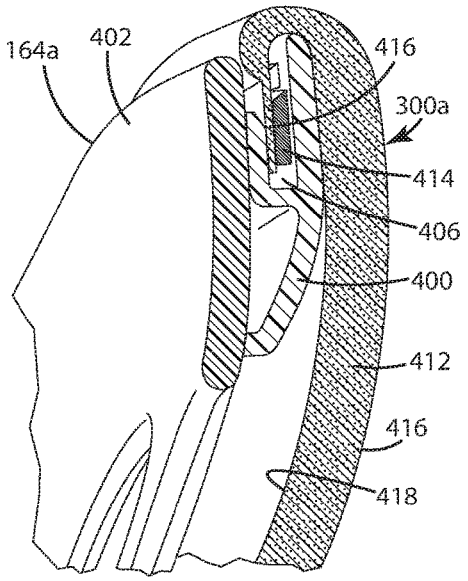
FIG. 27 is a cross-sectional view of a side portion of the alternative embodiment of the back assembly.

The reference numeral 18*a* generally designates an alternative embodiment of the back assembly. Since back assembly 18*a* is similar to the previously described back assembly 18, similar parts appearing in FIGS. 12A and 12B and FIGS. 25-30 are represented respectively by the same corresponding reference numeral, except for the suffix "a" in the numerals of the latter. The back assembly 18*a* includes a back frame assembly 150*a*, a back shell 164*a*, and an upholstery cover assembly 300*a*. In the illustrated example, the back shell 164*a* includes a substantially flexible outer peripheral portion 400 and a substantially less flexible rear portion 402 to which the peripheral portion 400 is attached. The rear portion 402 includes a plurality of laterally extending, vertically spaced slots 405 that cooperate to define slats 404 therebetween. As best illustrated in FIGS. 26 and 27, the peripheral portion 400 and the rear portion 402 cooperate to form an outwardly facing opening 408 extending about a periphery of the back shell 164*a*. The rear portion 402 includes a plurality of ribs 410 spaced about the groove 408 and are utilized to secure the cover assembly 300*a* to the back shell 164*a* as described below.

Figure 28:
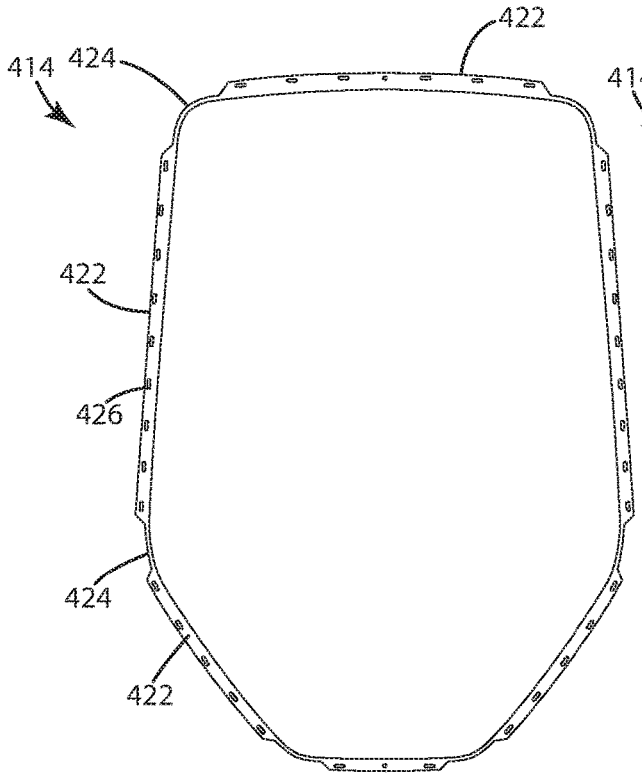
FIG. 28 is a front elevational view of a stay member.
Figure 29:
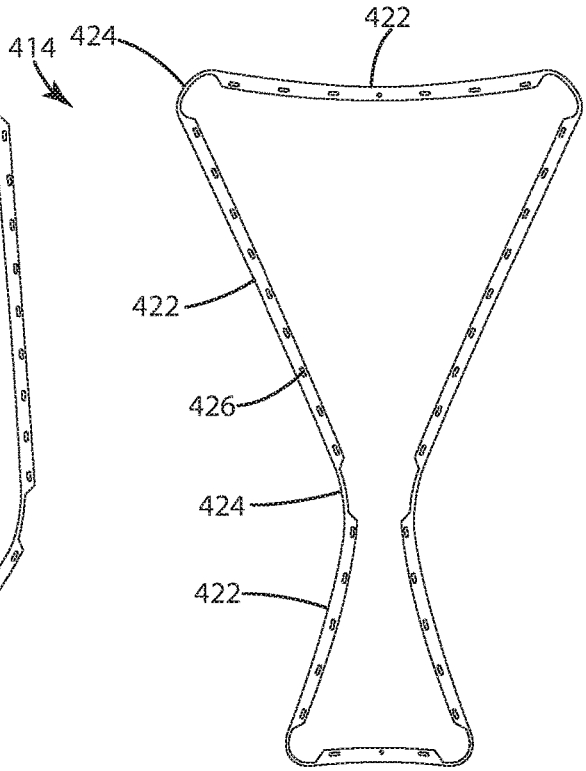
FIG. 29 is a front elevational view of the stay member in an inside-out orientation.
Figure 30:
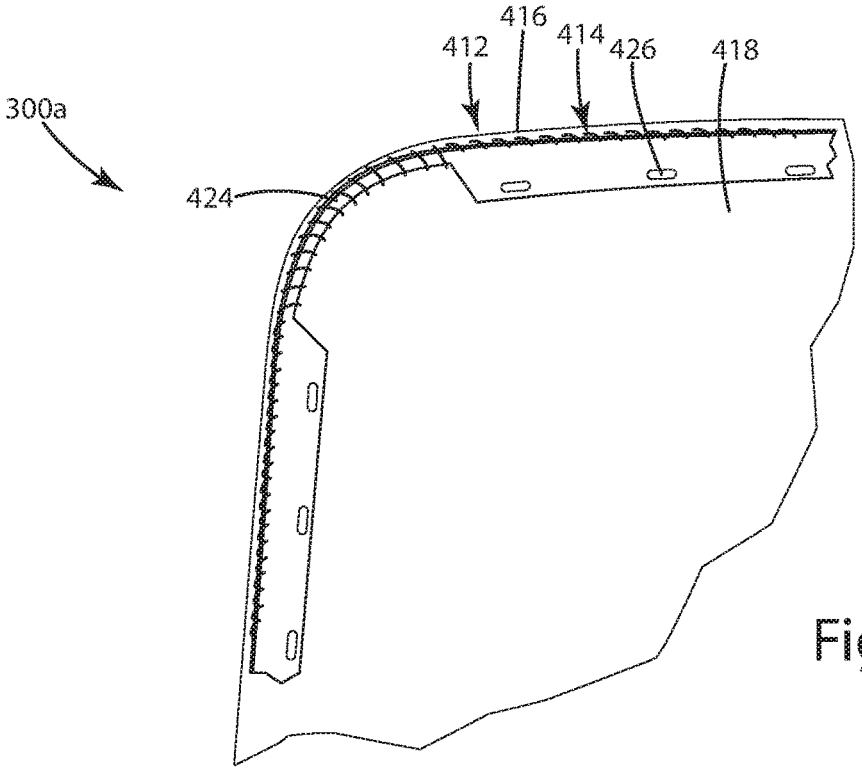
FIG. 30 is a partial front elevational view of the stay member sewn to a cover member.

The cover assembly 300*a* includes a fabric cover 412 and a stay-member 414 extending about a peripheral edge 416 fabric cover 412. The fabric cover 412 includes a front surface 418 and a rear surface 420 and preferably comprises a material flexible in at least one of a longitudinal direction and a lateral direction. As best illustrated in FIG. 28, the stay member 414 is ring-shaped and includes a plurality of widened portions 422 each having a rectangularly-shaped cross-sectional configuration interspaced with a plurality of narrowed corner portions 424 each having a circularly-shaped cross-sectional configuration. Each of the widened portions 422 include a plurality of apertures 426 spaced along the length thereof and adapted to engage with the ribs 410 of the back shell 164*a*, as described below. The stay member 414 is comprised of a relatively flexible plastic such that the stay member 414 may be turned inside-out, as illustrated in FIG. 29.

In assembly, the stay member 414 is secured to the rear surface 420 of the cover 412 such that the cover 412 is fixed for rotation with the widened portions 422, and such that the cover 412 is not fixed for rotation with the narrowed corner portions 424 along a line tangential to a longitudinal axis of the narrowed corner portions 424. In the present example, the stay member 414 (FIG. 30) is sewn about the peripheral edge 416 of the cover 412 by a stitch pattern that extends through the widened portions 422 and about the narrowed corner portions 424. The cover assembly 300*a* of the cover 412 and the stay member 414 are aligned with the back shell 164*a*, and the peripheral edge 416 of the cover 412 is wrapped about the back shell 164*a* such that the stay member 414 is turned inside-out. The stay member 414 is then inserted into the groove 408, such that the tension of the fabric cover 412 being stretched about the back shell 164*a* causes the stay member 414 to remain positively engaged within the groove 408. The ribs 410 of the back shell 164*a* engage the corresponding apertures 426 of the stay member 414, thereby further securing the stay member 414 within the groove 408. It is noted that the stitch pattern attaching the cover 412 to the stay member 414 allows the narrowed corner portions 424 of the stay member 414 to rotate freely with respect to the cover 412, thereby reducing the occurrence of aesthetic anomalies near the corners of the cover 412, such as bunching or over-stretch of a given fabric pattern.

Figure 31:
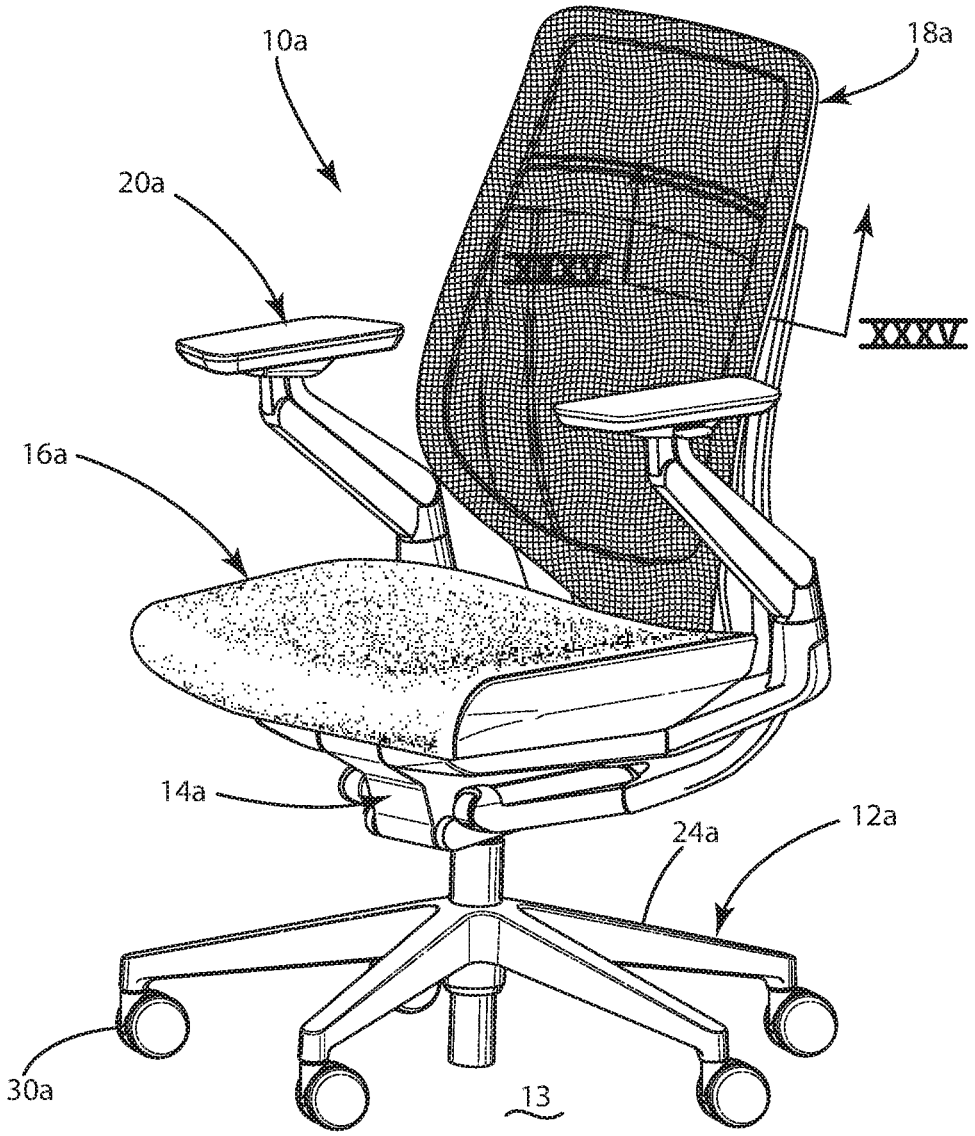
FIG. 31 is a front perspective view of an alternative embodiment of the chair assembly, including a back assembly comprising a mesh fabric cover.
Figure 32:
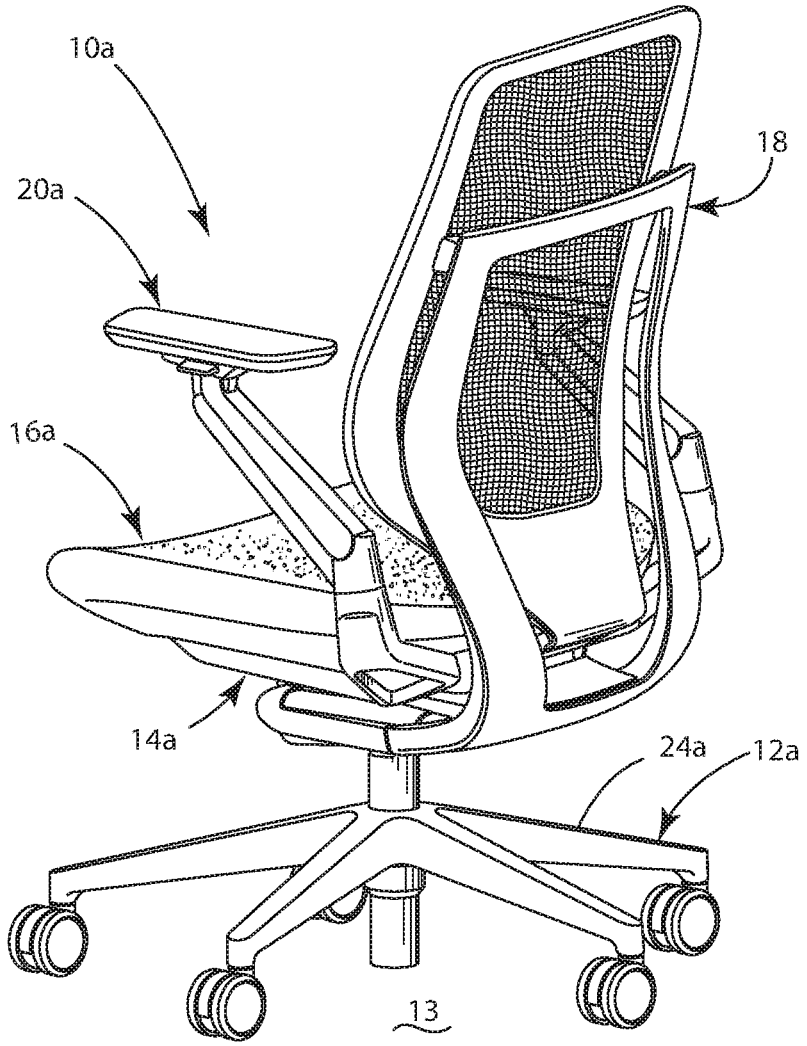
FIG. 32 is a back perspective view of an alternative embodiment of the chair assembly, including a back assembly comprising a mesh fabric cover.
Figure 33:
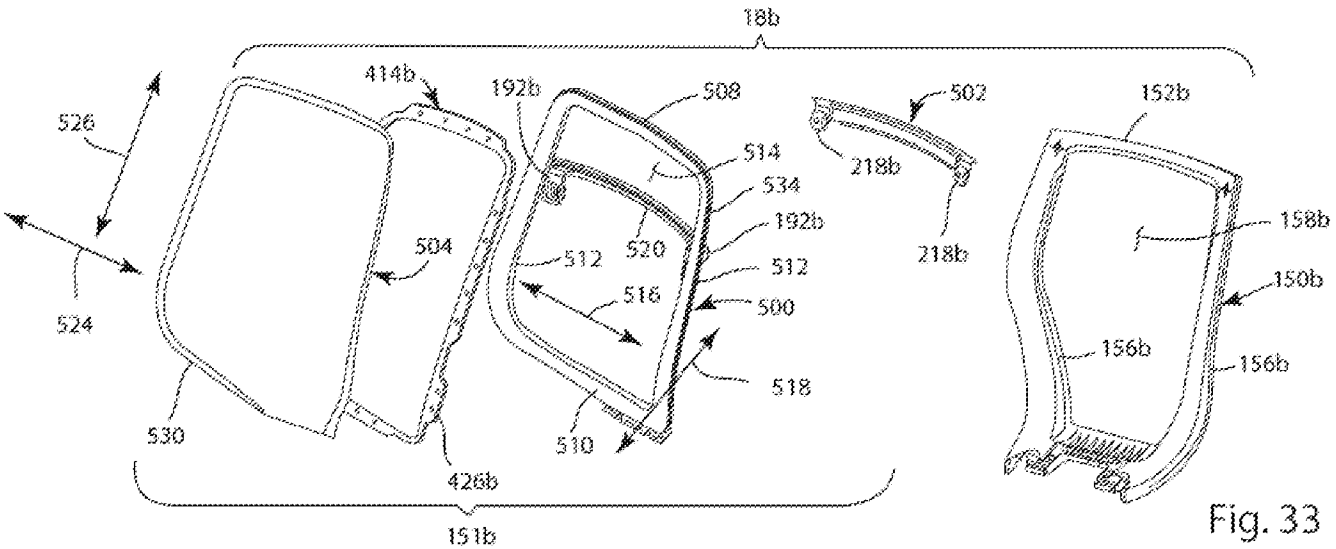
FIG. 33 is an exploded front perspective view of a back assembly of the alternative chair assembly.
Figure 34:
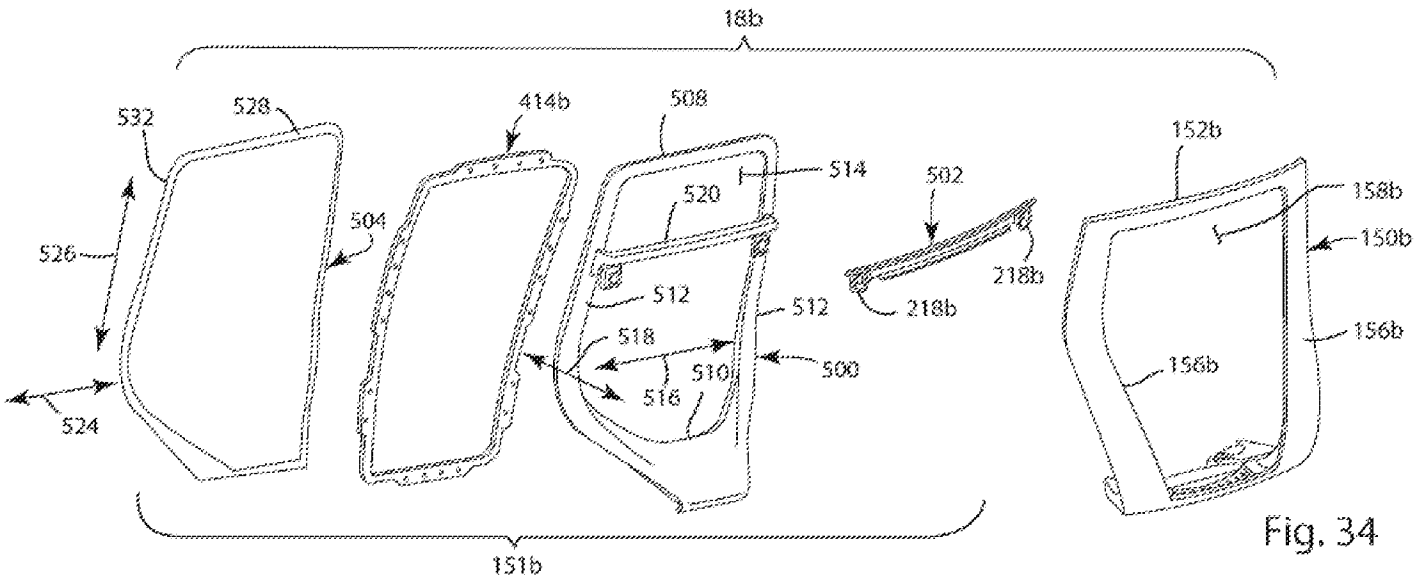
FIG. 34 is an exploded rear perspective view of a back assembly of the alternative chair assembly.

The reference numeral 10*b* (FIGS. 31 and 32) generally designates another embodiment of the present invention. Since chair assembly 10*b* is similar to the previously described chair assembly 10, similar parts appearing in FIGS. 1-30 and FIGS. 31-34 respectfully are representative of the same, corresponding reference numeral, except for the suffix "b" in the numerals of the latter. The chair assembly 10*b* is similar in construction and assembly to the chair assembly 10 as previously described, with the most notable exception being the configuration of the back assembly 18*b*.

As best illustrated in FIGS. 31-34, the back assembly 18*b* includes back frame assembly 150*b*, a back shell member 500, a cross member 502, and a mesh fabric upholstery cover 504. The back shell member 500 includes a laterally extending top portion 508, a laterally extending bottom portion 510, and a pair of longitudinally extending side portions 512 that extend between the top portion 508 and the bottom portion 510 and cooperate therewith to define an open space 514 therebetween. In the illustrated example, the back shell member 500 comprises a molded plastic, and is configured such that the side portions 512 and overall back shell member 500 are substantially rigid in a lateral direction 516 and relatively flexible in fore-and-aft direction 518. The back shell member 500 further includes a lateral portion 520 that extends between the side portions 512 at a position spaced between the top portion 508 and the bottom portion 510. The lateral portion 520 includes integrally molded pivot bosses 192*b*. In the illustrated example, the back shell member 500 is molded as a single, integral piece.

The cross member 502 extends laterally across and is secured to the back frame assembly 150*b*. In the illustrated example, the cross member 502 includes arcuately-shaped bearing surfaces 218*b* that cooperate with the pivot bosses 192*b* in a similar manner to as previously described bearing surfaces 218 and pivot bosses 192 of chair assembly 10, such that the lumbar area of the back shell member 500 is flexed in the fore-and-aft direction 518 as the back frame assembly 150*b* is moved between the upright and reclined positions in a similar manner to as described herein with respect to the back shell 164.

Figure 35A:
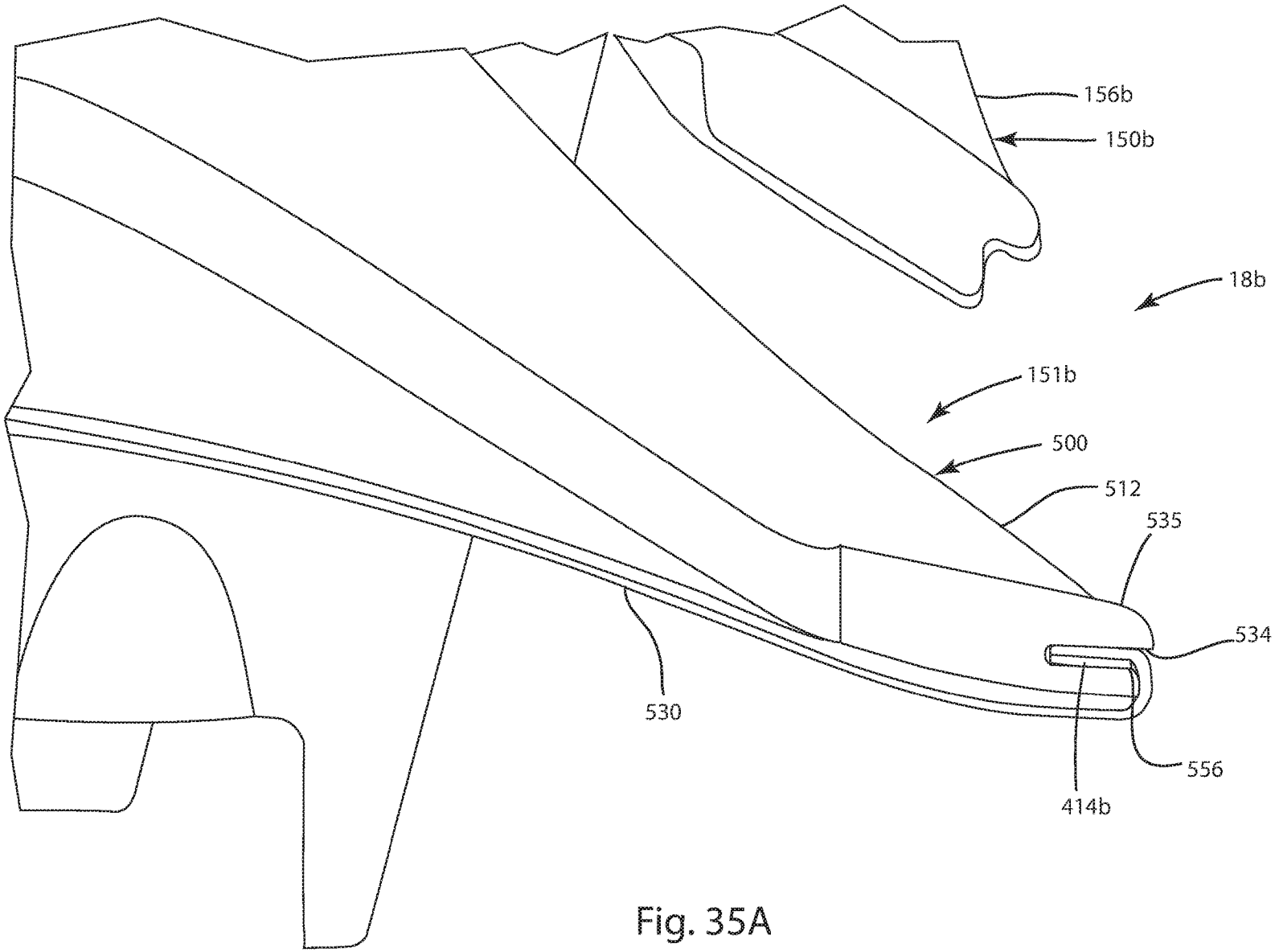
FIG. 35A is a cross-sectional view of the back assembly of the alternative chair assembly taken through the line XXXV-XXXV, FIG. 31.

The cover 504 comprises a thermoelastic knit or woven fabric material that is substantially less compliant in a lateral direction 524 than in a longitudinal direction 526. Preferably, the cover 504 has a longitudinal direction compliance to lateral direction compliance of at least 3:1, and more preferably of at least 10:1. In assembly, the ring or stay member 414*b* (FIG. 35) is attached to a rear surface 528 of the cover 504, opposite the front surface 530 and proximate the outer edge 532. The ring 414*b* and the outer edge 532 of the cover 504 are then wrapped about the back shell member 500 and inserted into a channel 534 that opens peripherally outward and extends longitudinally along the top portion 508, the bottom portion 510 and the side portions 512 of the back shell member 500. In the illustrated example, the ring member 414*b* includes a plurality of peripherally-spaced tabs 550 and reliefs 552, while the channel 534 includes a plurality of peripherally-spaced reliefs 554 and tabs 556 that are interspaced and engage one another, respectively, thereby cooperating to provide the back support assembly 151*b* with a rounded-edge aesthetic appearance. It is noted that in the illustrated example, an inwardly extending peripheral lip portion 535 of the cover 504 extends 180° to the main user-supporting portion 537 of the cover 504. The lip portion 535 preferably extends between 90° and 180° of the user-supporting portion 537.

Figure 36:
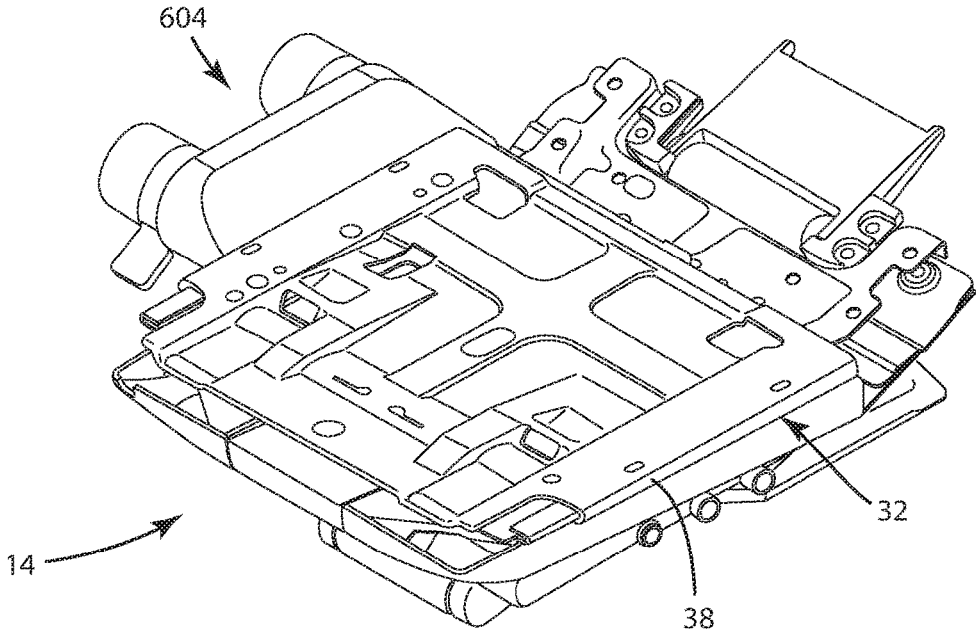
FIG. 36 is a perspective view of a control input assembly supporting a seat support plate thereon.
Figure 37:
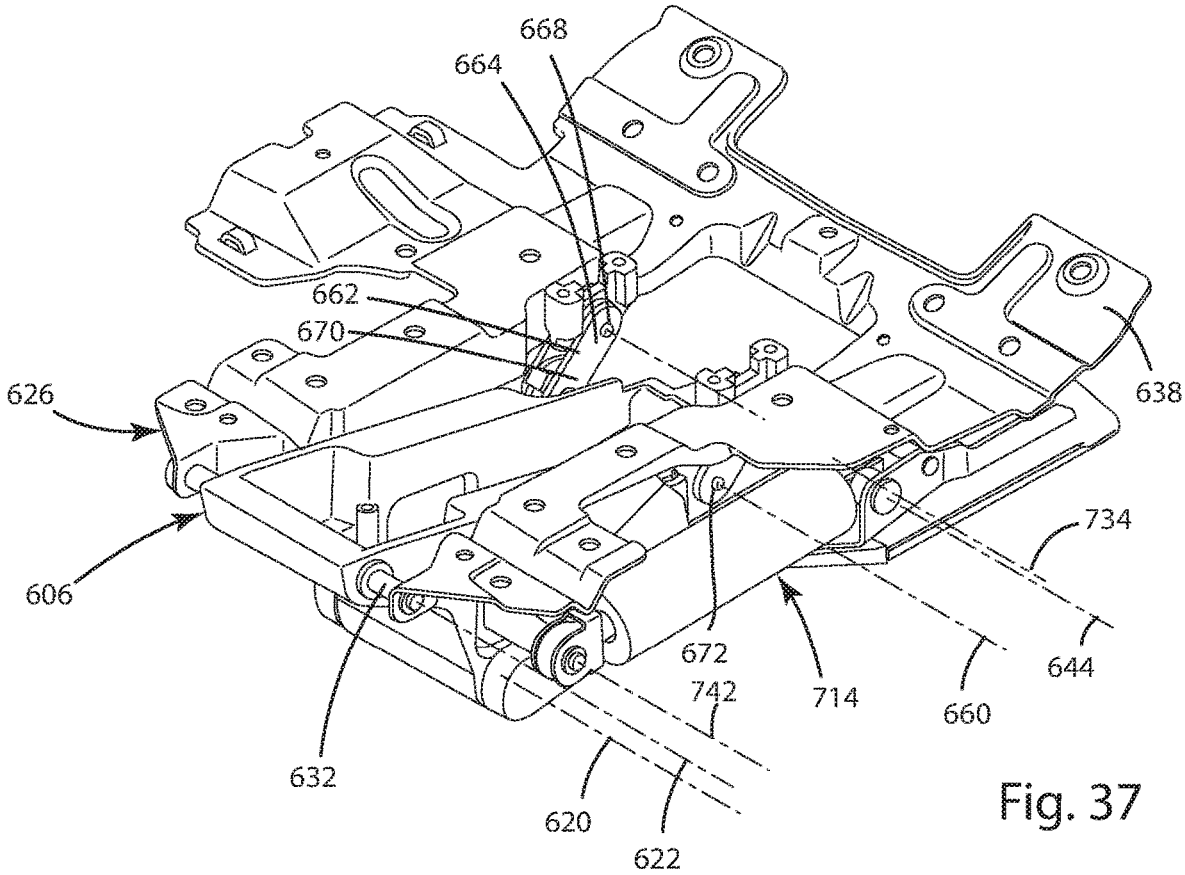
FIG. 37 is a perspective view of the control input assembly with certain elements removed to show the interior thereof.
Figure 38:
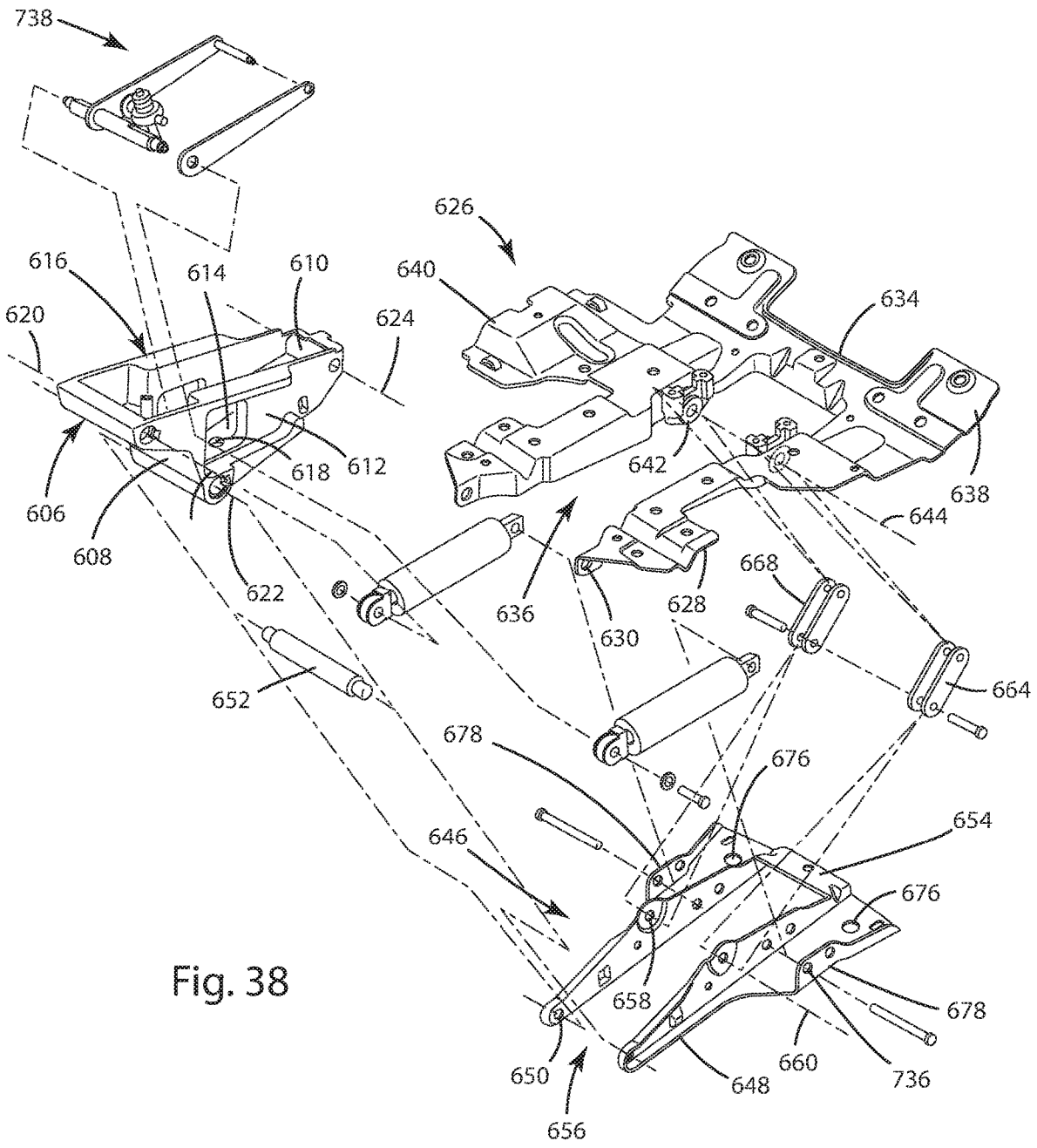
FIG. 38 is an exploded view of the control input assembly.

The seat assembly 16 and the back assembly 18 are operably coupled to and controlled by the control assembly 14 (FIG. 36) and a control input assembly 604. The control assembly 14 (FIGS. 37-39) includes a housing or base structure or ground structure 606 that includes a front wall 608, a rear wall 610, a pair of side walls 612 and a bottom wall 614 integrally formed with one another and that cooperate to form an upwardly opening interior space 616. The bottom wall 614 includes an aperture 618 centrally disposed therein for receiving the cylinder assembly 28 (FIG. 3) therethrough. The base structure 606 further defines an upper and forward pivot point 620, a lower and forward pivot point 622, and an upper and rearward pivot point 624, wherein the control assembly 14 further includes a seat support structure 626 that supports the seat assembly 16. In the illustrated example, the seat support structure 626 has a generally U-shaped plan form configuration that includes a pair of forwardly extending arm portions 628 each including a forwardly located pivot aperture 630 pivotably secured to the base structure 606 by a pivot shaft 632 for pivoting movement about the upper and forward pivot point 620. The seat support structure 626 further includes a rear portion 634 extending laterally between the arm portions 628 and cooperating therewith to form an interior space 636 within which the base structure 606 is received. The rear portion 634 includes a pair of rearwardly extending arm mounting portions 638 to which the arm assemblies 20 mount. The seat support structure 626 further includes a control input assembly mounting portion 640 to which the control input assembly 604 is mounted. The seat support structure 626 further includes a pair of bushing assemblies 642 that cooperate to define a pivot point 644.

The control assembly 14 further includes a back support structure 646 having a generally U-shaped plan view configuration and including a pair of forwardly extending arm portions 648 each including a pivot aperture 650 and pivotably coupled to the base structure 606 by a pivot shaft 652 such that the back support structure 646 pivots about the lower and forward pivot point 672. The back support structure 646 includes a rear portion 654 that cooperates with the arm portions 648 to define an interior space 656 which receives the base structure 606 therein. The back support structure 646 further includes a pair of pivot apertures 658 located along the length thereof and cooperating to define a pivot point 660. It is noted that in certain instances, at least a portion of the back frame assembly 150 may be included as part of the back support structure 646.

The control assembly 14 further includes a plurality of control links 642 each having a first end 644 pivotably coupled to the seat support structure 626 by a pair of pivot pins 668 for pivoting about the pivot point 644, and a second end 670 pivotably coupled to corresponding pivot apertures 658 of the back support structure 646 by a pair of pivot pins 672 for pivoting about the pivot point 660. In operation, the control links 642 control the motion, and specifically the recline rate of the seat support structure 626 with respect to the back support structure 646 as the chair assembly is moved to the recline position, as described below.

Figure 40A:
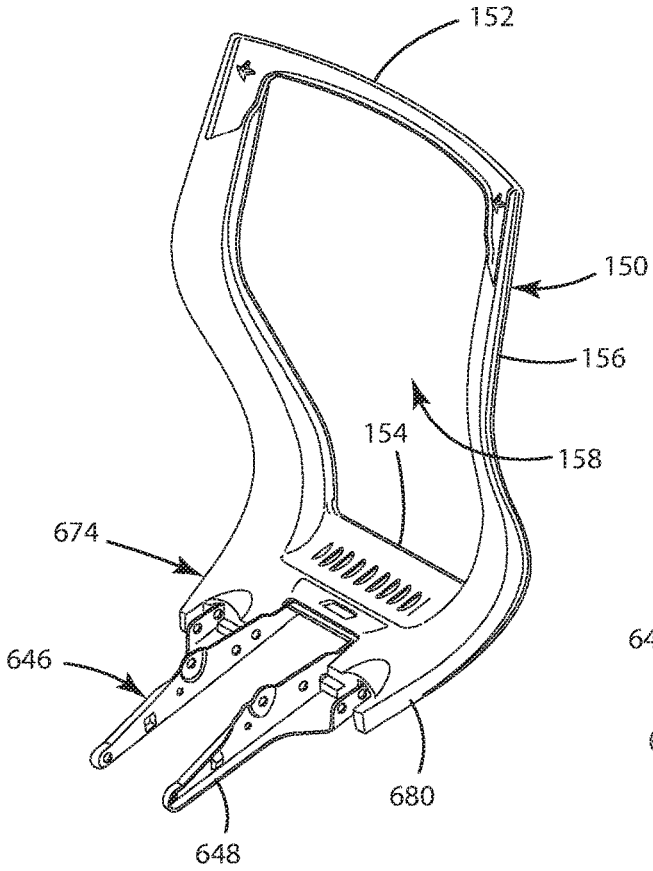
FIG. 40A is a front perspective view of a back support structure.
Figure 40B:
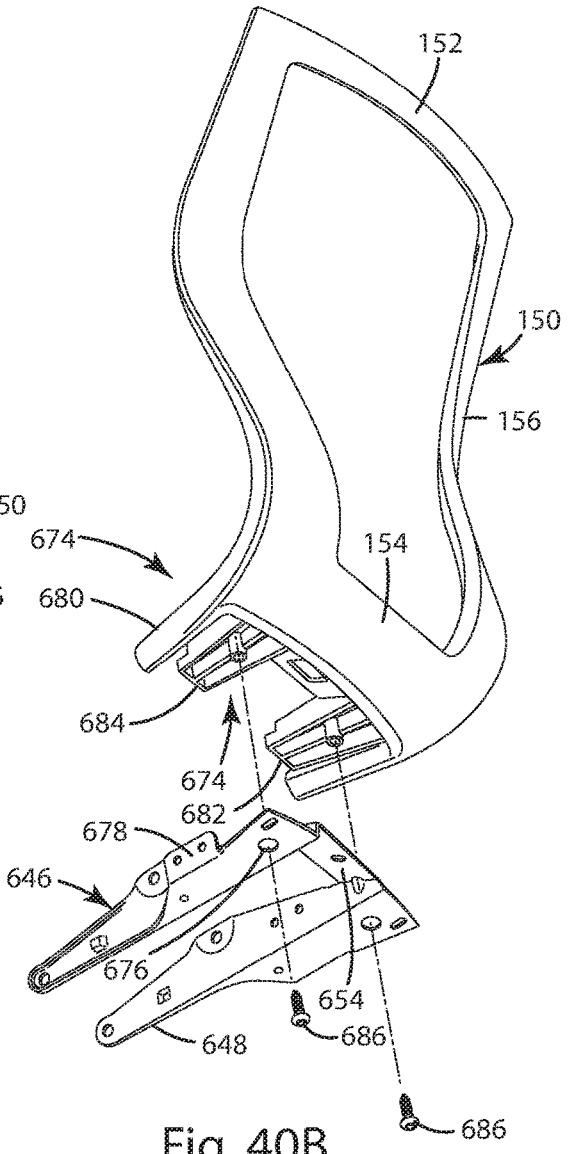
FIG. 40B is an exploded perspective view of the back support structure.

As best illustrated in FIGS. 40*a* and 40*b*, a bottom frame portion 154 of the back frame assembly 150 is configured to connect to the back support structure 646 via a quick connect arrangement 674. Each arm portion 648 of the back support structure 646 includes a mounting aperture 676 located at a proximate end 678 thereof. In the illustrated example, the quick connect arrangement 674 includes a configuration of the bottom frame portion 154 of the back frame assembly 150 to include a pair of forwardly extending coupler portions 680 that cooperate to define a channel 682 therebetween that receives the rear portion 654 and the proximate ends 678 of the arm portions 648 therein. Each coupler portion 680 includes a downwardly extending boss 684 that aligns with and is received within a corresponding aperture 676. Mechanical fasteners, such as screws 686 are then threaded into the bosses 684, thereby allowing a quick connection of the back frame assembly 150 to the control assembly 14.

Figure 41:
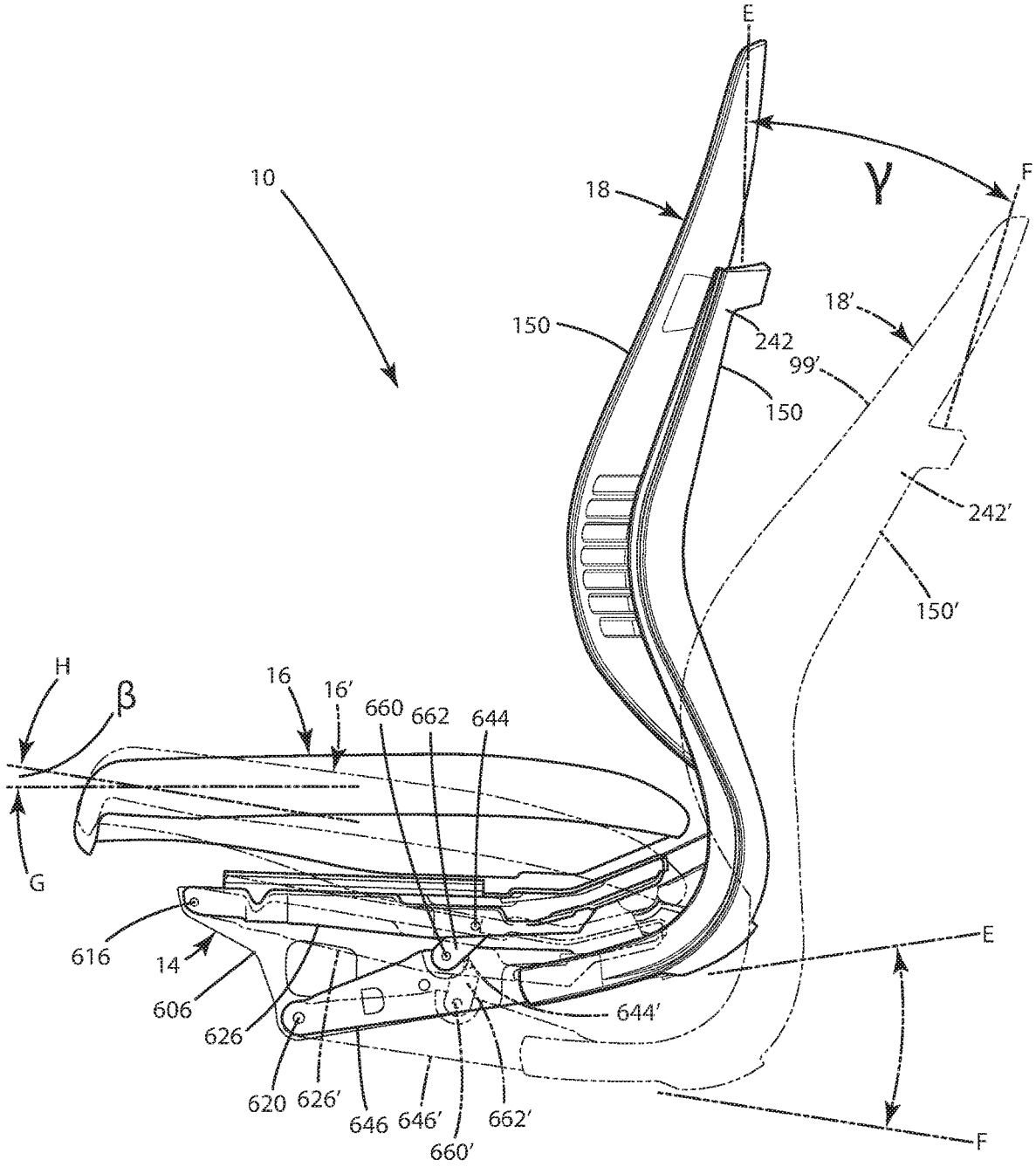
FIG. 41 is a side elevational view of the chair assembly illustrating multiple pivot points thereof.

As best illustrated in FIG. 41, the base structure 606, the seat support structure 626, the back support structure 646 and the control links 662 cooperate to form a four-bar linkage assembly that supports the seat assembly 16, the back assembly 18, and the arm assemblies 20. For ease of reference, the associated pivot assemblies associated with the four-bar linkage assembly of the control assembly 14 are referred to as follows: the upper and forward pivot point 620 between the base structure 606 and the base support structure 626 as the first pivot point 620; the lower and forward pivot point 622 between the base structure 606 and the back support structure 646 as the second pivot point 622; the pivot point 644 between the first end 664 of the control link 662 and the seat support structure 626 as the third pivot point 644; and, the pivot point 660 between the second end 670 of the control link 662 and the back support structure 646 as the fourth pivot point 660. Further, FIG. 41 illustrates the component of the chair assembly 10 shown in a reclined position in dashed lines, wherein the reference numerals of the chair in the reclined position are designated with a "'".

In operation, the four-bar linkage assembly of the control assembly 14 cooperates to recline the seat assembly 16 from the upright position G to the reclined position H as the back assembly 18 is moved from the upright position E to the reclined position F. Specifically, the control link 662 is configured and coupled to the seat support structure 626 and the back support structure 646 to cause the seat support structure 626 to rotate about the first pivot point 620 as the back support structure 646 is pivoted about the second pivot point 622. Preferably, the seat support structure 646 is rotated about the first pivot point 620 at between about ⅓ and about ⅔ the rate of rotation of the back support structure 646 about the second pivot point 620, more preferably the seat support structure rotates about the first pivot point 612 at about half the rate of rotation of the back support structure 646 about the second pivot point 620, and most preferable the seat assembly 16 reclines to an angle β of about 9° from the fully upright position G to the fully reclined position H, while the back assembly 18 reclines to an angle α of about 18° from the fully upright position E to the fully reclined position F.

Figure 42:
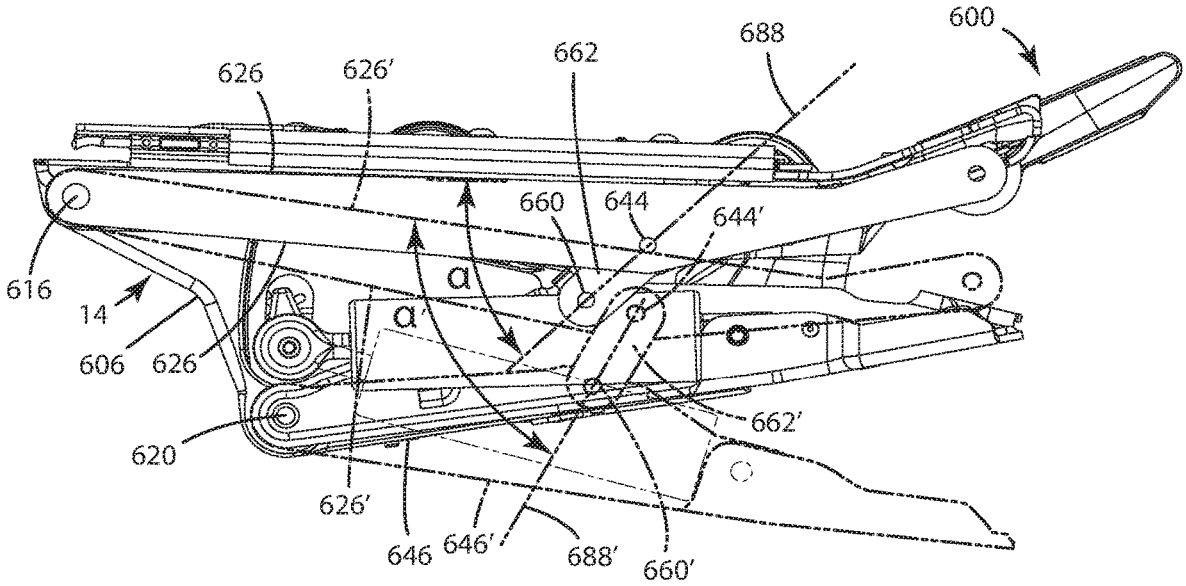
FIG. 42 is a side perspective view of the control assembly showing multiple pivot points associated therewith.

As best illustrated in FIG. 41, the first pivot point 612 is located above and forward of the second pivot point 620 when the chair assembly 10 is at the fully upright position, and when the chair assembly 10 is at the fully reclined position as the base structure 606 remains fixed with respect to the supporting floor surface 13 as the chair assembly 10 is reclined. The third pivot point 644 remains behind and below the relative vertical height of the first pivot point 612 throughout the reclining movement of the chair assembly 10. It is further noted that the distance between the first pivot point 612 and the second pivot point 620 is greater than the distance between the third pivot point 644 and fourth pivot point 660 throughout the reclining movement of the chair assembly 10. As best illustrated in FIG. 42, a longitudinally extending center line axis 688 of the control link 662 forms an acute angle α with the seat support structure 626 when the chair assembly 10 is in the fully upright position and an acute angle α' when the chair assembly 10 is in the fully reclined position. It is noted that the center line axis 688 of the control link 662 does not rotate past an orthogonal alignment with the seat support structure 626 as the chair assembly 10 is moved between the fully upright and fully reclined positions thereof.

Figure 43:
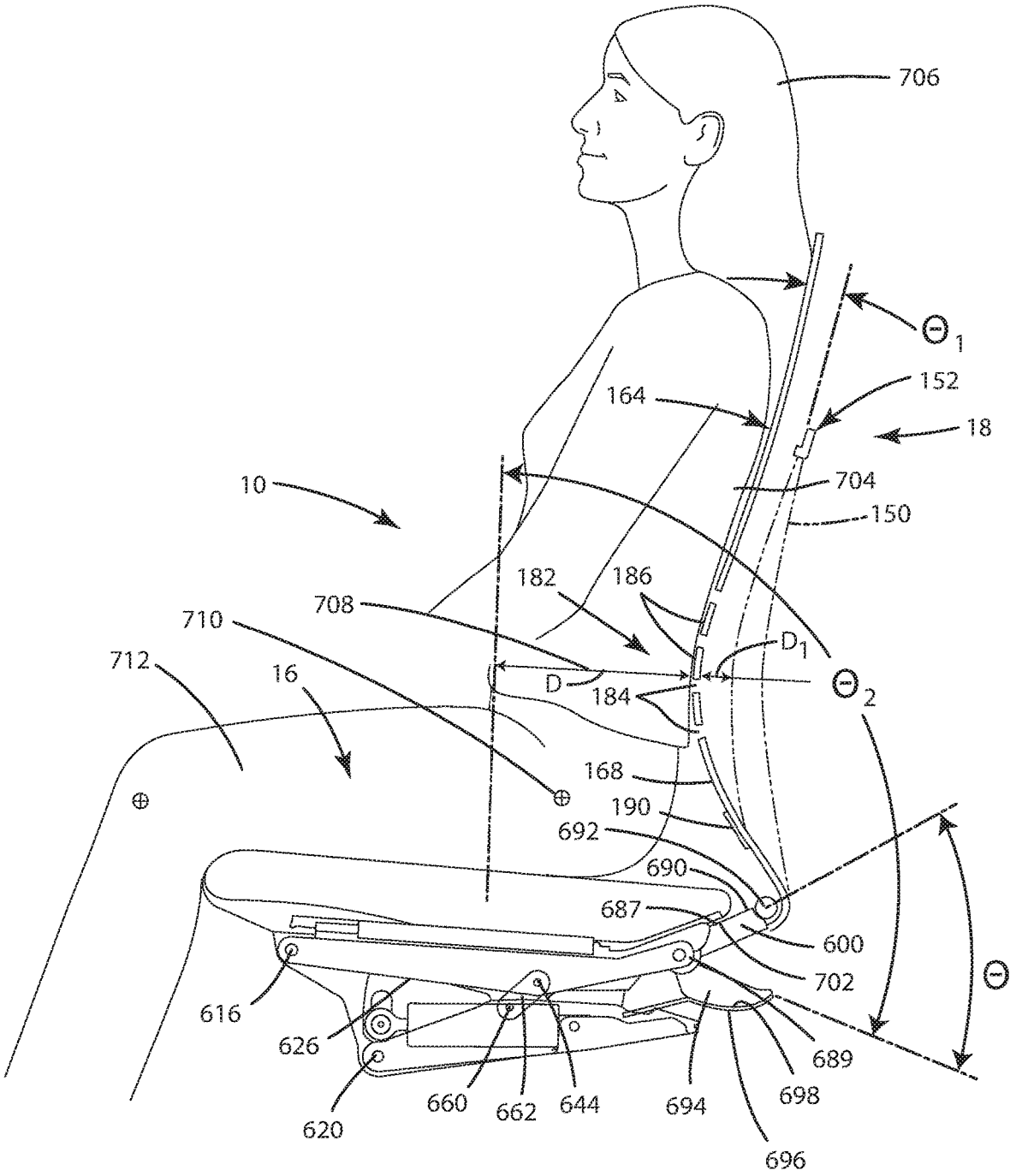
FIG. 43 is a cross-sectional view of the chair showing the back in an upright position with the lumbar adjustment set at a neutral setting.

With further reference to FIG. 43, the back control link 600 includes a forward end 687 that is pivotably connected to seat support structure 626 at a fifth pivot point 689. A rearward end 690 of back control link 600 is connected to lower portion 168 of back shell 164 at a sixth pivot point 692. Sixth pivot point 692 is optional, and back control link 600 and back shell 164 may be rigidly fixed to one another. Also, pivot point 692 may include a stop feature that limits rotation of back control link 600 relative to back shell 164 in a first and/or second rotational direction. For example, with reference to FIG. 43, pivot 692 may include a stop feature that permits clockwise rotation of lower portion 168 of back shell 164 relative to control link 600. This permits the lumbar to become flatter if a rearward/horizontal force tending to reduce dimension D1 is applied to the lumbar portion of back shell 164. However, the stop feature may be configured to prevent rotation of lower portion 168 of back shell 164 in a counter-clockwise direction (FIG. 43) relative to control link 600. This causes link 600 and lower portion 168 of back shell 164 to rotate at the same angular rate as a user reclines in the chair by pushing against an upper portion of back assembly 18.

Figure 48:
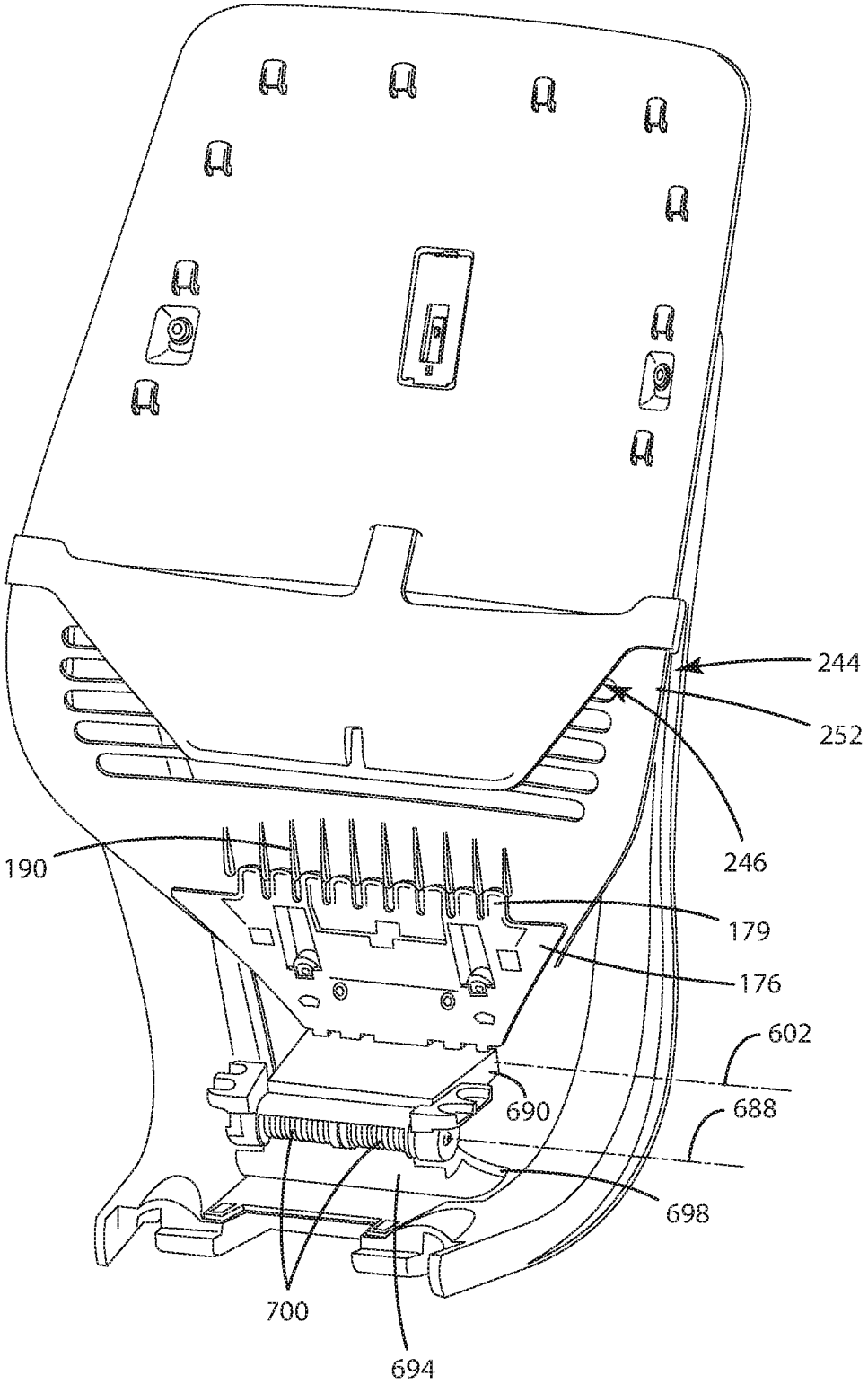
FIG. 48 is a perspective view of the back assembly.
Figure 49:
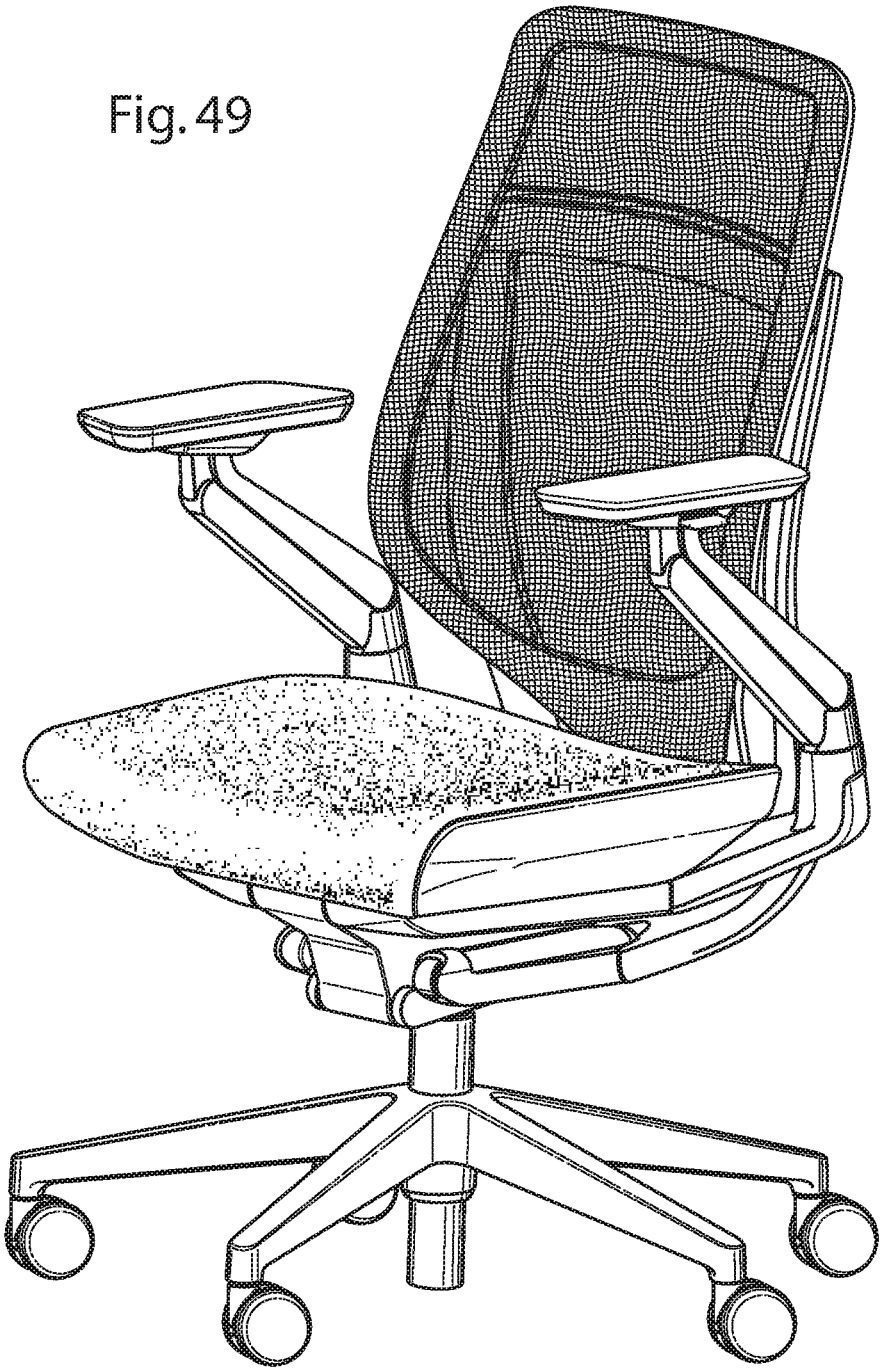
FIG. 49 is a front perspective view of the alternative embodiment of the chair assembly.
Figure 50:
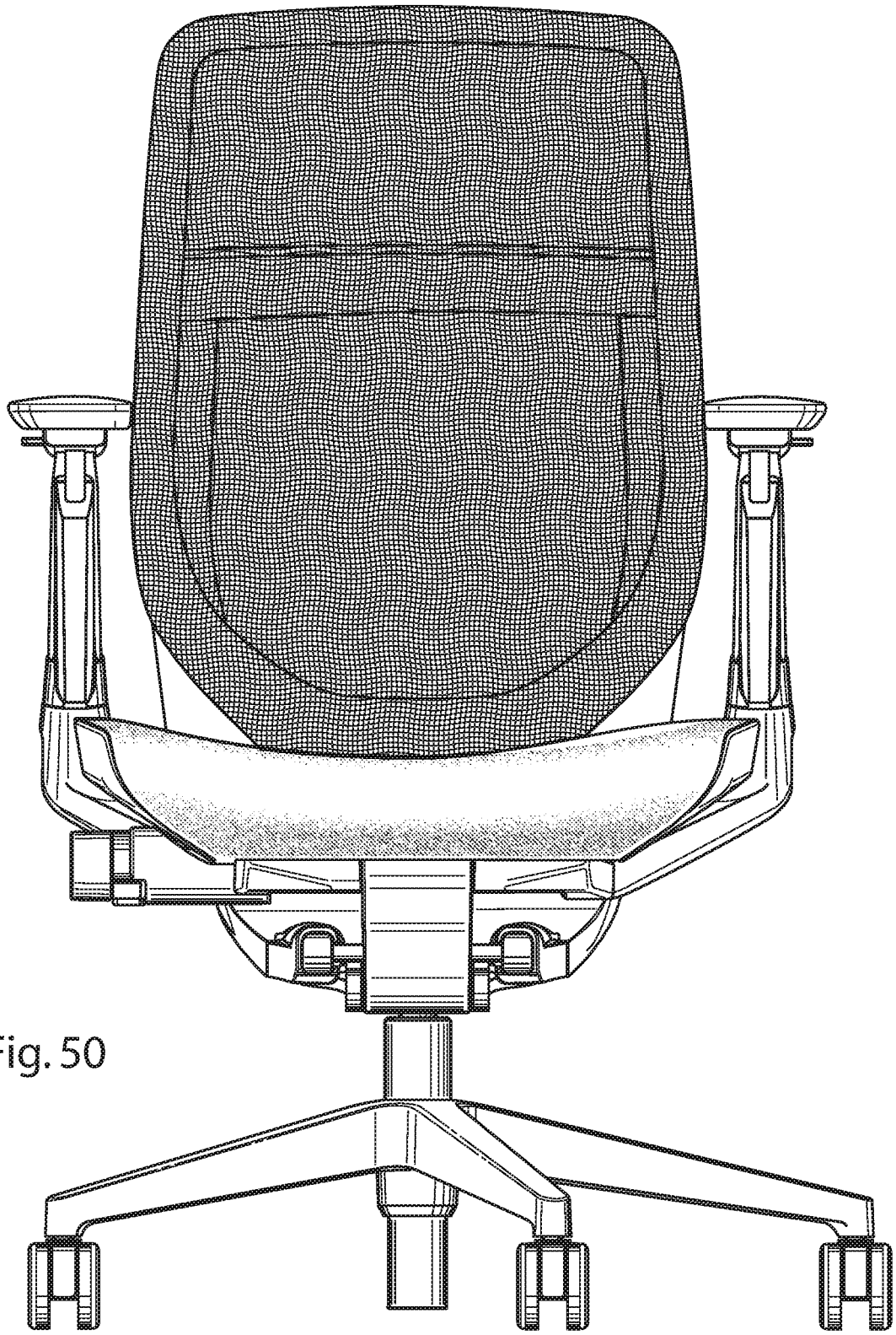
FIG. 50 is a front elevational view of the alternative embodiment of the chair assembly.
Figure 51:
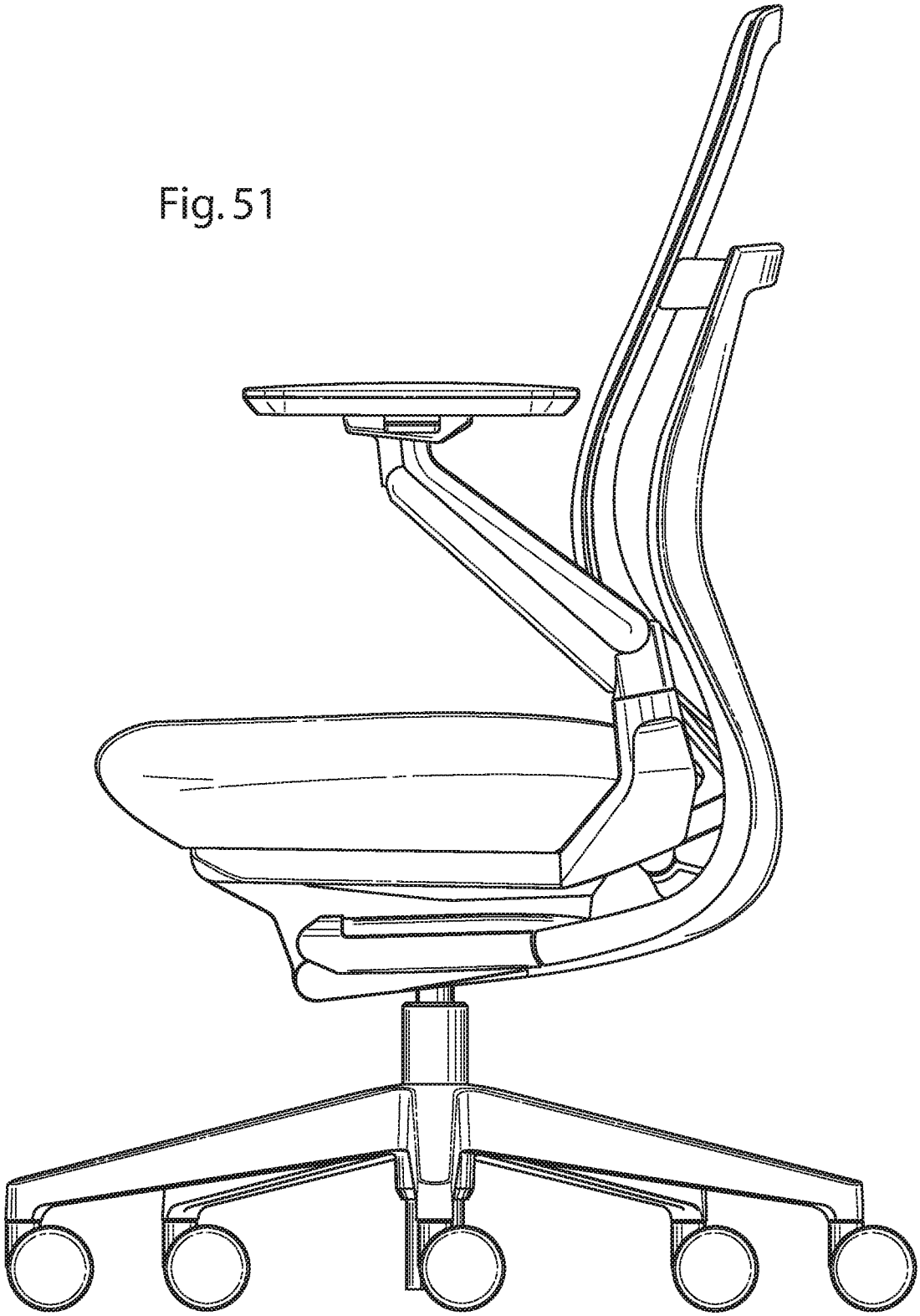
FIG. 51 is a first side elevational view of the alternative embodiment of the chair assembly.
Figure 52:
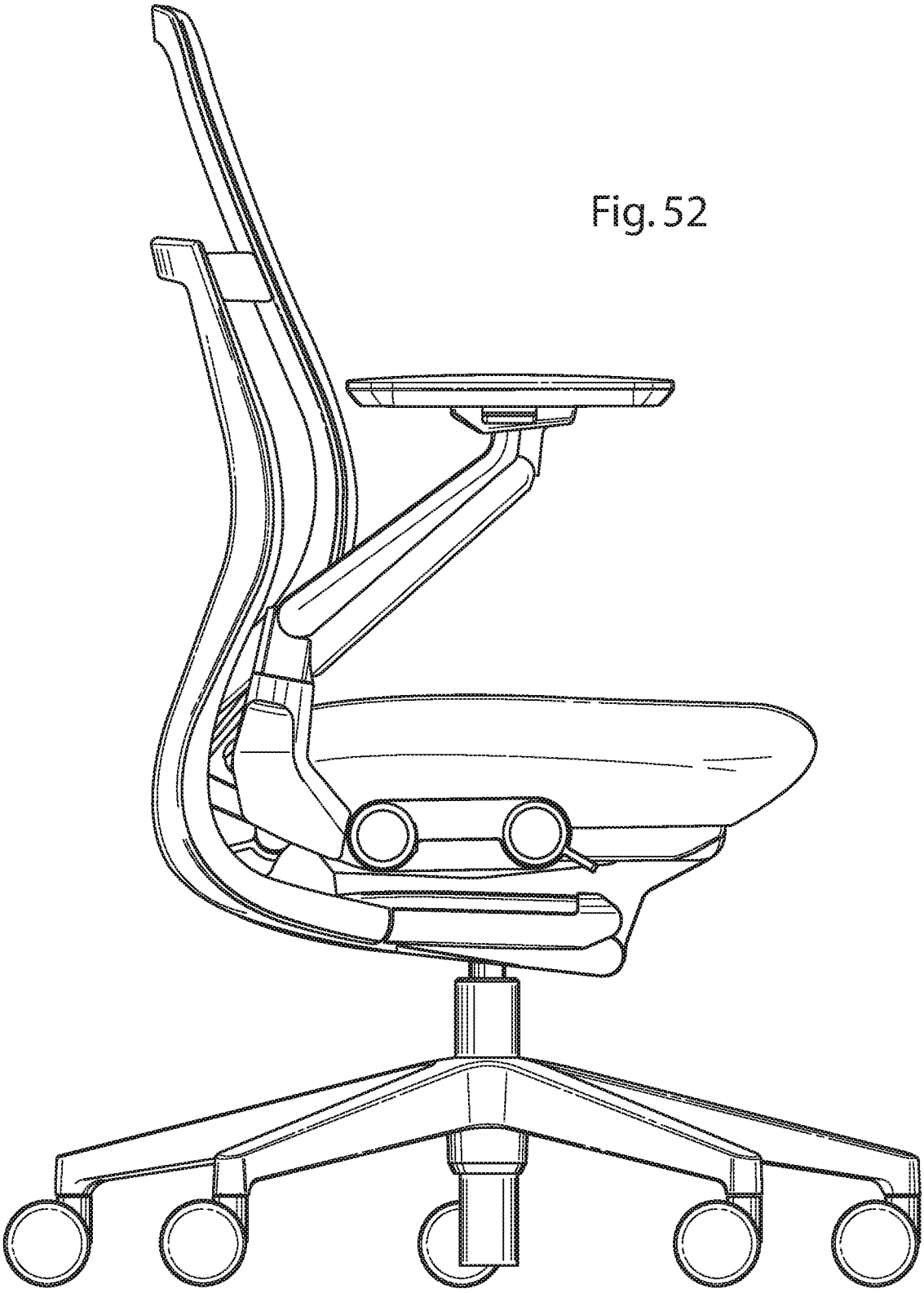
FIG. 52 is a second side elevational view of the alternative embodiment of the chair assembly.
Figure 53:
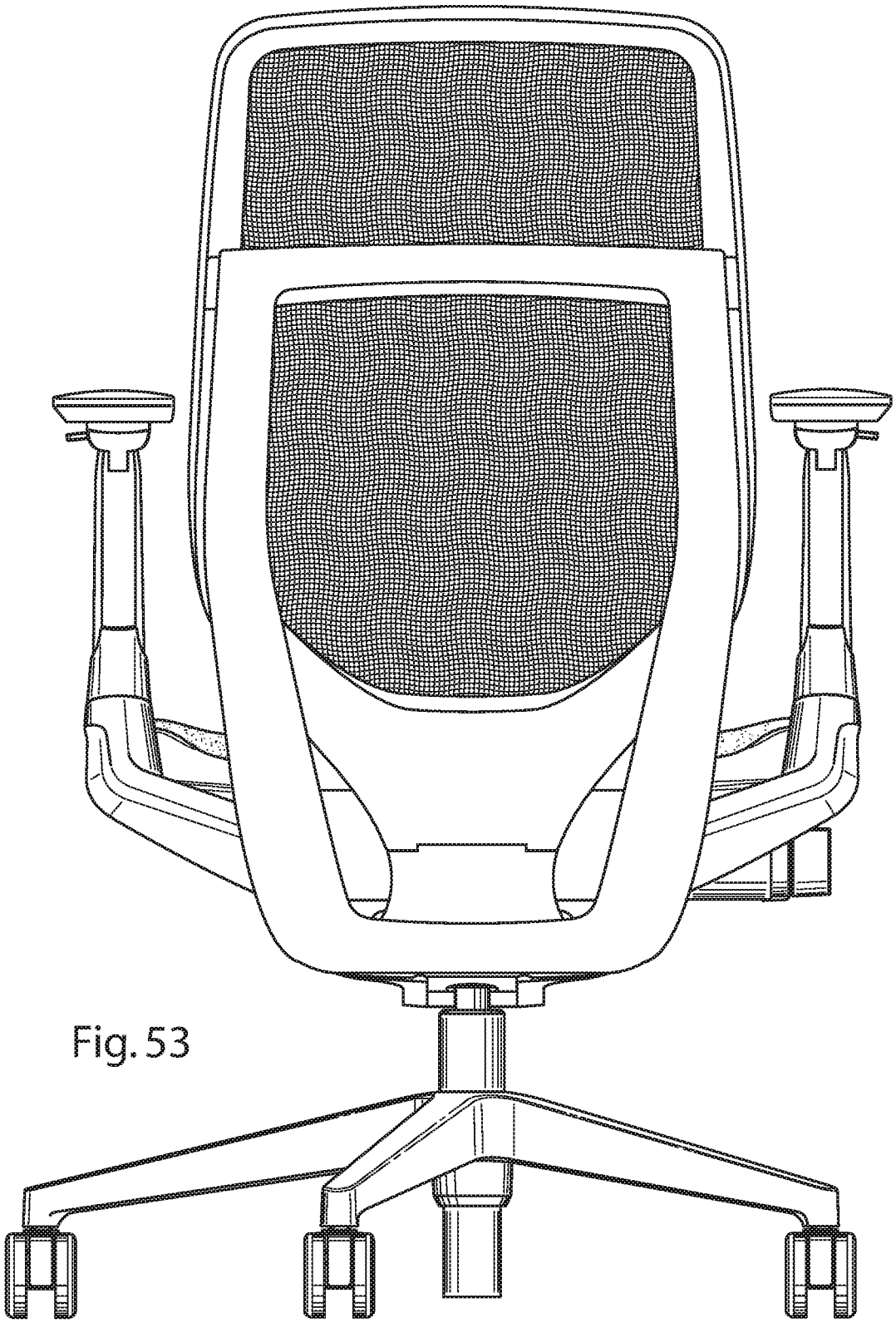
FIG. 53 is an rear elevational view of the alternative embodiment of the chair assembly.
Figure 54:
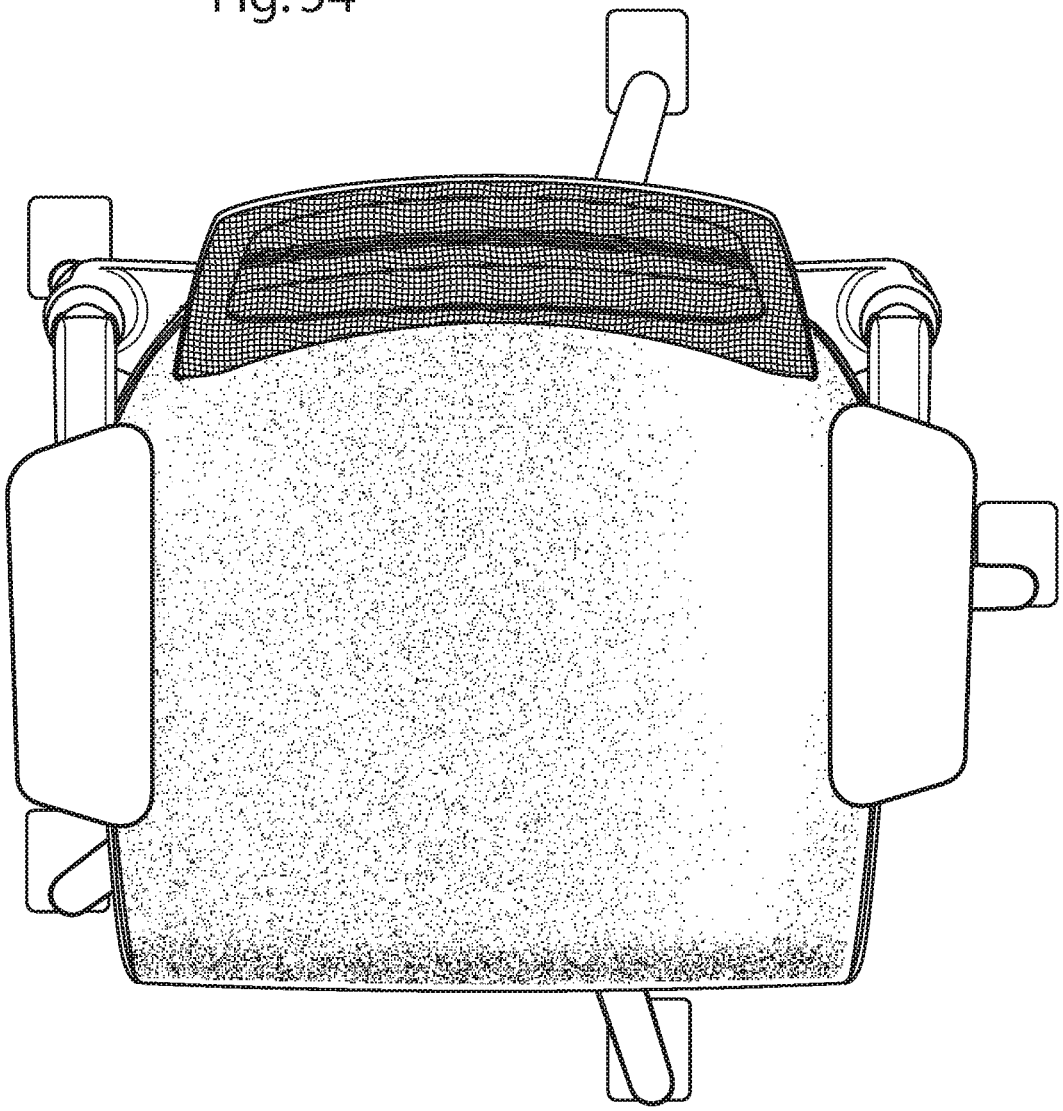
FIG. 54 is a top plan view of the alternative embodiment of the chair assembly.
Figure 55:
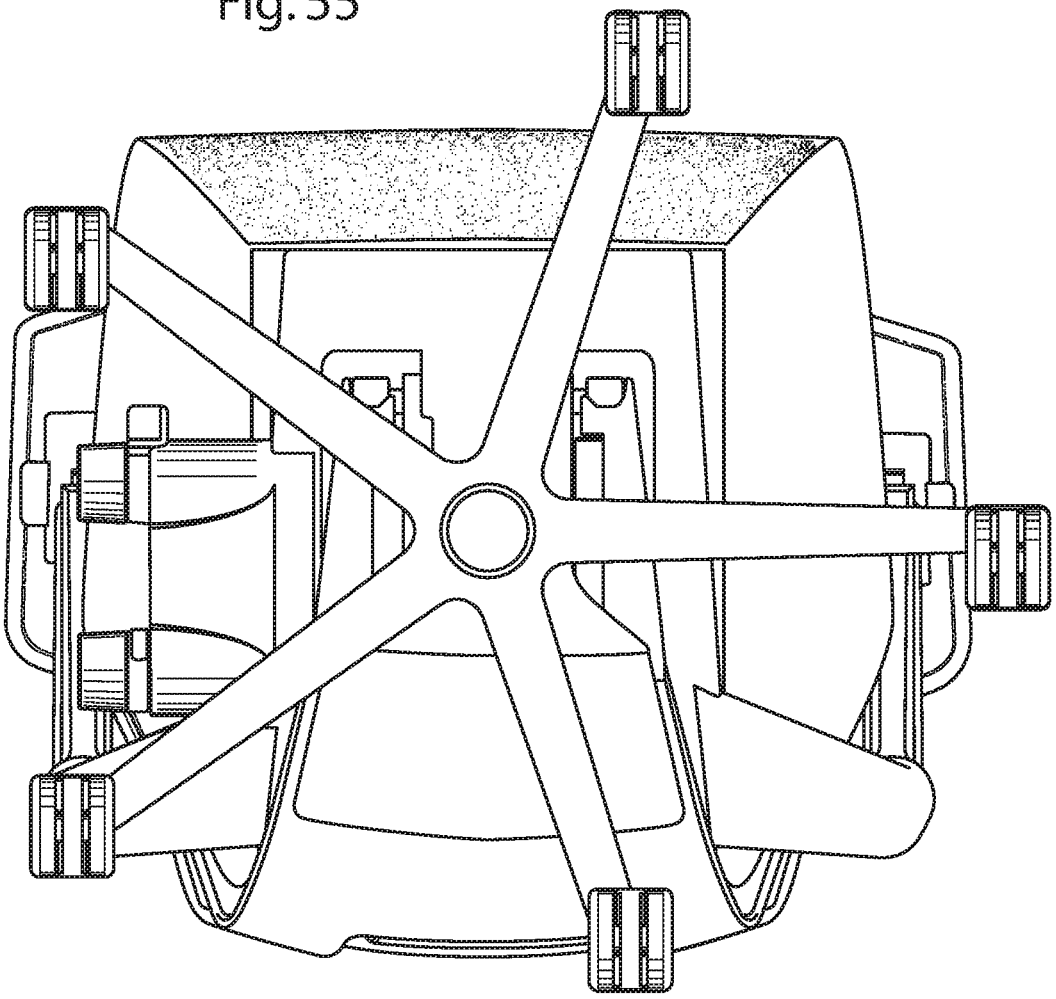
FIG. 55 is a bottom plan view of the alternative embodiment of the chair assembly.

A cam link 694 is also pivotably connected to seat support structure 626 for rotation about pivot point or axis 689. Cam link 694 has a curved lower cam surface 696 that slidably engages an upwardly facing cam surface 698 formed in back support structure 646. A pair of torsion springs 700 (FIG. 48) rotatably bias the back control link 600 and the cam link 694 in a manner that tends to increase the angle Ø (FIG. 43). The torsion springs 700 generate a force tending to rotate control link 600 in a counter-clockwise direction (FIG. 43), and simultaneously rotate cam link 694 in a clockwise direction (FIG. 43). Thus, torsion springs 700 tend to increase the angle Ø between back control link 600 and cam link 694. A stop 702 on seat support structure 626 limits counter-clockwise rotation of back control link 600 to the position shown in FIG. 43. This force may also bias control link 600 in a counter-clockwise direction into the stop feature.

As discussed above, the back shell 164 is flexible, particularly in comparison to the rigid back frame structure 150. As also discussed above, the back frame structure 150 is rigidly connected to the back support structure 646, and therefore pivots with the back support structure 646. The forces generated by torsion springs 700 push upwardly against lower portion 168 of back shell 164. The slots 184 in back shell structure 164 create additional flexibility at lumbar support portion 182 of back shell 164. The force generated by torsion springs 700 also tend to cause the lumbar portion 182 of the back shell 164 to bend forwardly such that the lumbar portion 182 has a higher curvature than the regions adjacent lumbar portion 182.

Figure 44:
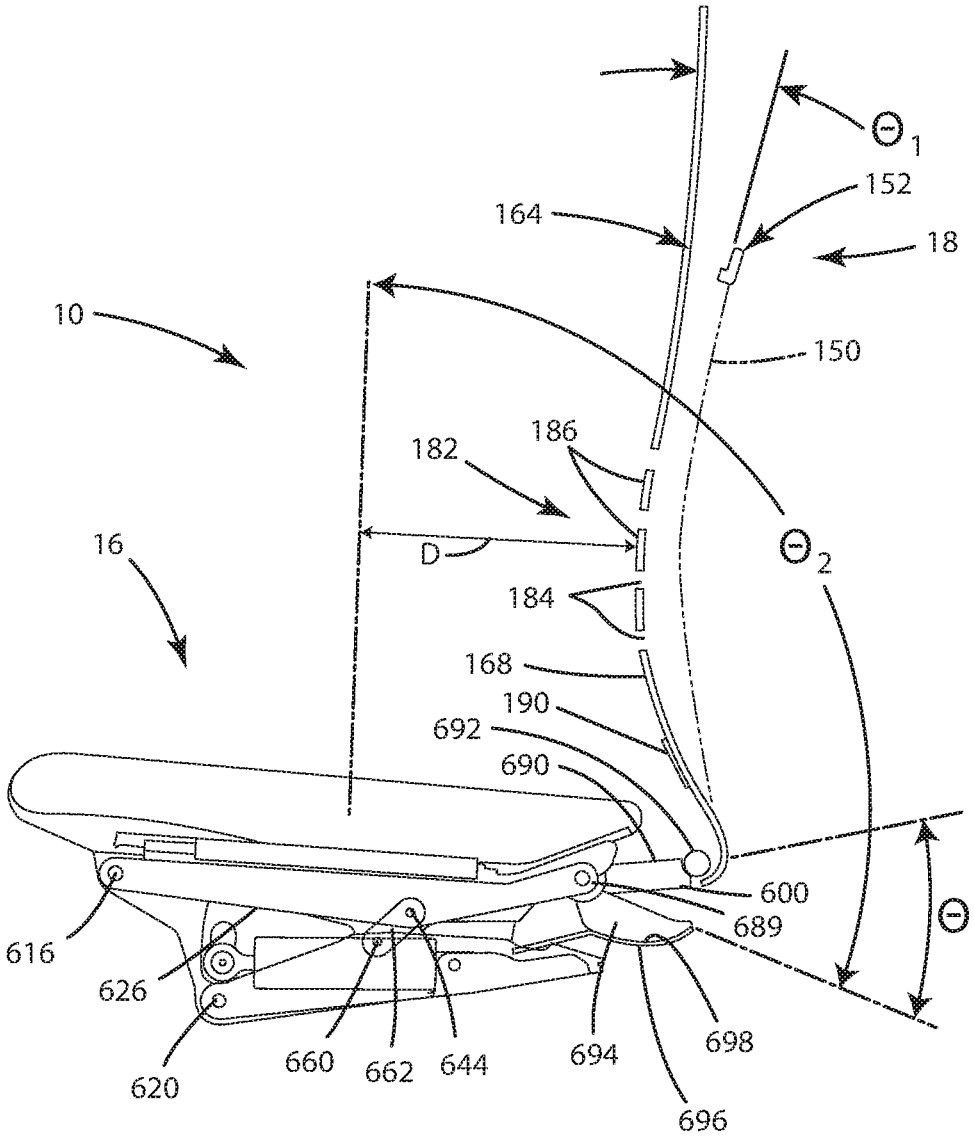
FIG. 44 is a cross-sectional view of the chair showing the back in an upright position with the lumbar portion adjusted to a flat configuration.

As discussed above, the position of lumbar assembly 246 is vertically adjustable. Vertical adjustment of the lumbar assembly 246 also adjusts the way in which the back shell 164 flexes/curves during recline of the chair back. In FIG. 43, the lumbar assembly 182 is adjusted to an intermediate or neutral position, such that the curvature of lumbar portion 182 of back shell 164 is also intermediate or neutral. With further reference to FIG. 44, if the vertical position of the lumbar assembly 246 is adjusted, the angle Ø is reduced, and the curvature of lumbar region 182 is reduced. As shown in FIG. 44, this also causes angle $Ø^1$ to become greater, and the overall shape of the back shell 164 to become relatively flat.

Figure 45:
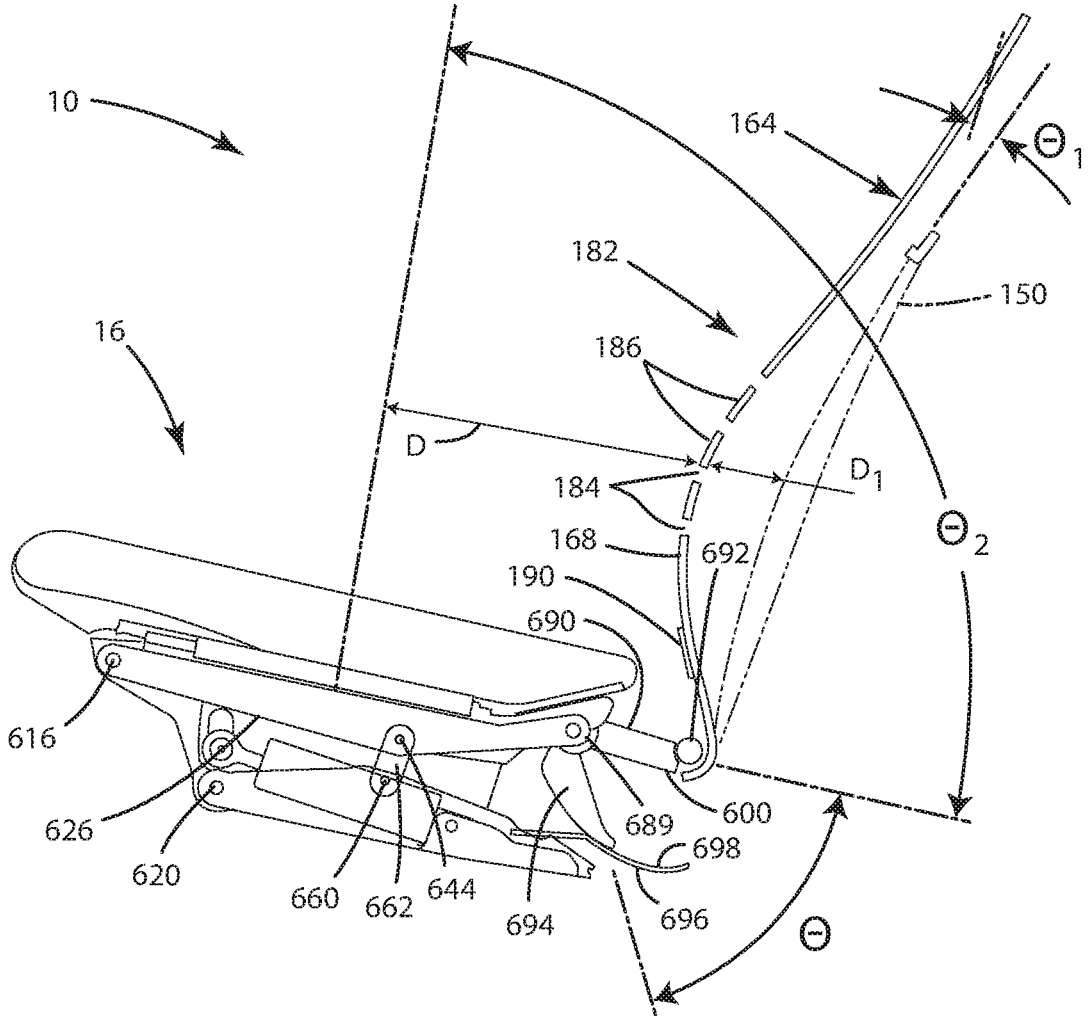
FIG. 45 is a cross-sectional view of the chair showing the back reclined with the lumbar adjusted to a neutral position.

With further reference to FIG. 45, if the height of lumbar assembly 246 is set at an intermediate level (i.e., the same as FIG. 43), and a user leans back, the four-bar linkage defined by links and structures 606, 626, 646, 662, and pivot points 620, 622, 644, 660 will shift (as described above) from the configuration of FIG. 43 to the configuration of FIG. 45. This, in turn, causes an increase in the distance between pivot point 688 and cam surface 698. This causes an increase in the angle Ø from about 49.5° (FIG. 43) to about 59.9° (FIG. 45). As the spring rotates towards an open position, some of the energy stored in the spring is transferred into the back shell 164, thereby causing the degree of curvature of lumbar portion 168 of back shell 164 to become greater. In this way, back control link 600, cam link 694, and a torsion springs 700 provide for greater curvature of lumbar portion 182 to reduce curvature of a user's back as the user leans back in the chair.

Also, as the chair tilts from the position of FIG. 43 to the position of FIG. 45, the distance D between the lumbar portion 182 and the seat 16 increases from 174 mm to 234 mm. A dimension $D^1$ between the lumbar portion 182 of back shell 164 and back frame structure 150 also increases as the back tilts from the position of FIG. 43 to the position of FIG. 45. Thus, although the distance D increases somewhat, the increase in the dimension $D^1$ reduces the increase in dimension D because the lumbar portion 182 of back shell 164 is shifted forward relative to the back frame 150 during recline.

Referring again to FIG. 43, a spine 704 of a seated user 706 tends to curve forwardly in the lumbar region 708 by a first amount when a user is seated in an upright position. As a user leans back from the position of FIG. 43 to the position of FIG. 45, the curvature of the lumbar region 708 tends to increase, and the user's spine 704 will also rotate somewhat about hip joint 710 relative to a user's femur 712. The increase in the dimension D and the increase in curvature of lumbar region or portion 182 of back shell 112 simultaneously ensure that a user's hip joint 710 and femur 712 do not slide on the seat 16, and also accommodate curvature of the lumbar region 708 of a user's spine 704.

Figure 46:
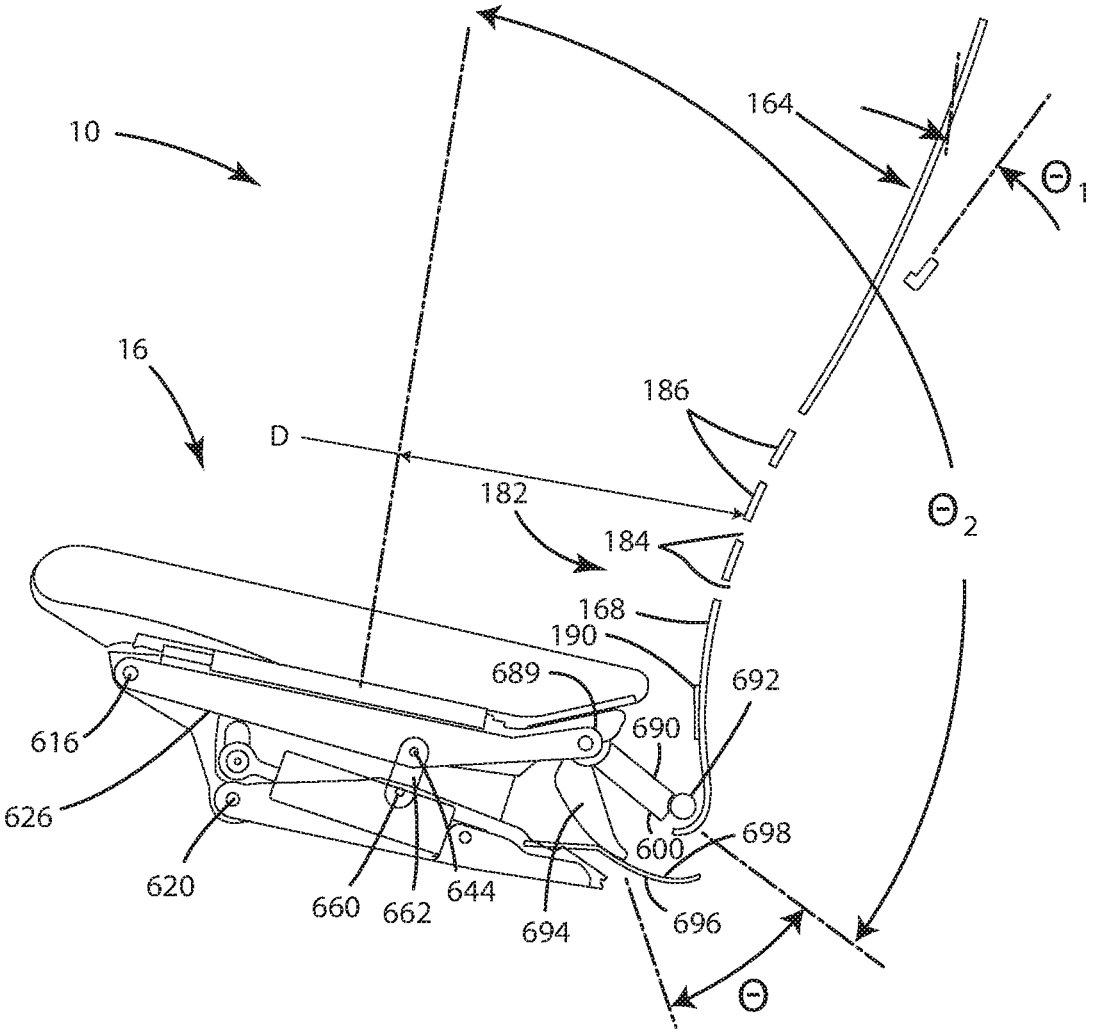
FIG. 46 is a cross-sectional view of the chair in a reclined position with the lumbar adjusted to a flat configuration.

As discussed above, FIG. 44 shows the back of the chair in an upright position with the lumbar region 182 of shell 164 adjusted to a flat position. If the chair back is tilted from the position of FIG. 44 to the position of FIG. 46, the back control link 700 and the cam link 694 both rotate in a clockwise direction. However, the cam link 694 rotates at a somewhat higher rate and the angle Ø therefore changes from 31.4° to 35.9°. The distance D changes from 202 mm to 265 mm, and the angle $Ø^1$ changes from 24.2° to 24.1°.

Figure 47:
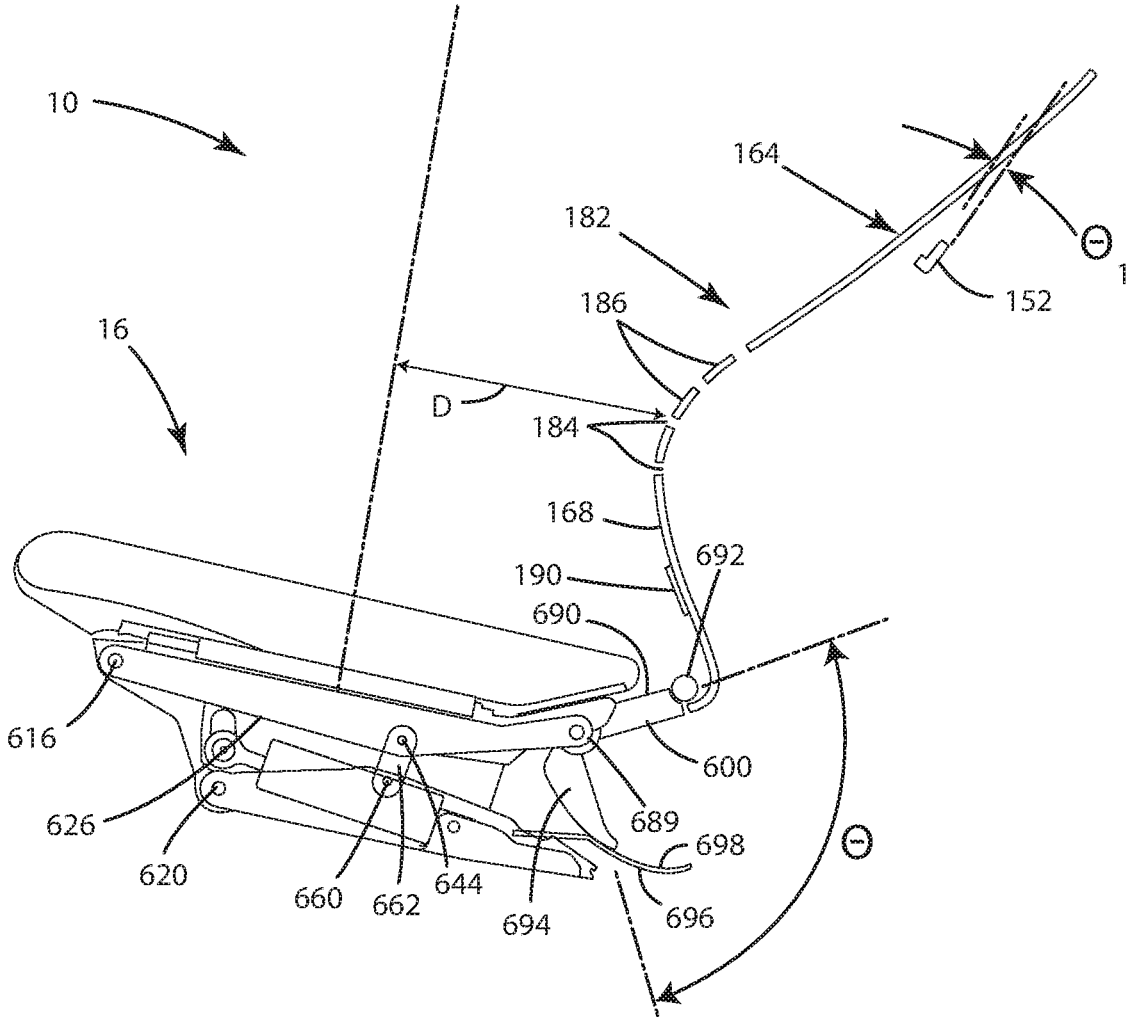
FIG. 47 is a cross-sectional view of the chair showing the back reclined with the lumbar portion of the shell set at a maximum curvature.

With further reference to FIG. 47, if the chair back is reclined, and the lumbar adjustment is set high, the angle Ø is 93.6°, and the distance D is 202 mm.

Thus, the back shell 164 curves as the seat back is tilted rearwardly. However, the increase in curvature in the lumbar region 182 from the upright to the reclined position is significantly greater if the curvature is initially adjusted to a higher level. This accounts for the fact that the curvature of a user's back does not increase as much when a user reclines if the user's back is initially in a relatively flat condition when seated upright. Restated, if a user's back is relatively straight when in an upright position, the user's back will remain relatively flat even when reclined, even though the degree of curvature will increase somewhat from the upright position to the reclined position. Conversely, if a user's back is curved significantly when in the upright position, the curvature of the lumbar region will increase by a greater degree as the user reclines relative to the increase in curvature if a user's back is initially relatively flat.

Figure 39:
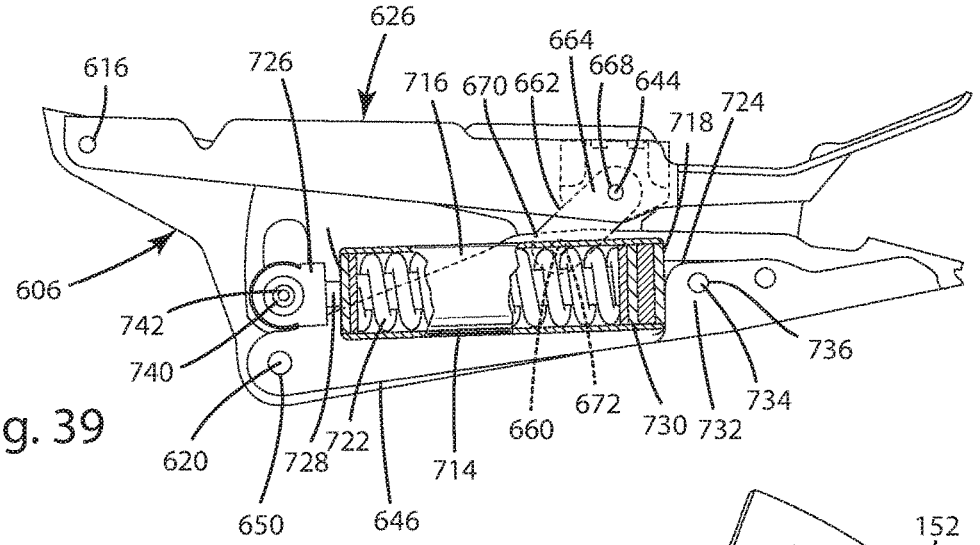
FIG. 39 is a side elevational view of the control input assembly.

A pair of spring assemblies 714 (FIGS. 37-39) bias the back assembly 18 from the reclined position F towards the upright position E. As best illustrated in FIG. 39, each spring assembly 714 includes a cylindrically-shaped housing 716 having a first end 718 and a second end 720. Each spring assembly 714 further includes a compression coil spring 722, a first coupler 724 and a second coupler 726. In the illustrated example, the first coupler is secured to the first end 718 of the housing 716, while the second coupler 726 is secured to a rod member 728 that extends through the coil spring 722. A washer 730 is secured to a distal end of the rod member 728 and abuts an end of the coil spring 722, while the opposite end of the coil spring 722 abuts the second end 720 of the housing 716. The first coupler 724 is pivotably secured to the back support structure 446 by a pivot pin 732 for pivoting movement about a pivot point 734, wherein the pivot pin 732 is received within pivot apertures 736 of the back support structure 646, while the second coupler 726 is pivotably coupled to a moment arm shift assembly 738 by a shaft 740 for pivoting about a pivot point 742. The moment arm shift assembly 738 is adapted to move the biasing or spring assembly 714 from a low tension setting to a high tension setting wherein the force exerted by the biasing assembly 714 on the back assembly 18 is increased relative to the low-tension setting.

In the foregoing description, it will be readily appreciated by those skilled in the art that modifications may be made to the invention without departing when the concept is disclosed. Such modifications are to be considered as included in the following claims, unless these claims by their language expressly state otherwise.

We claim:

1. A chair back assembly, comprising:

a back frame having a front surface and a rear surface and comprising a laterally extending frame portion having opposite end portions;

a back shell comprising a front surface, a rear surface positioned in front of the front surface of the back frame, a pair of laterally spaced side portions defining an opening therebetween, wherein the side portions are exclusively connected to the laterally extending frame portion at the opposite end portions of the laterally extending frame portion, wherein the connections between the side portions of the back shell and the opposite end portions of the laterally extending frame portion are the only connections between the side portions of the back shell and the back frame, and wherein the connections between the side portions of the back shell and the opposite end portions of the laterally extending frame portion are located above a lumbar support area of the back shell; and a cover extending across the opening and connected to the side portions of the back shell.

2. The chair back assembly of claim 1, wherein the cover covers the front surface of the back shell.

3. The chair back assembly of claim 2, wherein the cover is secured to an edge of the back shell.

4. The chair back assembly of claim 1, wherein the side portions are pivotally connected to the opposite end portions of the laterally extending frame portion.

5. The chair back assembly of claim 1, wherein the back frame comprises a vertically extending upright portion comprising opposite side surfaces and wherein the opposite end portions of the laterally extending frame portion are positioned laterally outward from at least a portion of the side surfaces of the vertically extending upright portion of the back frame.

6. The chair back assembly of claim 5, wherein the vertically extending upright portion includes a pair of side frame portions spaced from one another.

7. The chair back assembly of claim 1, wherein the cover is less compliant in a lateral direction than in a vertical direction.

8. The chair back assembly of claim 1, wherein the back shell comprises a forwardly extending first bottom portion, and wherein the back frame comprises a forwardly extending second bottom portion, wherein the second bottom portion is vertically spaced below the first bottom portion.

9. A chair comprising the chair back assembly of claim 8 and further comprising a base, wherein the first and second bottom portions are pivotally connected to the base.

10. The chair of claim 9, wherein the second bottom portion is directly pivotally connected to the base, and wherein the first bottom portion is connected to a seat support structure.

11. The chair of claim 10, wherein the seat support structure is pivotally connected to the base.

12. The chair of claim 11, further comprising a link member pivotally connecting the seat support structure and the base.

13. The chair back assembly of claim 1, wherein the cover comprises a thermoelastic knot or woven fabric material.

14. The chair back assembly of claim 1, wherein the back shell comprises a top portion connected to and extending between an upper end of the laterally spaced side portions.

15. The chair back assembly of claim 14, wherein the back shell comprises a bottom portion connected to and extending between a lower end of the laterally spaced side portions, wherein the bottom portion, the side portions and the top portion cooperate to define a ring, and wherein the cover is further connected to the top and bottom portions of the back shell.

16. A chair, comprising:

a base;

a seat support structure pivotally connected to the base;

a back frame comprising a front surface, a rear surface and a forwardly extending bottom portion pivotally connected to the base;

a back shell comprising a forwardly extending bottom portion connected to the seat support structure, a front surface, a rear surface positioned in front of the front surface of the back frame, a pair of laterally spaced side portions defining an opening therebetween, and a top portion extending laterally between and connected to the side portions, wherein each of the side portions are exclusively connected to the back frame at a first location; and a cover extending across the opening and connected to the side portions and the top portion of the back shell.

17. The chair of claim 16, further comprising:

a cross member separate from the back frame and the shell; and wherein the back shell further comprises a lateral portion extending between and connected to the side portions, and wherein the lateral portion and the cross member connect the side portions of the back shell and the end portions of the laterally extending frame portions at the first location.

18. The chair of claim 16, wherein each of the side portions of the back shell are connected to opposite end portions of a laterally extending frame portion of the back frame, wherein the back frame comprises a vertically extending upright portion comprising opposite side surfaces, and wherein the opposite end portions of the laterally extending frame portion are positioned laterally outward from at least a portion the side surfaces of the vertically extending upright portion of the back frame.

19. The chair of claim 16, wherein the cover comprises a thermoelastic knot or woven fabric material.

20. The chair of claim 16, wherein the first location is located above a lumbar support area of the back shell.

21. The chair of claim 16, wherein the cover covers the front surface of the back shell.

22. The chair of claim 21, wherein the cover is secured to an edge of the back shell.

23. The chair of claim 16, wherein the side portions are pivotally connected to the back frame at the first location.

24. A chair, comprising:

a base;

a back frame comprising an upright portion with a front surface, a rear surface and a forwardly extending first bottom portion pivotally connected to the base;

a shell spaced forwardly of the upright portion of the back frame and comprising laterally spaced side portions, a lower portion extending laterally between first ends of the side portions, and an upper portion extending laterally between opposite second ends of the side portions, wherein the upper and lower portions and side portions define a ring having a central opening, wherein each of the side portions are exclusively connected to the upright portion of the back frame at a first location positioned above a lumbar region of the shell, wherein the connections between the side portions of the shell and the upright portion of the back frame at the first location are the only connections between the side portions of the shell and the upright portion of the back frame; and a cover extending across the opening and connected to the side portions and the upper and lower portions of the shell.

25. The chair of claim 24, wherein the upright portion of the back frame includes a laterally extending frame portion having opposite end portions that are connected to the side portions of the shell.

26. The chair of claim 25, wherein the side portions are pivotally connected to the opposite end portions of the laterally extending frame portion.

27. The chair of claim 25, wherein the upright portion of the back frame comprises opposite side surfaces and wherein the opposite end portions of the laterally extending frame portion are positioned laterally outward from at least a portion the side surfaces of the upright portion of the back frame.

28. The chair of claim 25, wherein the cover is visible both above and below the laterally extending frame portion of the back frame when the chair is viewed from behind the chair.

29. The chair of claim 24, wherein the first location is located above a lumbar support area of the shell.

30. The chair of claim 24, wherein a width of the lower portion of the shell is less than a width of the upper portion of the shell.

31. The chair of claim 30, wherein a width of the shell at a location between the upper portion and the lower portion is greater than the width of the lower portion of the shell.

32. The chair of claim 24, further comprising:

a seat assembly configured to support a seated user, wherein the lower portion of the shell is positioned rearward of at least a majority of the seat assembly.

33. The chair of claim 24, wherein the cover is secured to an edge of the shell.

34. The chair back assembly of claim 14, further comprising:

a cross member having opposite end portions, wherein the opposite end portions of the cross member connect the opposite end portions of the laterally extending frame portion to the side portions of the back shell.

35. The chair back assembly of claim 34, wherein the back shell further comprises a lateral portion extending between and connected to the side portions, and wherein the lateral portion and the cross member connect the side portions of the back shell and the opposite end portions of the laterally extending frame portion.

36. The chair back assembly of claim 1, wherein the cover comprises a thermoplastic material.

37. The chair back assembly of claim 1, wherein the back shell and the cover are separate from one another.

38. The chair back assembly of claim 1, wherein the back frame and the back shell are separate from one another.

39. The chair back assembly of claim 1, wherein the cover is visible both above and below the laterally extending frame portion when viewed from behind the chair back assembly.

40. The chair back assembly of claim 1, wherein a width of the chair back assembly at a lower end of the chair back assembly is less than a width of the chair back assembly at an upper end of the chair back assembly.

41. The chair back assembly of claim 40, wherein a width of the chair back assembly at a location between the lower and the upper end of the chair back assembly is greater than the width of the chair back assembly at the lower end of the chair back assembly.

* * * * *